US005911414A

United States Patent [19]

Kato et al.

[11] Patent Number: 5,911,414

[45] Date of Patent: Jun. 15, 1999

[54] SHEET TRANSPORT APPARATUS HAVING A HOLE PUNCHER, AND SHEET PROCESSING DEVICE

[75] Inventors: Katsuhito Kato, Toride; Noriyoshi Ueda, Kashiwa; Yoshifumi Takehara, Abiko; Naho Saitoh, Toride; Kazuyuki Iwamoto, Abiko; Kenichi Hayashi; Wataru Kawata, both of Kashiwa, all of Japan

[73] Assignee: Canon Kabushiki Kaisha, Tokyo, Japan

[21] Appl. No.: 08/997,734

[22] Filed: Dec. 24, 1997

[30] Foreign Application Priority Data

Dec. 27, 1996 [JP] Japan ..... 8-350599
Jan. 10, 1997 [JP] Japan ..... 9-002622

[51] Int. Cl.[6] ..... B65H 31/00; G03G 15/00

[52] U.S. Cl. ..... 270/58.07; 83/684; 234/38; 399/407

[58] Field of Search ..... 399/407, 408; 270/58.01, 58.07; 83/167, 345, 591, 592, 684, 691, 405; 234/35, 38, 40

[56] References Cited

U.S. PATENT DOCUMENTS 5,239,904 8/1993 Yamaguchi et al. ..... 83/684 X
5,746,162 5/1998 Hosoi et al. .

FOREIGN PATENT DOCUMENTS 6-278095 10/1994 Japan .
7-098522 4/1995 Japan .
9-193093 7/1997 Japan .

*Primary Examiner*—William Royer
*Assistant Examiner*—Sophia S. Chen
*Attorney, Agent, or Firm*—Fitzpatrick, Cella, Harper & Scinto

[57] ABSTRACT

A sheet transport apparatus has a puncher for punching a hole in a sheet as the sheet is being transported through a transport path, and a transport device for clamping and transporting the sheet, the transport device being disposed downstream of the puncher and having a first rotation member and a second rotation member for pressing the sheet into contact with the first rotation member, the transport device being disposed at a position where a hole punched by the puncher passes through.

21 Claims, 49 Drawing Sheets

SHEET TRANSPORT APPARATUS HAVING A HOLE PUNCHER, AND SHEET PROCESSING DEVICE

BACKGROUND OF THE INVENTION

1. Field of the Invention

The present invention relates to a sheet transport apparatus having a puncher for punching a hole in the sheet, and more particularly, to a sheet transport apparatus having the function of, for example, sorting, or a sheet transport apparatus for use in an image forming apparatus such as a copying machine.

2. Description of the Related Art

Previously, in order to file in a binder a sheet bundle output from an image forming apparatuses such as a printer and a copying machine, sheet hole punchers were provided separately from the apparatuses.

These hole punchers punched by one operation the ejected sheet bundle having images formed thereon, and it was necessary to set the sheet bundle manually in the hole puncher, thereby decreasing productivity. In addition, in cases where the bundle had a large number of sheets, punches and dies of the punchers were overloaded, and a significant force was required for punching. At the same time, the punches and the dies wore out, resulting in bad punching and the production of burrs. Therefore, it was necessary to perform several punching operations by dividing the sheet bundle into a predetermined number of sheets, and this further decreased productivity.

A sheet processing device has been proposed in which a hole puncher is provided on a transport path, and a sheet bundle loaded on a processing tray provided in the image forming apparatus is hole punched in one operation. This allows for the previous operation of setting the sheet bundle in the puncher to be omitted, thereby increasing operational efficiency.

In the above device, however, the next sheet cannot be transported during the punching operation of the sheet bundle while the sheet bundle loaded on the processing tray is being punched in one operation, and it is difficult to increase the sheet transporting speed of the image forming apparatus. In addition, the punching operation must be performed for each of a predetermined number of sheets due to the fact that the sheet bundle is punched in one operation.

Thus, a sheet processing device shown in FIG. 9 has been proposed in which a multiple-hole puncher 51 composed of a rotary punch 52 and die 53 is provided on a sheet transport path 50, and the sheet transport speed is in synchronization with the rotation speed of the punch 52 and die 53. With this, the sheets P in transportation can be punched one by one without stopping transportation of the sheet.

In the above conventional device, however, a burr P1 may sometimes be produced around a punched hole of a sheet P when the sheet P is cardboard, and the punch 52 and the die 53 are worn. At this time, since the sheet P passes through the sheet transport path 50 after the punching operation, the burr P1 rubs over the inner wall of the sheet transport path 50 to generate frictional resistance. This may generates flaws and tears on the sheet P, and cause bad transportation.

In addition, as shown in FIGS. 10A and 10B, in a sheet processing device, such as a sorter, in which the sheet P is ejected on an eject tray 54 and registered, the trailing end of the sheet P to be ejected may be caught by the burr P1 of the previously ejected and loaded sheet P to cause bad loading. In addition, when performing registration in the direction perpendicular to the direction of ejection, punched holes of the previously ejected sheet P and the later ejected sheet P may be caught by each other to cause bad registration.

SUMMARY OF THE INVENTION

Accordingly, it is an object of the present invention to provide a sheet transport apparatus which does not cause bad sheet transportation or bad registration even if a burr is produced around a punched hole.

In one aspect of the invention, there is provided a sheet transport apparatus comprising a puncher for punching a hole in a sheet as the sheet is being transported in a transport path, and transport means for clamping and transporting the sheet, the transport means disposed downstream of the puncher and having a first rotation member and a second rotation member for pressing the sheet into contact with the first rotation member, wherein the transport means is disposed at a position where a hole punched by the puncher passes through.

In yet another aspect of the present invention, there is provided a sheet processing device with a guide means for forming a sheet transport path, a sheet puncher provided in the sheet transport path for punching a hole in a punching region of the sheet, conveyor rotation members provided in the sheet transport path, the conveyor rotation members provided downstream of the sheet puncher and overlapping the punching region of the sheet, and a first tray provided downstream of the conveyor rotation members for receiving and loading thereon the punched sheet.

According to the described configuration, the punched position of the sheet is pressed into contact with the transport means. Thus, even if a burr is produced on the punched hole, the burr can be crushed.

Therefore, a sheet jam on the sheet transport path, and bad loading of the sheet on a tray caused by the burr can be prevented.

In addition, when the multiple-hole puncher is provided on the sheet transport path, by providing the rotation member pairs downstream of the puncher as the transport means which are formed successively over a region wider than punching region of the puncher, the same effect as that described above can be obtained even if the number of holes increases, and the rotation member pairs can comply with the multiple-hole puncher.

DESCRIPTION OF THE PREFERRED EMBODIMENTS

A sheet transport apparatus having a hole puncher, a sheet processing device, and an image forming apparatus according to the present invention will be described with reference to the attached drawings.

[First Embodiment]

Figure 1:
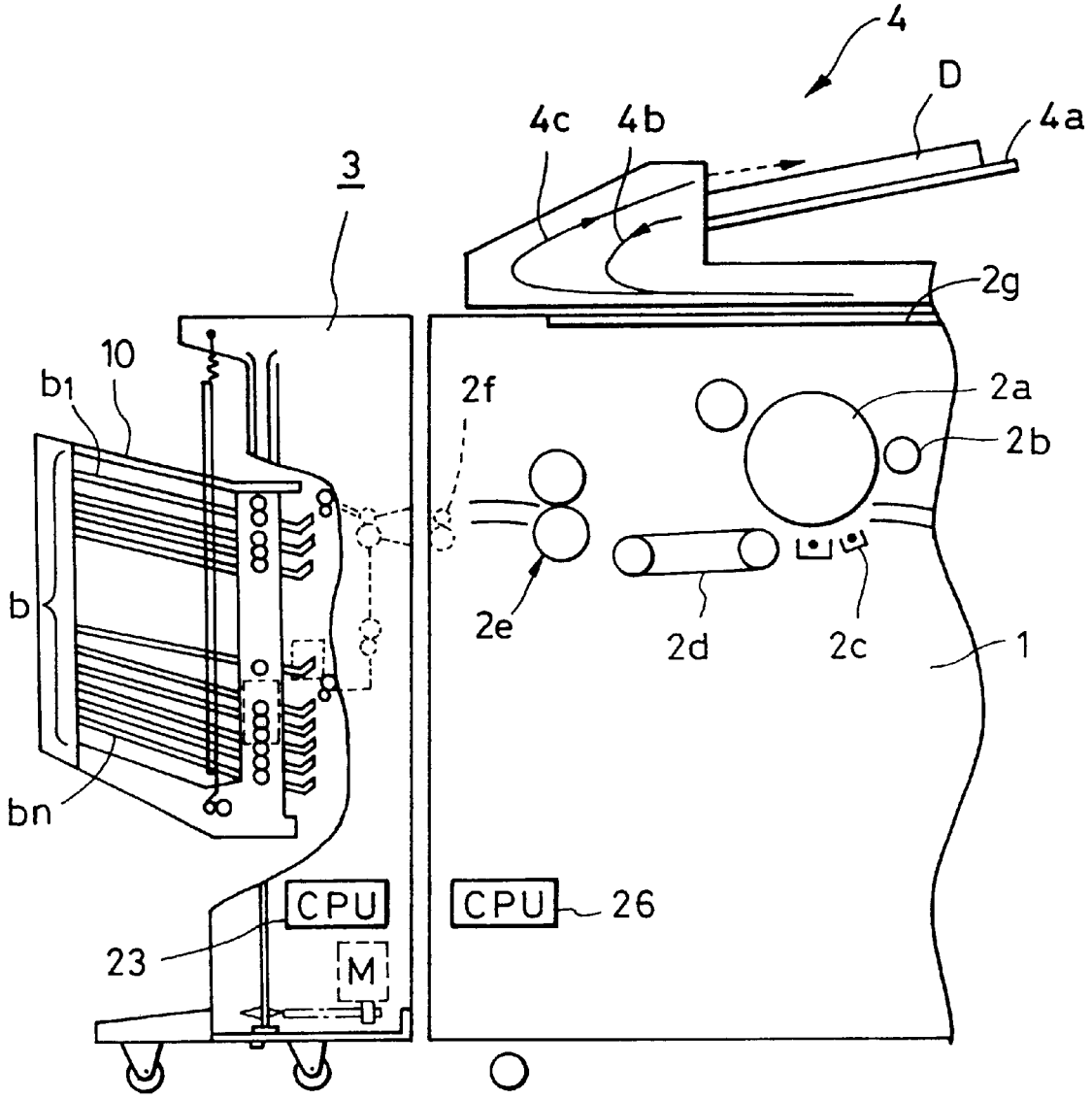
FIG. 1 is a schematic sectional view showing a schematic configuration of an image forming apparatus including a sheet processing device.
Figure 2:
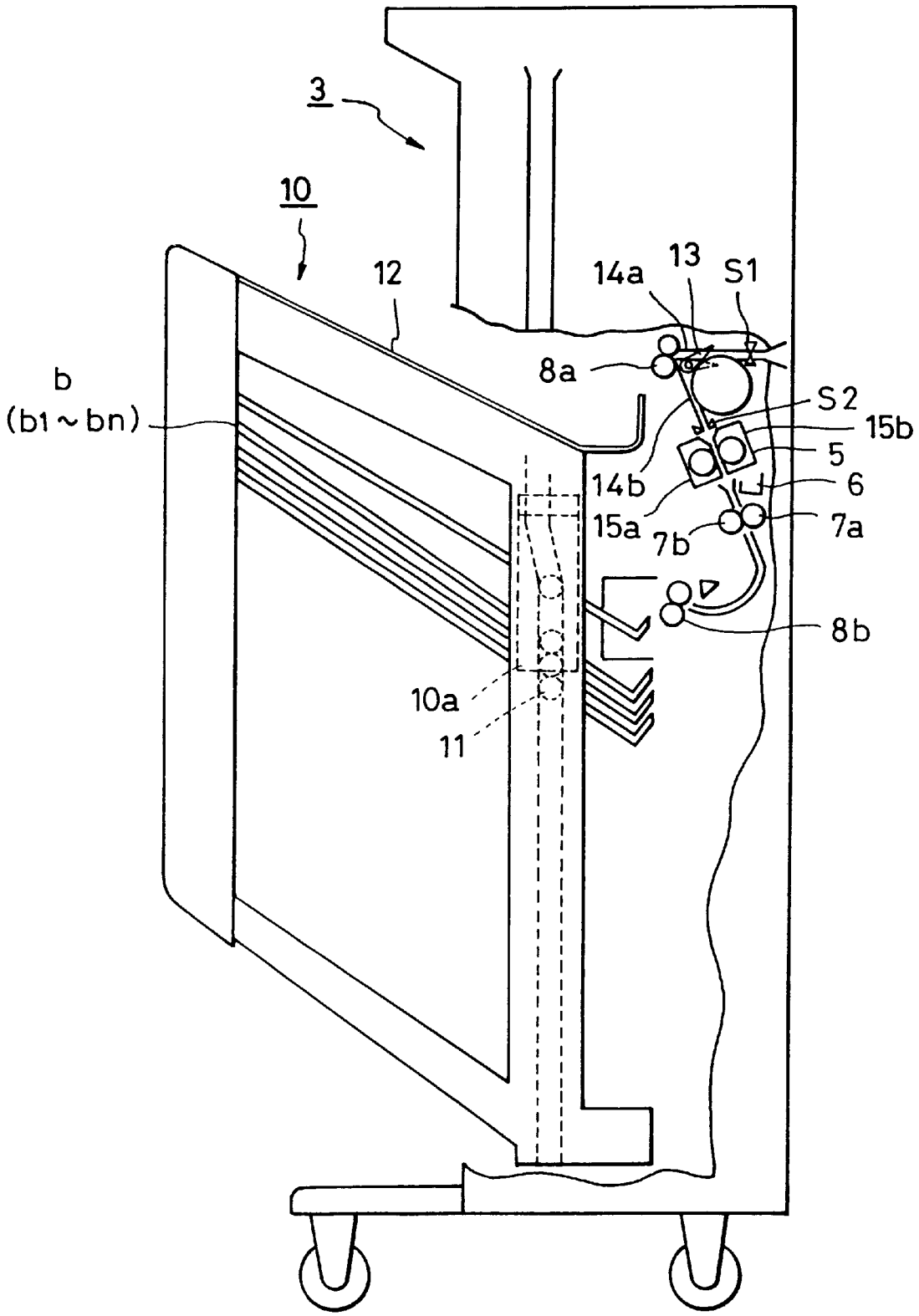
FIG. 2 is a partially sectional view of the sheet processing device according to a first embodiment of the present invention.
Figure 3:
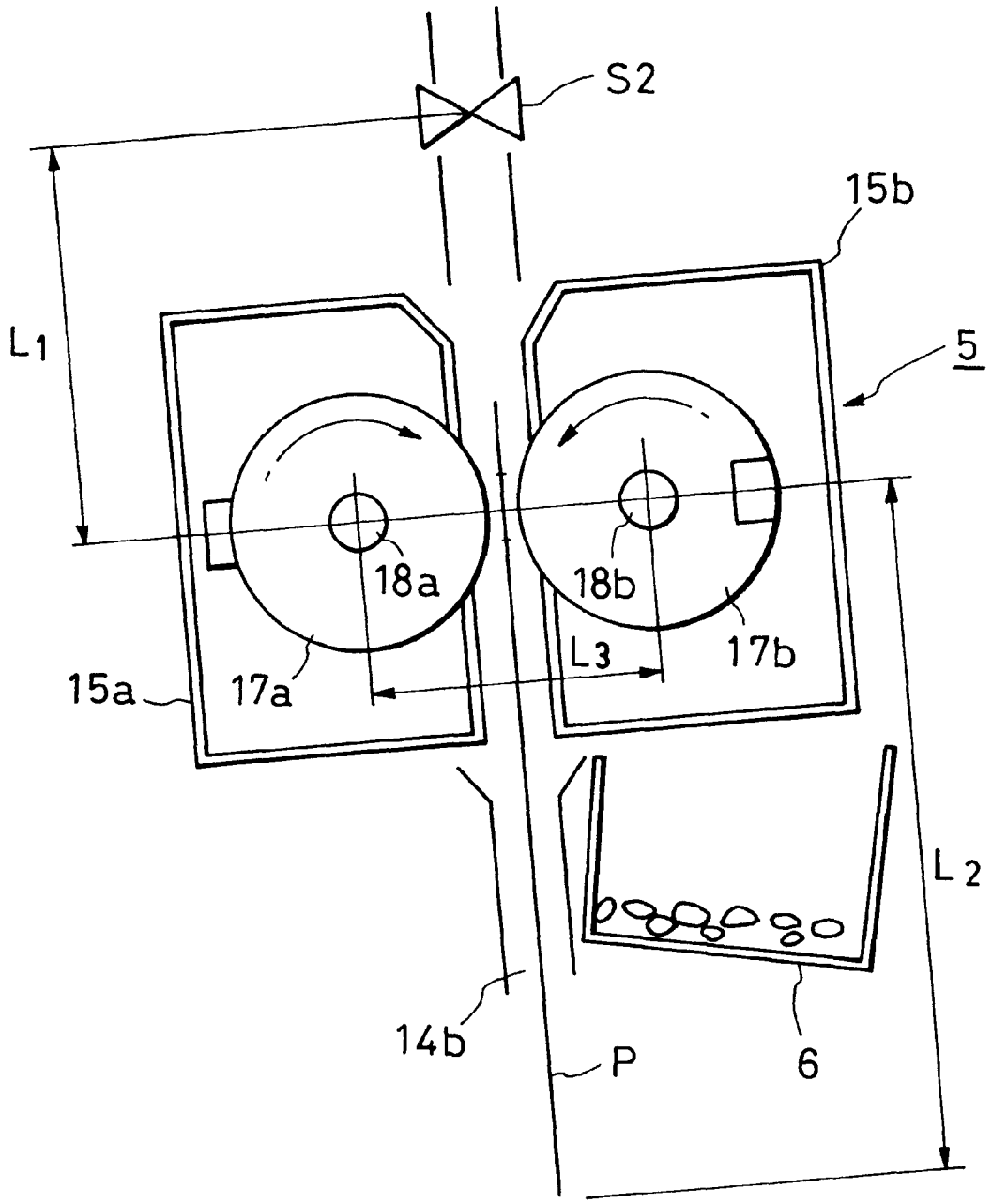
FIG. 3 is a sectional side view of a puncher according to the first embodiment.
Figure 4B:
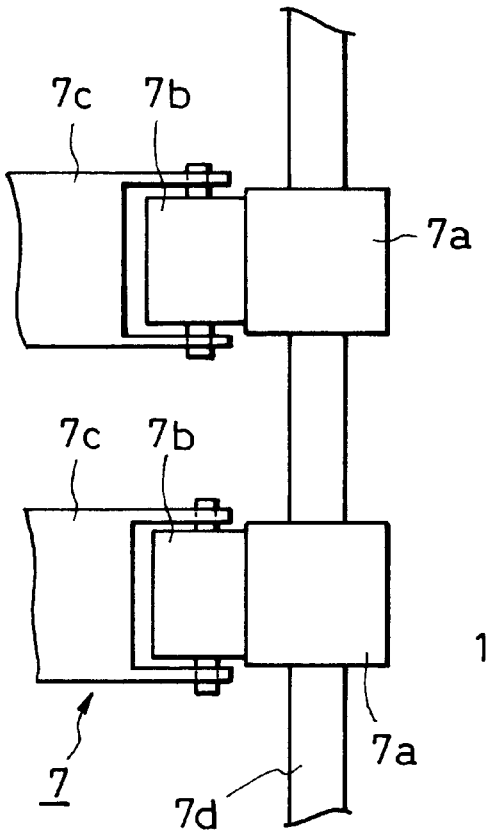
FIGS. 4A and 4B are illustrations of the puncher and press-contact roller pairs according to the first embodiment.
Figure 4A:
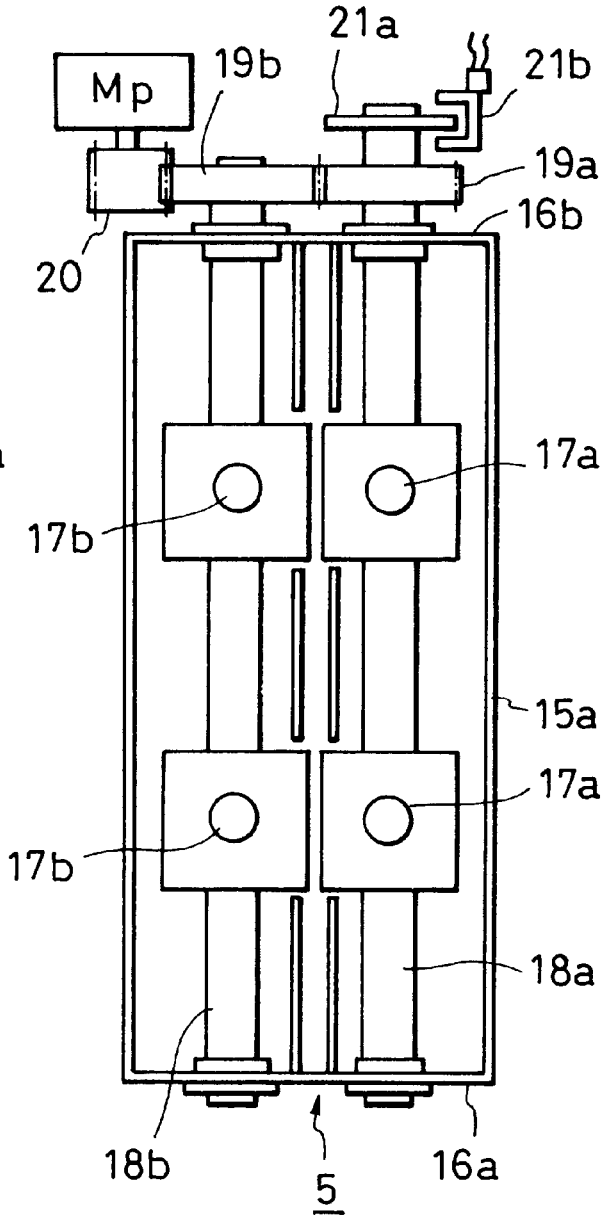
Figure 5:
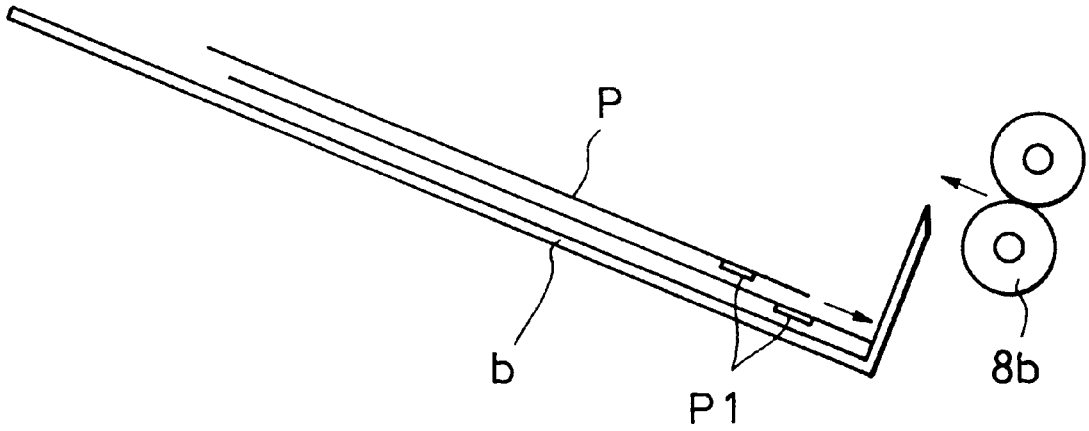
FIG. 5 is a view showing a state of a sheet loaded on a bin tray.
Figure 6:
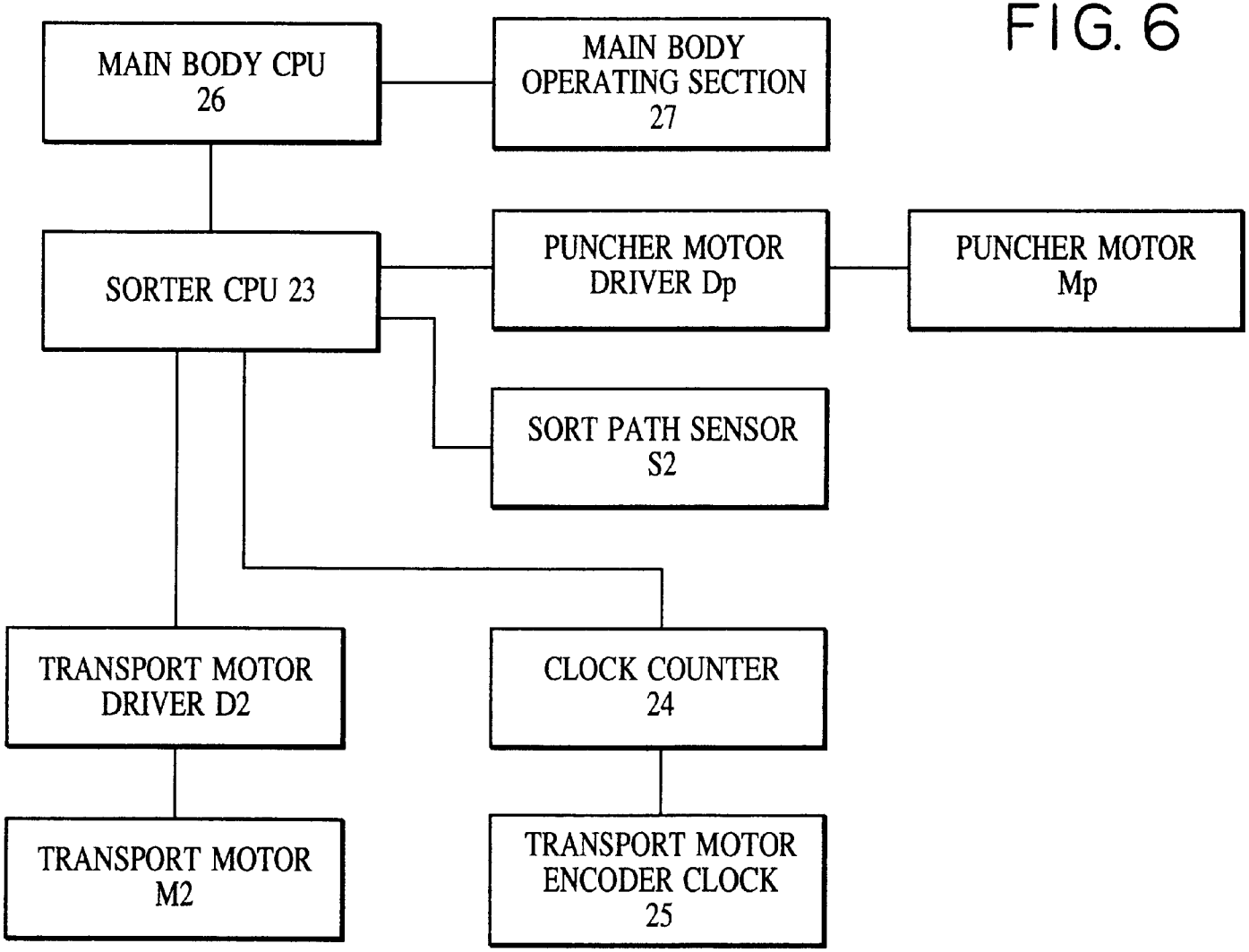
FIG. 6 is a block diagram of a control system in the apparatus.

A first embodiment of the sheet transport apparatus, and of the image forming apparatus according to the present invention will be described with reference to the drawings. Their structure and operation will be described. In the following embodiment, an example is described in which the present invention is applied to a transport system of a sheet processing device for use in an image forming apparatus. FIG. 1 is a schematic sectional view showing a schematic configuration of the image forming apparatus including the sheet processing device, FIG. 2 is a partially sectional view of the sheet processing device according to this embodiment, FIG. 3 is a sectional side view of a puncher according to this embodiment, FIGS. 4A and 4B are illustrations of the puncher and press-contact roller pairs according to this embodiment, FIG. 5 is a view showing a state of a sheet loaded on a bin tray, and FIG. 6 is a block diagram of a control system in the apparatus.

(Image forming apparatus)

The configuration of the image forming apparatus will be briefly described with reference to FIGS. 1 to 6. An automatic document feeding device 4 for automatically circulating a document is provided on the top surface of an image forming apparatus 1, and a sheet processing device 3 (hereinafter, referred to as "sorter 3") having n number of bin trays b (b1, b2, . . . bn) is attached to the downstream (the left side in the drawing) of the image forming apparatus 1.

The image forming apparatus 1 employs a known electrophotographic method. Although a detailed description is omitted here, an image of a document located on a platen glass 2*g* is formed on a photoconductive drum 2*a*, and is formed into a toner image by a developing device 2*b* provided around the photoconductive drum 2*a*. The toner image is transferred onto sheet P by a transfer device 2*c* and sheet P then separates from the photoconductive drum 2*a* and is carried by a conveyor belt 2*d* to a fixing device 2*e* where it is permanently fixed on the sheet P. A series of these operations are performed following instruction by a user through a main body operating section 27 (see FIG. 6), and controlled by a main body CPU 26.

(Document feeding device)

The automatic document feeding device 4 feeds a lowermost sheet of a document bundle D laid on a document pad 4*a* on the platen glass 2*g* through a feed path 4*b*, and places the sheet on the top surface of the document bundle D again through an eject path 4*c* after information on the document surface has been read.

(Sheet processing apparatus)

A sorter 3, which is a sheet processing device, is a so-called bin-moving sorter, and a plurality of bin trays b for loading and storing sheet materials are accommodated in a bin unit 10. Bin rollers 11 provided in both sides of the bin unit 10 are moved up and down by the rotation of a helical cam 10*a*, whereby the bin trays b stored in a vertical direction ascend or descend one by one.

In the sorter 3, a transport path of the sheet P is divided into a non-sort path 14*a* with sensor S1 for non-sorting of the sheet P, and a sort path 14*b* with sensor S2 for sorting the sheet P. The sheet P is guided to either of the paths by the action of a flapper 13.

The non-sort path 14*a* is provided with an eject roller pair 8*a* so as to eject the sheet P on a non-sort tray 12. The sort path 14*b* is provided with a puncher 5 for hole punching the sheet P, and press-contact roller pairs 7*a*, 7*b*, which are transport means for clamping and transporting the sheet P, are provided downstream of the puncher 5. The puncher 5 and the press-contact roller pairs 7*a*, 7*b* will be described below in detail.

In addition, the sorter 3 is provided with a sorter CPU 23 for controlling the operations of the components and a motor M. The sorter CPU 23 is connected to the main body CPU 26, whereby the components provided inside the sorter 3 can be actuated in association with the operation of the main body.

(Puncher)

As shown in FIG. 3 and FIG. 4A, the sort path 14*b* is provided with the puncher 5 and a chip box 6 for containing chips discharged from the puncher 5. The chip box is of a detachable type so that the user can dispose of the chips. In addition, a sort path sensor S2 is provided upstream of the puncher 5, so that the sheet to be transported can be detected.

In this embodiment, the puncher 5 is composed of two punches 17*a* rotating in a transport direction such that the peripheral speed equals the transport speed, and two dies 17*b* rotating in synchronization with the punches 17*a* and opposing the punches 17*a* such that the sort path 14*b* is sandwiched therebetween. The punches 17*a* and the dies 17*b* are mounted on a shaft 18*a* and a shaft 18*b*, respectively, to be opposed to each other, and accommodated in a frame 15*a* and a frame 15*b*, respectively. These frames 15*a* and 15*b* are supported by side plates 16*a* and 16*b* to form spaces following the sort path 14*b*, thereby constituting a part of the sort path 14*b*. In addition, the punches 17*a* are disposed on the left side of FIG. 3 where the surface of the sheet P faces upward when loaded on the bin tray b.

The shafts 18*a* and 18*b* includes gears 19*a* and 19*b*, respectively, and the gears 19*a* and 19*b* are sequentially meshed with a gear 20 mounted to a drive shaft of a puncher motor Mp. Therefore, when the puncher motor Mp is driven, the shafts 18*a* and 18*b* rotate, and the punches 17*a* and the dies 17*b* rotate in the transport direction. At this time, by adjusting phases of the punches 17*a* and the dies 17*b* so that a projection of each punch 17*a* is engaged with a recess of each die 17*b* on a straight line connecting the shafts 18*a* and 18*b*, the sheets entering the puncher 5 can be punched continuously.

In addition, a home position flag 21*a* and a sensor 21*b* are provided on the upper end of the shaft 18*a*. The home position flag 21*a* is detected by the sensor 21*b*, whereby home positions of the punches 17*a* and the dies 17*b* can be detected.

(Transport means)

The press-contact roller pairs 7 for clamping and transporting the punched sheet P are provided downstream of the puncher 5. As shown in plan view of FIG. 4B, each of the press-contact roller pair 7 is composed of a press-contact roller 7*a* as a first rotation member, and an urged roller 7*b* as a second rotation member which is urged by a plate spring 7*c* with respect to the press-contact roller 7*a*. Since the urged rollers 7*b* are urged to the press-contact rollers 7*a*, the sheet P can be clamped and transported by driving a press-contact roller shaft 7*d* by a transport motor M2. The rollers 7*a* are drive rollers and are formed of rubber, and the rollers 7*b* are formed of resin.

The press-contact rollers 7*a* are provided at two positions on the press-contact roller shaft 7*d*, i.e. at the positions corresponding to the above two pairs of the punches 17*a* and the dies 17*b*. Further, at positions opposite to the respective press-contact rollers 7*a*, the respective urged rollers 7*b* are urged by the respective plate spring 7*c*. Each of the nip widths between the press-contact rollers 7*a* and the urged rollers 7*b* is formed sufficiently larger than a diameter of a hole punched by the puncher 5 so that the punched hole passes through the nip of the press-contact roller pairs 7 even if the sheet shifts sideways or obliques.

(Operation)

The operation of the apparatus as described above will now be described. First, the sheet P on which an image is formed by the image forming apparatus 1 is fed to a sorter 3 through an eject roller pair 2*f*.

In the sorter 3, the sheet P is directed to the sort path 14*b* or the non-sort path 14*a* by the flapper 13. As shown in FIG. 2, at the time of non-sorting (when the flapper 13 is in the position shown by the chain line), the sheet P is ejected by the eject roller pair 8*a* passing through the non-sort path 14*a*, and loaded on the non-sort tray 12 provided on the top surface of the bin unit 10.

At the time of sorting (when the flapper is in a position shown by the solid line), the sheet P is ejected by the eject roller pair 8*b* passing through the sort path 14*b*, and accommodated in respective bin trays b which ascend and descend in synchronization with each other.

When punching of the sheet P is instructed during sorting, the punching is performed by the puncher 5 provided in the sort path 14*b*. In this embodiment, in order to accurately perform the punching in a predetermined position of the trailing end of the sheet P without stopping the sheet P, the following configuration and the sequence shown in FIG. 6 are employed. FIG. 6 is a block diagram of this embodiment.

During transportation of the sheet P, the transport motor M2 is driven by a transport motor driver D2 on the instruction of the sorter CPU 23. When the sort path sensor S2 detects the leading end of the sheet, the sensor S2 transmits a signal to the sorter CPU 23. The sorter CPU 23 starts to calculate outputs of the transport motor M2 by a clock counter 24 through a transport motor encoder clock 25.

Here, as shown in FIG. 3, it is assumed that the transport speed of the sheet P is V, the distance between the sort path sensor S2 and the center of the punch position of the puncher 5 is L1, the distance between the leading edge of the sheet and the predetermined punch position is L2, and the distance between the shafts 18*a* and 18*b* is L3 (substantially equivalent to the diameter of the punch 17*a* or the die 17*b*). In addition, the positions of the punch 17*a* and the die 17*b* rotated by 180° from the engagement center thereof are set as home positions.

The distance between the on-edge of the sort path sensor S2 and the leading end of the sheet P is given by the expression $L1+L2-\pi L3/2$ and is measured by the clock counter 24 at the same time. A puncher motor Mp is driven by a puncher motor driver Dp to rotate the punches 17*a* and the dies 17*b* one rotation at a peripheral speed equal to the above transport speed V in synchronization with the sheet P. Then, the punches 17*a* and the dies 17*b* rotate by 180° to be engaged with each other when the trailing end of the sheet P passes through the puncher 5, so that the sheet P is punched, whereby the punching can accurately be performed in a predetermined position of the trailing end of the sheet P without stopping the sheet P.

In addition, the punch position can be controlled by controlling the above measured distance. That is, by extending the above distance, the punch position approaches the trailing end of the sheet P, and by shortening the above distance, the punch position moves away from the trailing end of the sheet P. The user can set the punch position from the main body operating section 27 connected to the main body CPU 26.

The sheet P punched by the puncher 5 is transported downstream to reach the press-contact roller pairs 7. Since the two pairs of the press-contact rollers 7 are disposed corresponding to the positions of the punches 17*a* and the dies 17*b*, respectively, the punched portion of the sheet P is clamped and transported by the press-contact roller pairs 7.

By setting the urging force of the plate spring 7*c* to a predetermined value, a burr on the edge of the hole of the sheet P produced during the punching is completely crushed when passing through the press-contact roller pairs 7. Therefore, the sheet P can smoothly pass in the transport path at the downstream of the press-contact rollers 7, and can be smoothly ejected and loaded on the bin tray b without being caught by the burr.

In addition, the punches 17*a* are disposed at positions where the surface of the sheet P faces upward when loaded on the bin tray b, so that the burr of the sheet P faces downward on the bin tray b, as shown in FIG. 5. Therefore, the sheet P loaded on the bin tray b can be excellently registered with the sheet which is already loaded on the bin tray b, without being caught by its burr.

The eject roller pair 8*b* provided downstream of the press-contact roller pairs 7 may be provided at the position corresponding to the two pairs of the punches 17*a* and the dies 17*b*. This allows the burr to be crushed with certainty, whereby the sheet P can be more smoothly loaded on the bin tray b.

[Second Embodiment]

Figure 7B:
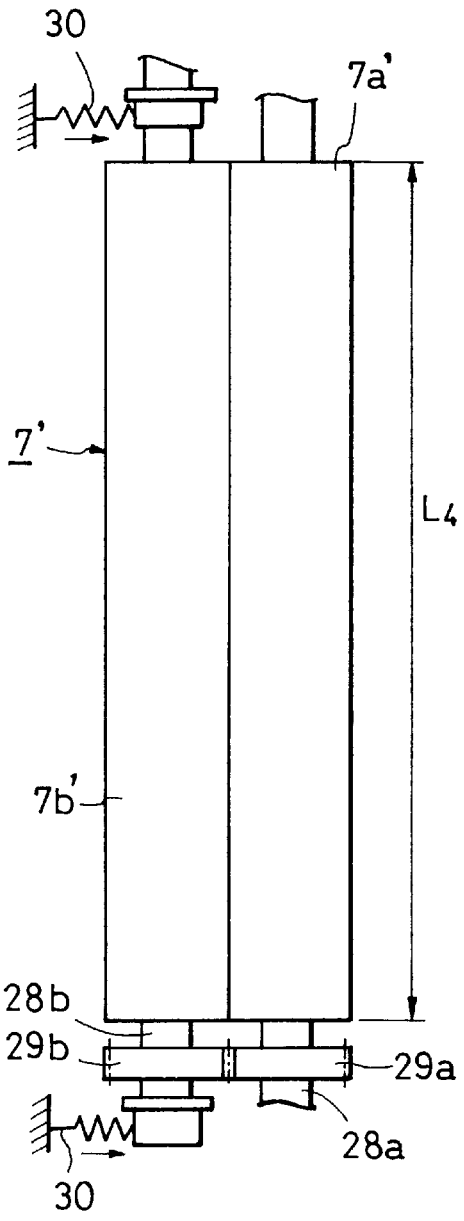
FIGS. 7A and 7B are illustrations of a puncher and a press-contact roller pair according to a second embodiment.
Figure 7A:
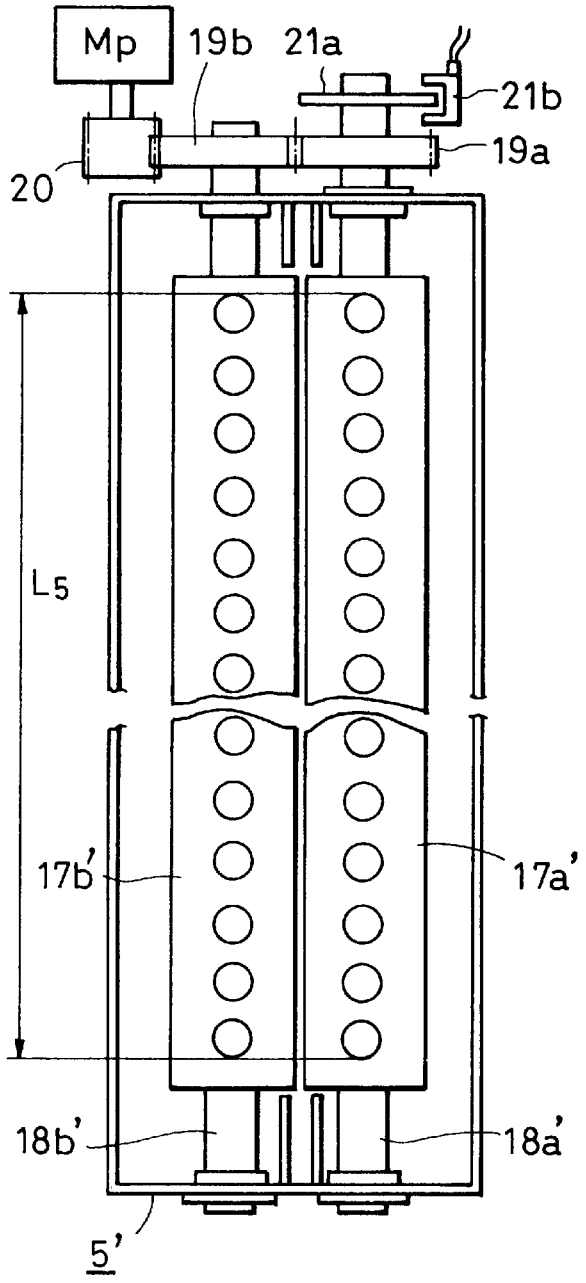

A second embodiment according to the present invention will be described with reference to FIGS. 7A and 7B. The same components as those of the first embodiment are indicated by the same numerals, and their description will be omitted. FIGS. 7A and 7B illustrate a puncher and a press-contact roller pair.

In this embodiment, a multiple-hole puncher 5' for punching a plurality of holes (thirty holes in this embodiment) is used as the puncher, and the puncher 5' is provided at the same position as that of the first embodiment. In addition, a reflection-type sheet detection sensor is used as a sort path sensor S2 (FIG. 2) so as not to be caught by punched holes.

A press-contact roller pair 7' for clamping and transporting the punched sheet P is provided downstream of the puncher 5'. The press-contact roller pair 7' is composed of a press-contact roller 7*a*' as a first rotation member, and an urged roller 7*b*' as a second rotation member which is urged by a spring 30 with respect to the press-contact roller 7*a*'. In addition, a roller region (nip region) L4 of the press-contact roller pair 7' is formed to have the width wider than that of a punching region L5 of punches 17*a*' and dies 17*b*' of the puncher 5' (L4>L5).

Gears 29*a* and 29*b* provided on one end of shafts 28*a* and 28*b* of the press-contact roller 7*a*' and the urged roller 7*b*', respectively, are meshed with each other, and the drive of a transport motor M2 (see FIG. 6) is transmitted through the gears 29*a* and 29*b* to rotate the sheet in the transport direction. In this embodiment, a rubber roller is used as the press-contact roller 7*a*', and a metal roller is used as the urged roller 7*b*'.

By setting the urging force of the spring 30 to a predetermined value similar to the first embodiment, the burrs of the holes produced at the time of punching are completely crushed when the sheet P passes through the press-contact roller pair 7'. In addition, since the nip width between the press-contact roller 7*a*' and the urged roller 7*b*' is formed wider than the punching region of the punches 17*a*' and the dies 17*b*', all of the burrs of the thirty punched holes can be completely crushed even if the sheet P obliques or shifts with respect to the press-contact roller 7*a*' and the urged roller 7*b*'. Therefore, the sheet P can be smoothly transported and loaded on the bin tray b.

[Third Embodiment]

Figure 8:
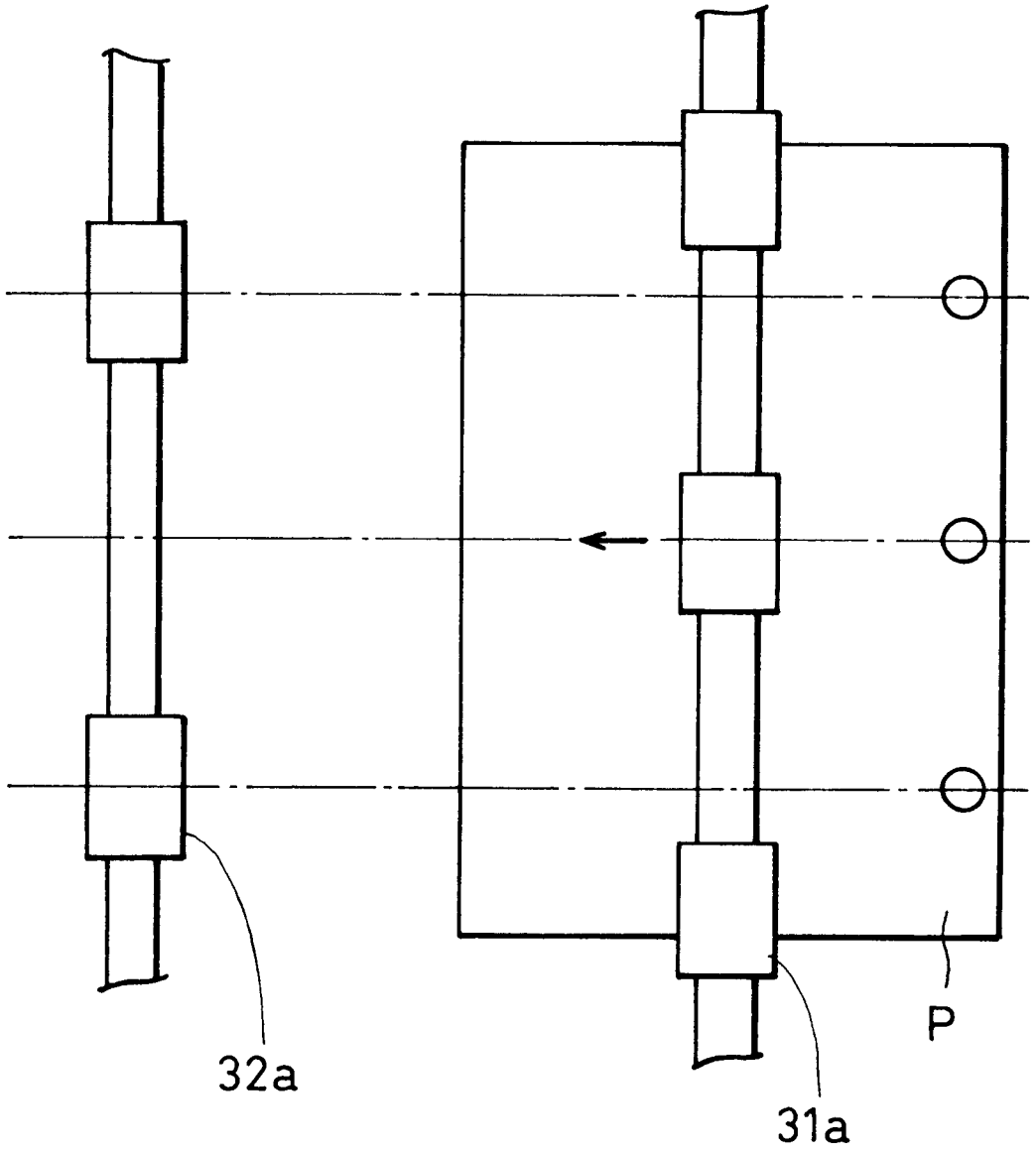
FIG. 8 is a view showing an example of the arrangement of the press-contact roller pair when the sheet is punched by a three-hole puncher according to a third embodiment.
Figure 9:
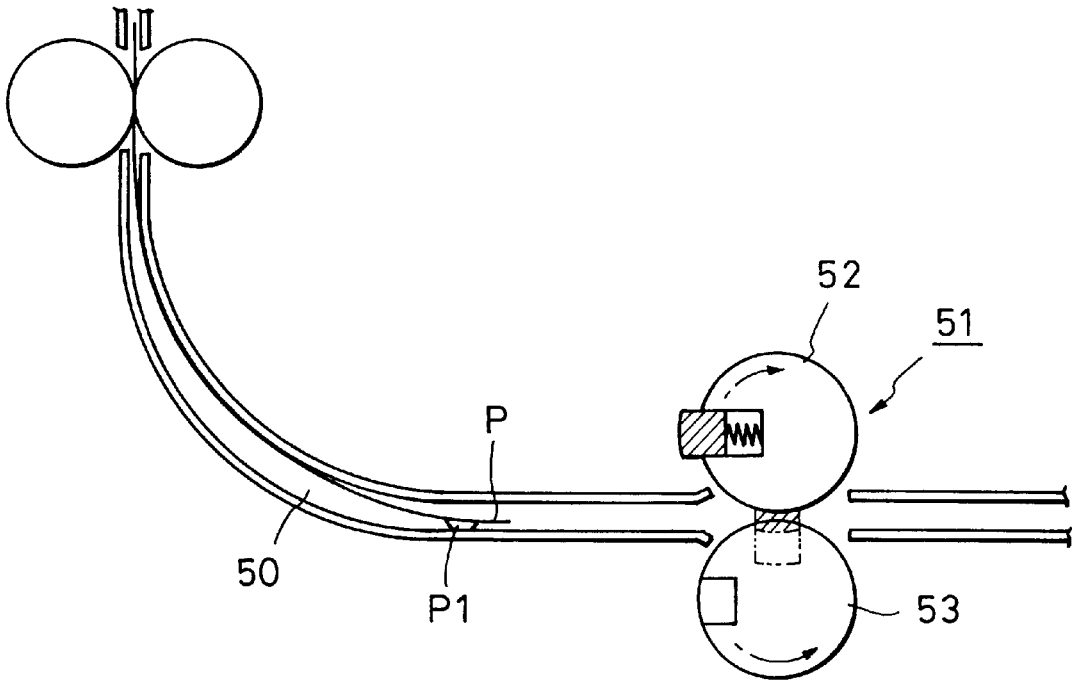
FIG. 9 PRIOR ART
FIG. 9 is an illustration of a puncher and a transport path according to a prior art.
Figure 10A:
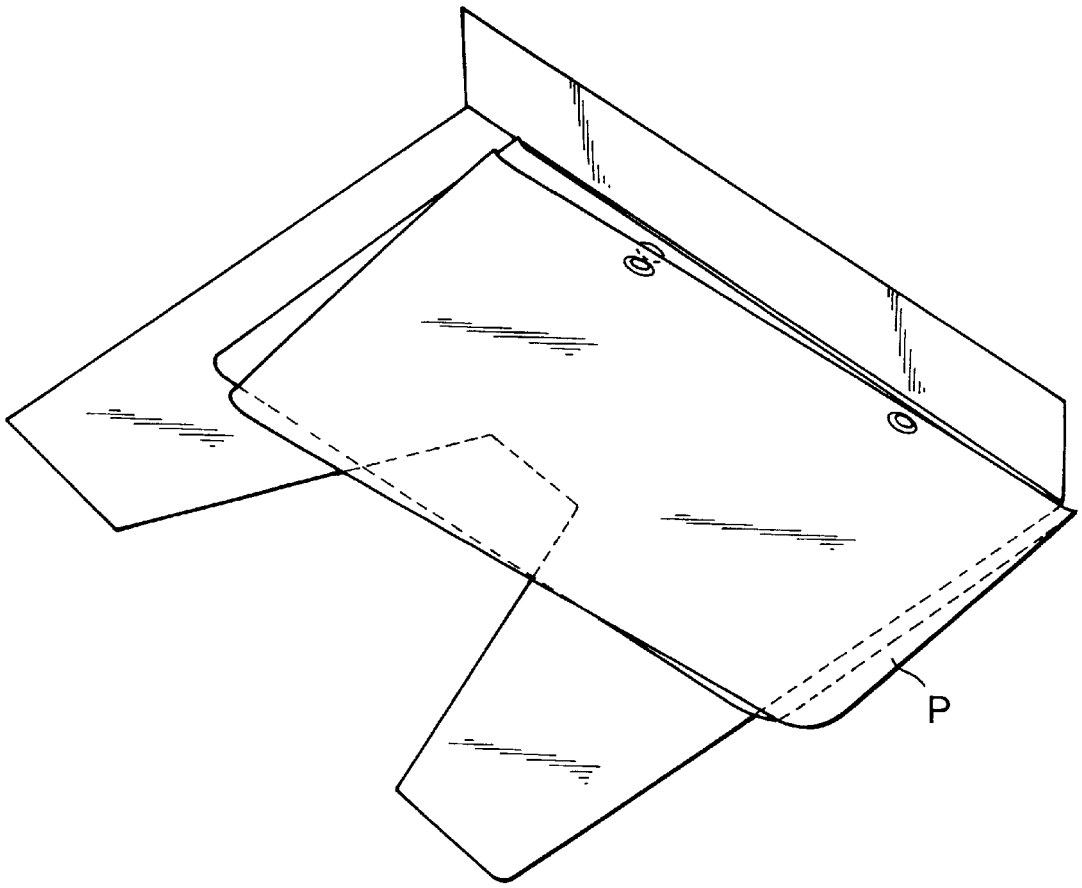
FIG. 10A PRIOR ART
FIGS. 10A and 10B are illustrations of a sheet processing device according to the prior art.
Figure 10B:
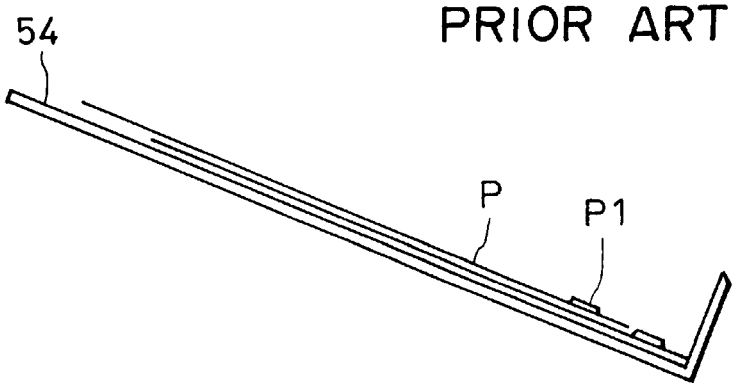
FIG. 10B PRIOR ART

A third embodiment according to the present invention will be described with reference to FIG. 8. The same components as those of the first and second embodiments are indicated by the same numerals, and their description is omitted. FIG. 8 illustrates an example of the arrangement of the press-contact roller pair when the sheet P is punched by the puncher.

In this embodiment, two transport means for clamping and transporting the punched sheet are provided. That is, a first press-contact roller pairs 31*a* are disposed downstream of the puncher, and a second press-contact roller pairs 32*a* are disposed further downstream of the puncher. The first press-contact roller pairs 31*a* are disposed at the position corresponding to the punched positions at both ends and the center of the sheet P, and the second press-contact roller pairs 32*a* are disposed at the position corresponding to the punched positions near both ends of the sheet P.

Only press-contact rollers 31*a* and 32*a* as first rotation members are shown in FIG. 8. Therefore, urged rollers (not shown) as second rotation members are pressed into contact with the press-contact rollers 31*a* and 32*a*, respectively, from the opposite side of the sheet. By reducing the contact area of the press-contact roller pairs with the sheet P, the pressure of the urging force can easily be increased, and manufacturing costs can be reduced.

The two-hole puncher 5, the multiple-hole puncher 5' for punching thirty holes, and the three-hole puncher (not shown) are used in the first, the second, and the third embodiment, respectively. However, the present invention is not limited thereto, and a puncher for a required number of holes may be provided, and a press-contact roller pair corresponding to the position of the hole punched by the puncher may be provided downstream. This also provides the same effect of the above-described embodiments.

In addition, when the press-contact roller pairs are formed so as to urge the entire area of the width of the sheet P as described in the second embodiment, the roller pairs can comply with any number of holes. In the case of a small number of holes as in the first and the third embodiments, it is efficient to dispose the press-contact roller pairs only at predetermined positions (positions corresponding to the punched holes).

Further, although the puncher and the press-contact roller pairs as transporting means are provided on the sort path of the sheet processing device in the above-described embodiments, the present invention is not limited thereto, and they may be provided on, for example, the sort path, or the upstream path which is divided into the sort path and the non-sort path. This also provides the above effect regardless of whether the sorting or non-sorting path is selected. The similar effect can also be obtained by providing the puncher and transporting means on the transport path of the image forming apparatus main body.

Further, although a copying machine is employed as the image forming apparatus in the above-described embodiments, the present invention is not limited thereto, and other image forming apparatuses, such as printers, and facsimiles, etc. may be employed. In addition, not only the puncher including rotation members but also a puncher including a punch which moves up and down may be employed.

Moreover, although the burrs may be produced on not only the die side but also the punch side of the sheet, such burrs can be crushed by sheet transport devices in accordance with any of the above first to third embodiments. Such counter burrs are produced when the punch passes through the hole in the reverse direction after punching.

[Fourth Embodiment]

Figure 57:
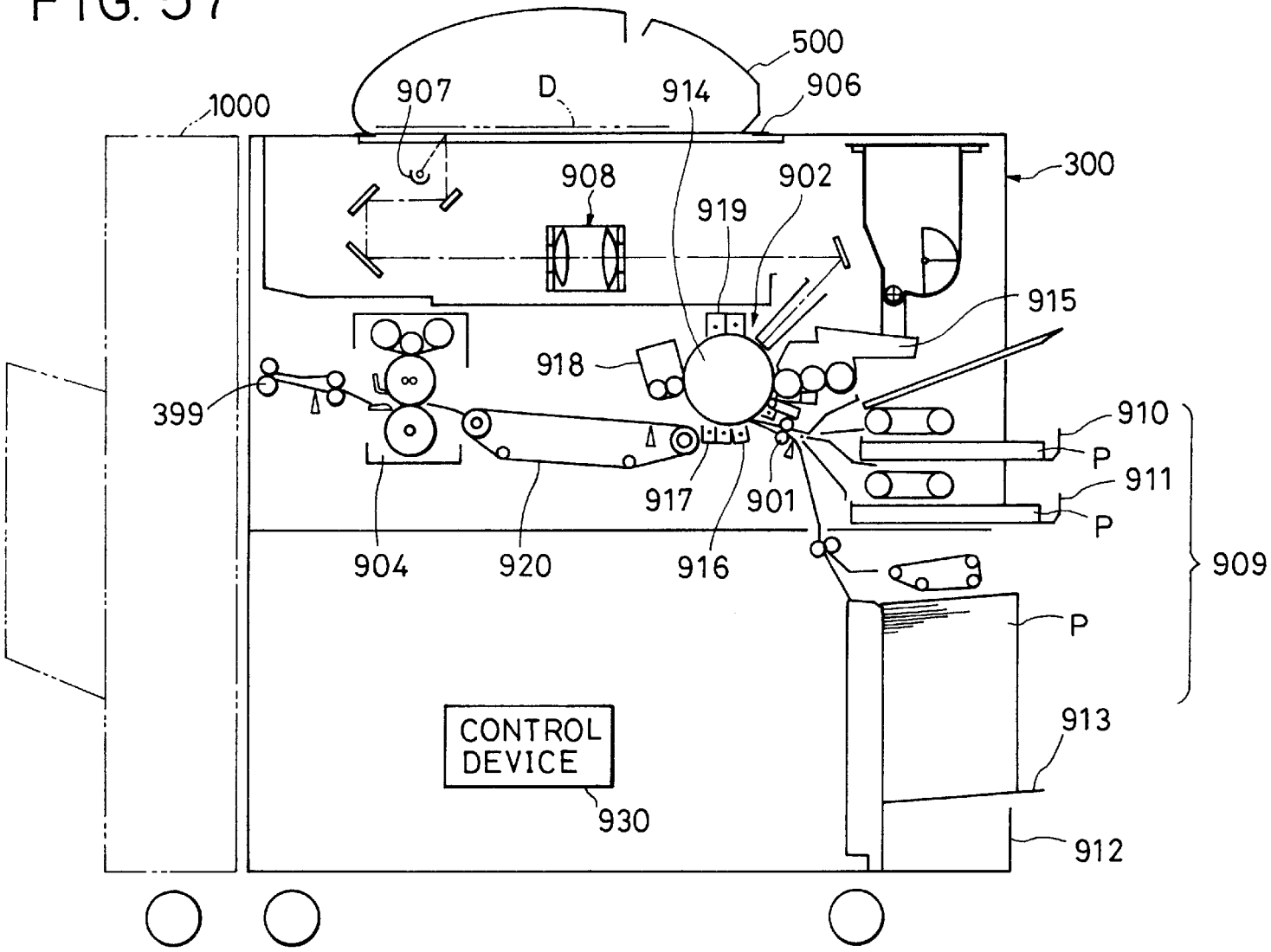
FIG. 57 is a front view of an image forming apparatus to which the sheet processing device of the fourth to fifth embodiments according to the present invention can be applied.

FIG. 57 shows an example of an image forming apparatus main body (copying machine main body) as a sheet output apparatus including a sheet processing device.

The following fourth to seventh embodiments describe a configuration for providing accurate positions of punched holes.

An image forming apparatus main body 300 includes a platen glass 906 as a document pad, a light source 907, a lens system 908, a sheet feed section 909, an image forming section 902, an automatic document feeding device 500, and a sheet processing device 1000 for loading an image-formed sheet ejected from the image forming main body.

The sheet feed section 909 has cassettes 910 and 911 which accommodate the sheet P therein and are detachable from the apparatus main body 300, and a deck 913 provided on a pedestal 912. The image forming section 902 includes a cylindrical photoconductive drum 914, a developing device 915, a transfer charger 916, a separate charger 917, a cleaner 918, and a primary charger 919. A transport device 920, a fixing device 904, and an eject roller pair 399 are provided downstream of the image forming section 902.

An operation of the image forming apparatus main body will now be described.

When a sheet feeding signal is output from a control device 930 provided in the apparatus main body 300, the sheet P is fed from the cassettes 910 or 911, or from the deck 913. On the other hand, light applied from the light source 907 to a document D laid on the document pad 906, and reflected therefrom illuminates the photoconductive drum 914 through the lens system 908. The photoconductive drum 914 is charged by the primary charger 919 in advance, and an electrostatic latent image is formed on the drum 914 by the illumination of light. The electrostatic latent image is developed by the developing device 915 to form a toner image.

Obliqueness of the sheet P fed from the sheet feed section 909 is corrected by a registration roller 901, and fed to the image forming section 902 with the proper timing. In the image forming section 902, the toner image on the photoconductive drum 914 is transferred onto the sheet P by the transfer charger 916, and the sheet P on which the toner image is transferred is charged by the separate charger 917 with a polarity opposite to that of the transfer charger 916, and separated from the photoconductive drum 914.

Then, the separated sheet P is transported by the transport device 920 to the fixing device 904, and a transfer image is permanently fixed on the sheet P by the fixing device 904. The sheet P on which the image is fixed is ejected from the apparatus main body 300 by the eject roller pair 399.

In this way, the image is formed on the sheet P fed from the sheet feed section 909, and the sheet P is ejected to a sheet punching device or a sheet processing device, which is described later.

The fourth embodiment of the present invention will be described with reference to the drawings.

Figure 11:
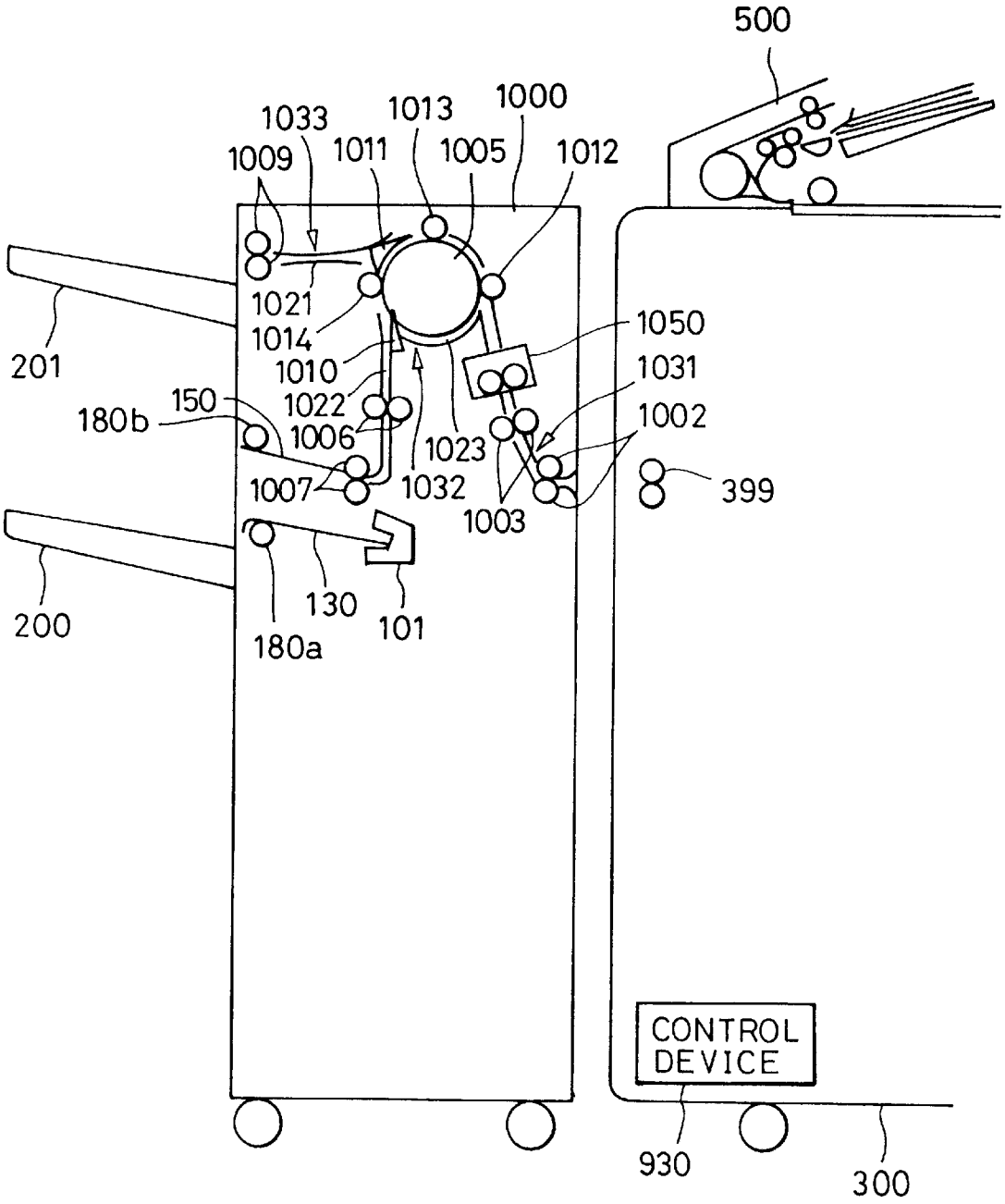
FIG. 11 is a front view showing the overall configuration of a sheet processing device according to a fourth embodiment of the present invention.

Referring to FIG. 11, there are provided a finisher (image processing device) 1000 and the image forming apparatus main body 300. Detailed descriptions of the image forming apparatus main body 300 and an RDF (Recirculating Document Feeder) 500 will be omitted. Numeral 399 denotes an eject roller of the image forming apparatus main body 300, 1002 denotes an entrance roller pair of the finisher 1000, 1003 denotes conveyor rollers, 1031 denotes a sheet detection sensor, 1050 denotes a punch unit 1050 for punching near the trailing end of the transported sheet, and 1005 denotes a large transport roller for pressing and transporting the sheet by press-down rollers 1012, 1013, and 1014.

A switching flapper 1011 switches between a non-sort path 1021 and one of a sort path 1022 and a buffer path 1023. A switching flapper 1010 switches between the sort path 1022 and a buffer path 1023 for temporarily storing sheets. Numeral 1006 denotes transport rollers, an intermediate tray 130 (hereinafter, referred to as processing tray) temporarily collects sheets to perform registration and stapling, and eject rollers 1007 eject the sheet on the processing tray 130. Numeral 150 denotes a rocking guide. A bundle eject roller 180*b* is supported by the rocking guide 150, and transports a sheet bundle laid on the processing tray 130 and is operatively associated with a lower roller 180*a* provided on the processing tray 130 to eject the bundle onto a stack tray 200 when the rocking guide 150 is closed.

Figure 12:
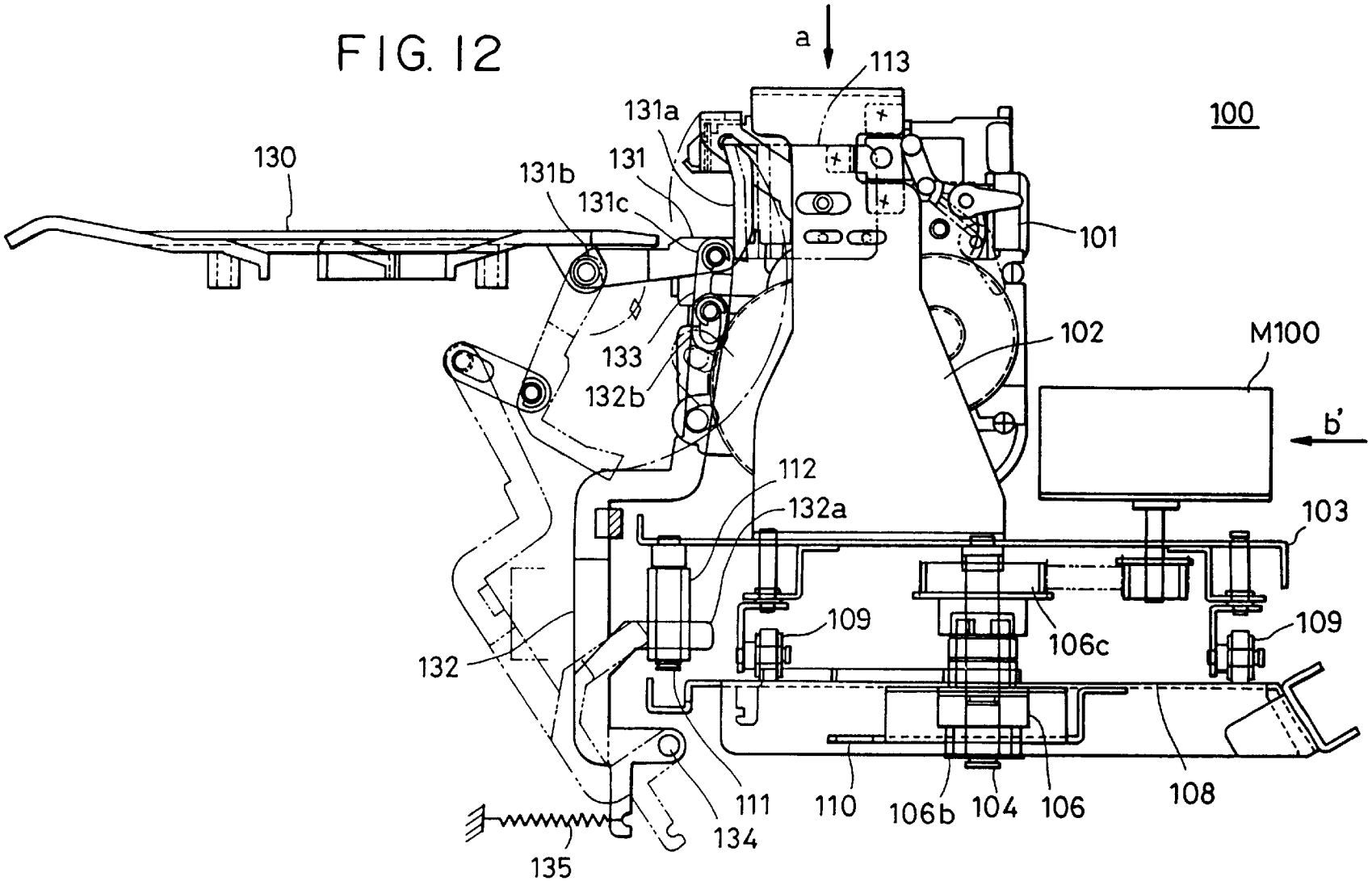
FIG. 12 is a side view showing a stapler and a processing tray.

A staple unit 100 will now be described with reference to FIG. 12 (main sectional view), FIG. 13 (a view seen from the direction of the arrow a of FIG. 12), and FIG. 14 (a view seen from the direction of the arrow b' of FIG. 12).

A stapler 101 is fixed to a movable carriage 103 through a holder 102. Shafts 104 and 105 are fixed to the movable carriage 103, and rollers 106 and 107 are rotatably assembled thereto, respectively. The rollers 106 and 107 are fitted to a slot rail (including 108*a*, 108*b*, and 108*c*) formed in a fixed stage 108.

The rollers 106 and 107 have flanges 106*a* and 107*a*, respectively, which are larger than the slot rail of the fixed stage 108. On the other hand, three support rollers are provided under the movable carriage 103 so that the movable carriage 103 supporting the stapler 101 can move on the fixed stage 108 along the slot rail without being removed therefrom. The movable carriage 103 moves on the fixed stage 108 by rollers 109 which are rotatably provided on the movable carriage 103.

Figure 13:
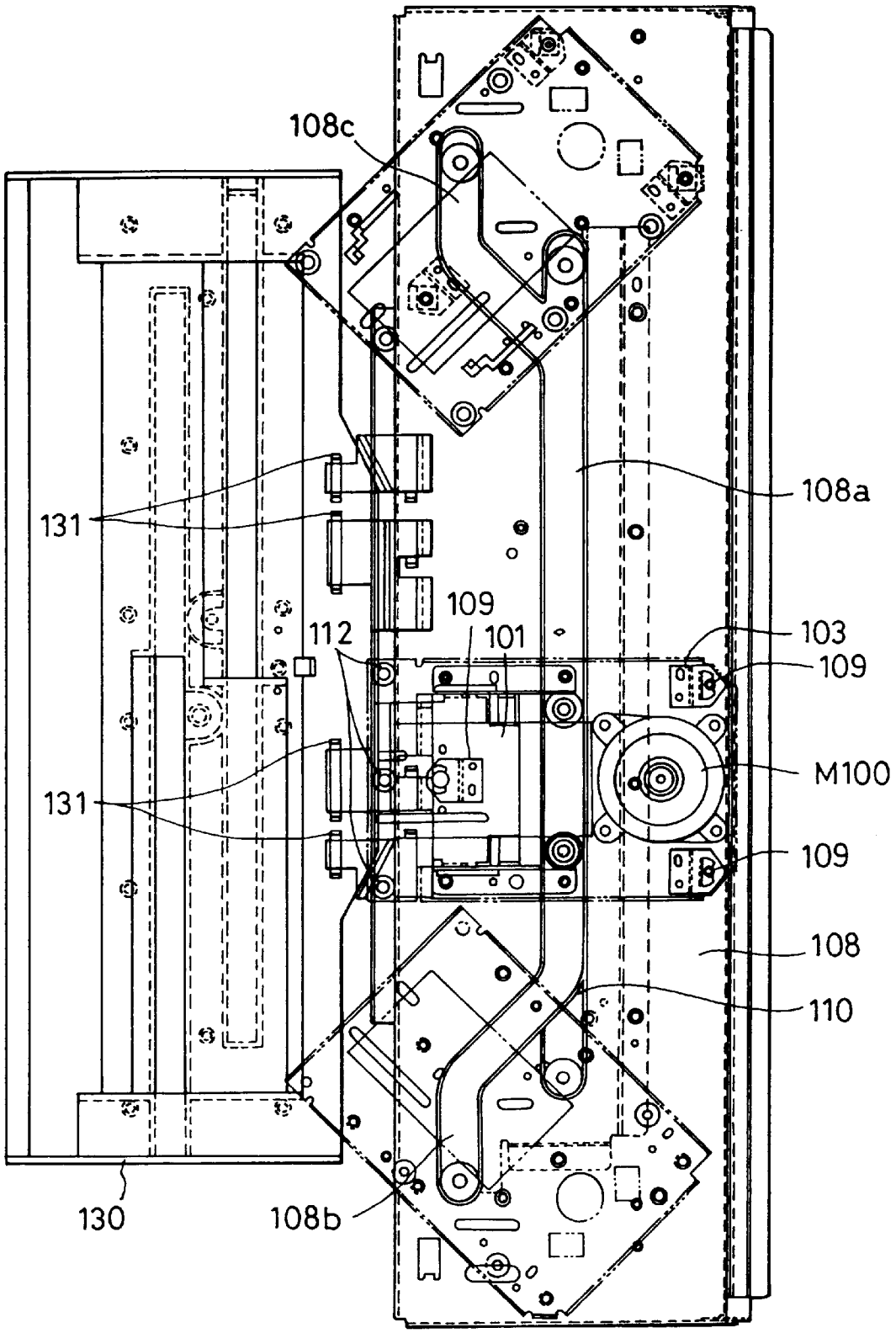
FIG. 13 is a plan view, as seen from the direction of the arrow a of FIG. 12, of a mechanism for moving the stapler.
Figure 14:
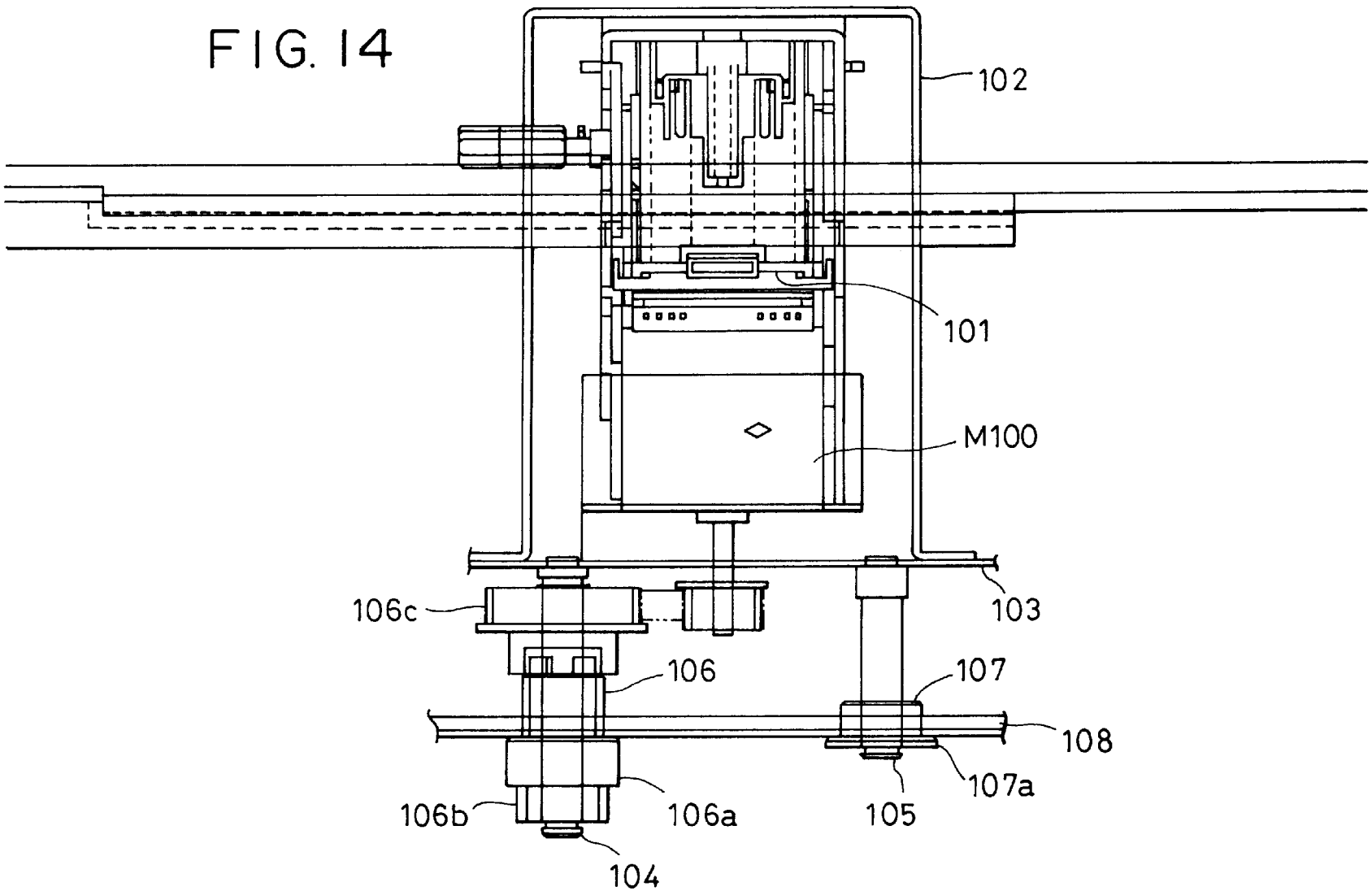
FIG. 14 is a rear view, as seen from the direction of the arrow b of FIG. 12, of the stapler.

The slot rail is divided at the proximal and distal sections thereof to provide two parallel rail slots, as shown in FIG. 13. Due to the shape of the rail slot, when the stapler 101 is located at the proximal side of the rail slot, the roller 106 is fitted to the rail slot 108*b* and the roller 107 is fitted to the rail slot 108*a*, so that the stapler 101 is placed in an inclined position.

When the stapler 101 is located at the center of the rail slot, both of the rollers 106 and 107 are fitted to the rail slot 108*a*, so that the stapler 101 is placed in a horizontal position.

Further, when the stapler 101 is located at the distal side of the rail slot, the roller 106 is fitted to the rail slot 108*a* and the roller 107 is fitted to the rail slot 108*c*, so that the stapler 101 is placed in a position inclined in the direction opposite to that of the stapler 101 located at the proximal side.

Incidentally, after the rollers 106 and 107 have been fitted to the two parallel rail slots, the stapler 101 moves with its position maintained. The start of changing the position is operated by a cam (not shown).

A mechanism for moving the stapler 101 will now be described.

The roller 106, one of the rollers of the movable carriage 103, has a pinion gear 106*b* and a belt pulley 106*c* formed in one piece, and the pinion gear 106*b* is connected to a motor M100 which is fixed above the movable carriage 103 through a belt looped over the pulley 106*c*. In addition, a rack gear 110 is fixed on the lower surface of the fixed stage 108 so as to be fitted to the pinion gear 106*b* along the rail slot, and the movable carriage 103 is moved forward and backward together with the stapler 101 by forward and backward rotations of the motor M100.

A shaft 111 extending downward from the movable carriage 103 is provided with stopper push-down rollers 112. The stopper push-down rollers 112 play a role for rotating a trailing end stopper 131 to avoid collision of the trailing end stopper 131 of the processing tray 130 with the stapler 101, which will be described later in detail.

Incidentally, the stapler unit 100 is provided with a sensor for detecting a home position of the stapler 101, and the stapler 101 usually stands by at the home position (in this embodiment, at the proximal end).

The trailing end stopper 131 for supporting the trailing end of the sheet P loaded on the processing tray 130 will now be described.

The trailing end stopper 131 includes a support plane 131*a* which is perpendicular to the load plane of the processing tray 130 to support the trailing end of the sheet, a pin 131*b* to be fitted to a round hole formed in the processing tray 130 for rocking, and a pin 131*c* to be fitted to a link. The link is composed of a main link 132 having a cam plane 132*a* pressed in abutment with the stopper pushdown rollers 112 assembled to the movable carriage 103, and a connect link 133 for connecting a pin 132*b* provided on the upper end of the main link 132 and the pin 131*c* of the trailing end stopper 131.

The main link 132 is rocked using a shaft 134 fixed to a frame (not shown) as a fulcrum. In addition, a tensile spring 135 for urging the main link clockwise is provided on the lower end of the main link 132, and the main link 132 is positioned by an abutting plate, so that the trailing end stopper 131 is usually maintained in the position perpendicular to the processing tray 130.

When the movable carriage 103 is moved, the stopper push-down roller 112 provided on the movable carriage 103 pushes down the cam plane of the main link 132 connected to the trailing end stopper 131 which interferes with the stapler 101, so that the trailing end stopper 131 is pulled by the connect link 133 and rotated to the position where it does not interfere with the stapler 101. A plurality of (in this embodiment, three) stopper push-down rollers 112 are provided so that the trailing end stopper 131 is maintained in the interference-preventing position during the movement of the stapler 101.

Staple stoppers 113 (shown by the two-dot chain line in FIG. 12), each having the support plane of the same shape as that of the trailing end stopper 131, are attached to both sides of the holder 102, whereby the trailing end of the sheet can be supported by the staple stoppers 113 even if the stapler 101 is placed in the horizontal position and pressing the trailing end stopper 131.

A processing tray unit 129 will now be described with reference to FIG. 15.

The processing tray unit 129 is provided between a transport section for transporting the sheet from the image forming apparatus main body 300 and the stack tray 200 for receiving and accommodating the sheet bundle processed by the processing tray 130.

The processing tray unit 129 is composed of the processing tray 130, the trailing end stopper 131, a registration wall 140, the rocking guide 150, a lead-in paddle 160, an advance-and-retreat tray 170, and the bundle eject roller pair 180.

The processing tray 130 is an inclined tray in which the downstream side (left of the drawing) is in an upward position and the upstream side (right of the drawing) is in a downward position, and the trailing end stopper 131 is fitted to the lower end thereof. The sheet P ejected by the eject roller pair 180 of the transport section slides on the processing tray 130 until its trailing end is in abutment with the trailing end stopper 131 by the weight of the sheet P and the action of the paddle 160.

The bundle eject lower roller 180*a* is attached to the upper end of the processing tray 130, and a bundle eject upper roller 180*b* to be in abutment with the bundle eject lower roller 180*a* is attached to the rocking guide 150. The bundle eject lower roller 180*a* and the bundle eject upper roller 180*b* can be rotated in forward and backward directions by driving a motor M180.

The registration wall (registration means) 140 will now be described with reference to FIG. 16, which is a view as seen from the direction of the arrow c of FIG. 15.

Figure 16:
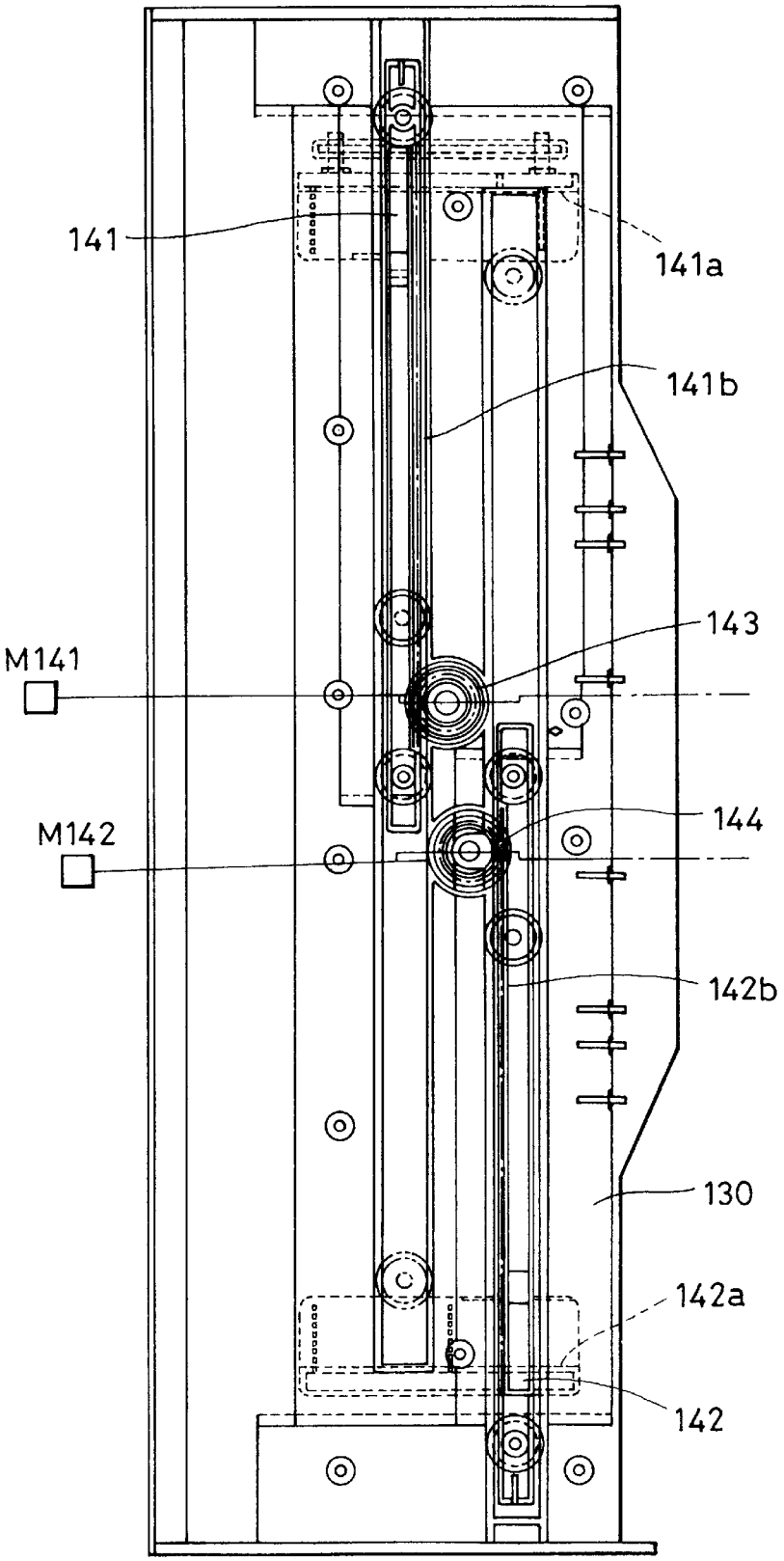
FIG. 16 is a plan view of the processing tray and a mechanism for moving registration means.

The registration means 140 includes a proximal registration member 141 and a distal registration member 142 which can separately move forward and backward (vertical direction in FIG. 16). Both of the registration members 141 and 142 are composed of support planes which stand upright on the processing tray 130, bend perpendicularly from registration planes 141*a* and 142*a* for pressing a side end surface of the sheet to support the bottom surface of the sheet P, and rack gears 141*b* and 142*b* which are parallel to the processing tray 130 and extend along the length of the processing tray 130. The registration members 141 and 142 are supported by open guides extending along the length of the processing tray 130, and are assembled so that the registration planes 141*a* and 142*a* appear on the top surface of the processing tray 130 and the gears 141*b* and 142*b* appear on the bottom surface of the tray 130.

Pinion gears 143 and 144 are engaged with rack gears 141*b* and 142*b*, respectively, and the pinion gears 143 and 144 are connected to motors M141 and M142, so that the registration members 141 and 142 are moved forward and backward by forward and backward rotation of the motors M141 and M142. The respective registration members 141 and 142 are provided with sensors (not shown) for detecting their home positions, and the registration members 141 and 142 usually stand by at their home positions.

In this embodiment, the home position of the proximal registration member 141 is set to the proximal end, and the home position of the distal registration member 142 is set to distal end.

Figure 15:
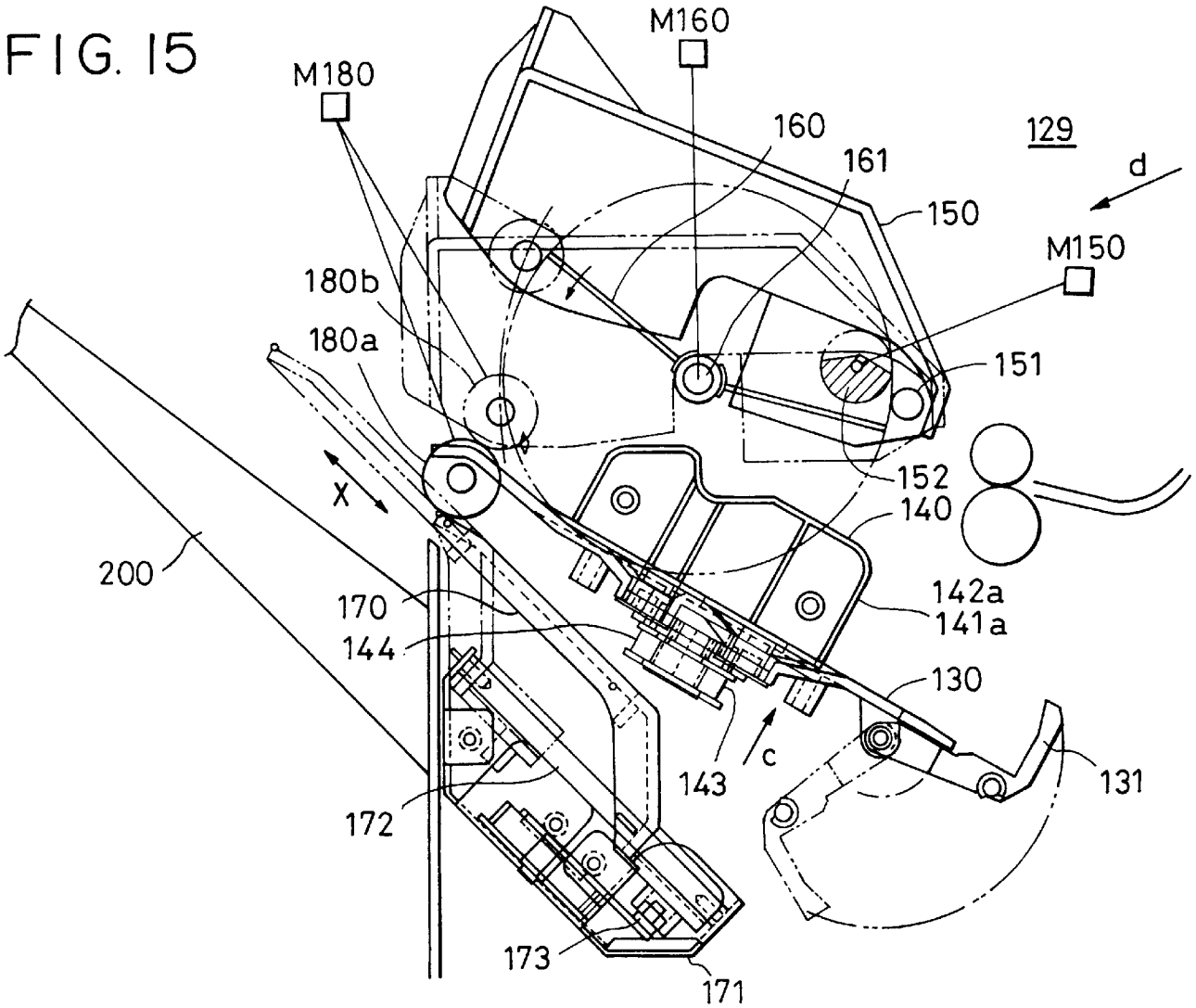
FIG. 15 is a vertical sectional view of a rocking guide and the processing tray.

The rocking guide 150 supports the bundle eject upper roller 180*b* at the downstream side (left of FIG. 15), and a rocker fulcrum shaft 151 is provided at the upstream side (right of FIG. 15). The rocking guide 150 is usually opened (the bundle eject rollers 180*a* and 180*b* are separated from each other) when the sheets P are ejected onto the processing tray 130 one by one, and does not interfere with the ejection and drop of the sheet P on the processing tray 130 and the registration operation of the sheet P. The rocking guide 150 is closed (the bundle eject rollers 180*a* and 180*b* are in abutment with each other) when the sheet bundle is ejected from the processing tray 130 to the stack tray 200.

A rotary cam 152 is provided at the position corresponding to the distal side surface of the rocking guide 150. When the rotary cam 152 rotates to push up the distal side surface of the rocking guide 150, the rocking guide is opened while rocking about the shaft 151, and is closed when the rotary cam 152 rotates by 180° from this state to separate from the distal surface of the rocking guide 150. The rotation of the rotary cam 152 is effected by a motor M150 connected to the rotary cam 152 through a drive system (not shown).

When the rocking guide is in the closed position, it is regarded as the home position, and a sensor (not shown) for detecting the home position is provided on the rocking guide 150.

The lead-in paddle 160 will now be described.

The lead-in paddle 160 is fixed to a paddle shaft 161, and is rotatably supported by side plates. The paddle shaft 161 is connected to a motor M160, and rotates counterclockwise upon receipt of the drive of the motor M160. The length of the paddle 160 is set slightly longer than the distance from the puddle 160 to the processing tray 130, and a home position of the paddle 160 is set to the position (shown by the solid line in FIG. 15) where the paddle 160 is not in abutment with the sheet P ejected by the eject roller pair 180 to the processing tray 130. When the ejection of the sheet P is completed in this state, and the sheet P is laid on the processing tray 130, the puddle 160 rotates counterclockwise upon receipt of the drive of the motor M150, and leads the sheet P until it is in abutment with the trailing end stopper 131. Then, the paddle 160 stops at the home position after waiting for a predetermined time to prepare for the next ejection of the sheet P.

Figure 17:
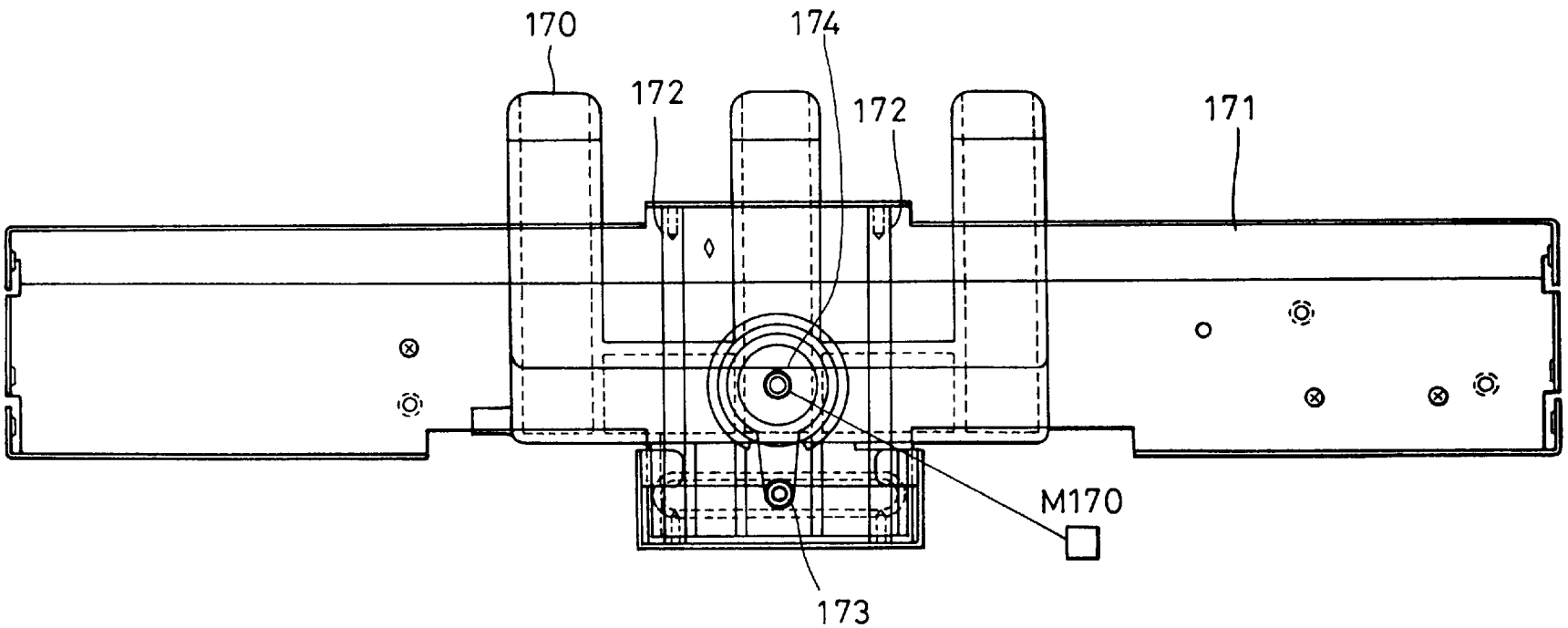
FIG. 17 is a plan view of an advance-and-retreat tray.

The advance-and-retreat tray 170 will now be described with reference to FIG. 17 which is a view as seen from the direction of the arrow d of FIG. 15.

The advance-and-retreat tray 170 is located under the bundle eject lower roller 180*a*, and advances and retreats in the sheet transport direction (x direction in FIG. 15) while substantially following the inclination of the processing tray 130. In an advanced state, the proximal end of the advance-and-retreat tray 170 projects toward the stack tray 200 (shown by the two-dot chain line in FIG. 15), while in a retreated state, the proximal end retreats to the right of the bundle eject roller pairs 180 (shown by the solid line in FIG. 15). The position of the proximal of the advance-and-retreat tray 170 is set so as not to be crossed by the center of gravity of the sheet P ejected onto the processing tray 130.

The advance-and-retreat tray 170 is supported by rails 172 fixed to a frame 171 so as to be movable in a sheet ejection direction. In addition, a rotary link 173 rotates about a shaft 174 to be engaged with a groove provided in the lower surface of the advance-and-retreat tray 170, so that the advance-and-retreat tray 170 advances and retreats as described above by one rotation of the rotary link 173.

The rotary link 173 is driven by a motor M170 through a drive mechanism (not shown). The home position of the advance-and-retreat tray 170 is set to the retreated position (shown by the solid line in FIG. 15), and the position is detected by a sensor (not shown).

Figure 18:
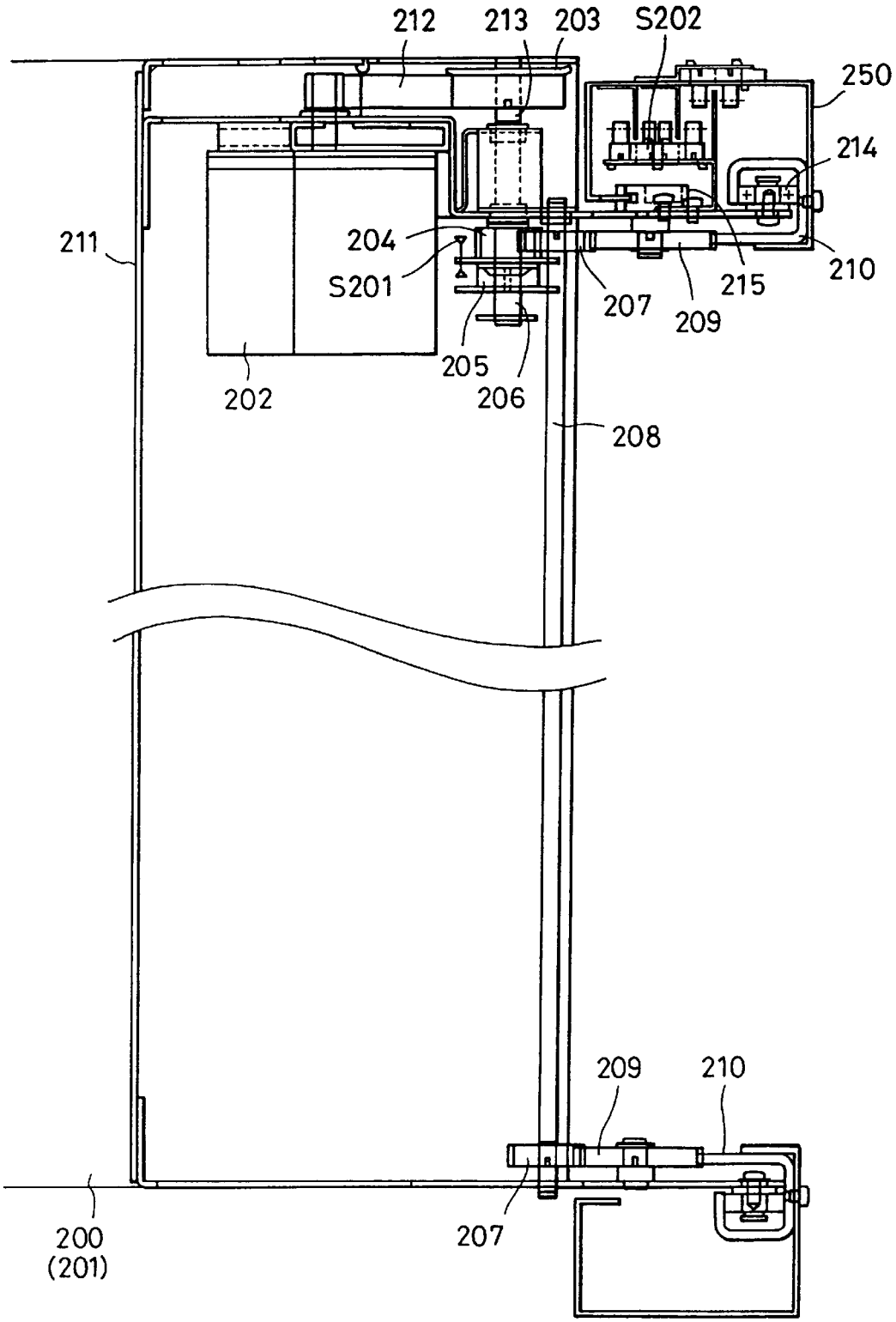
FIG. 18 is a plan view of a mechanism for moving a stack tray.
Figure 19:
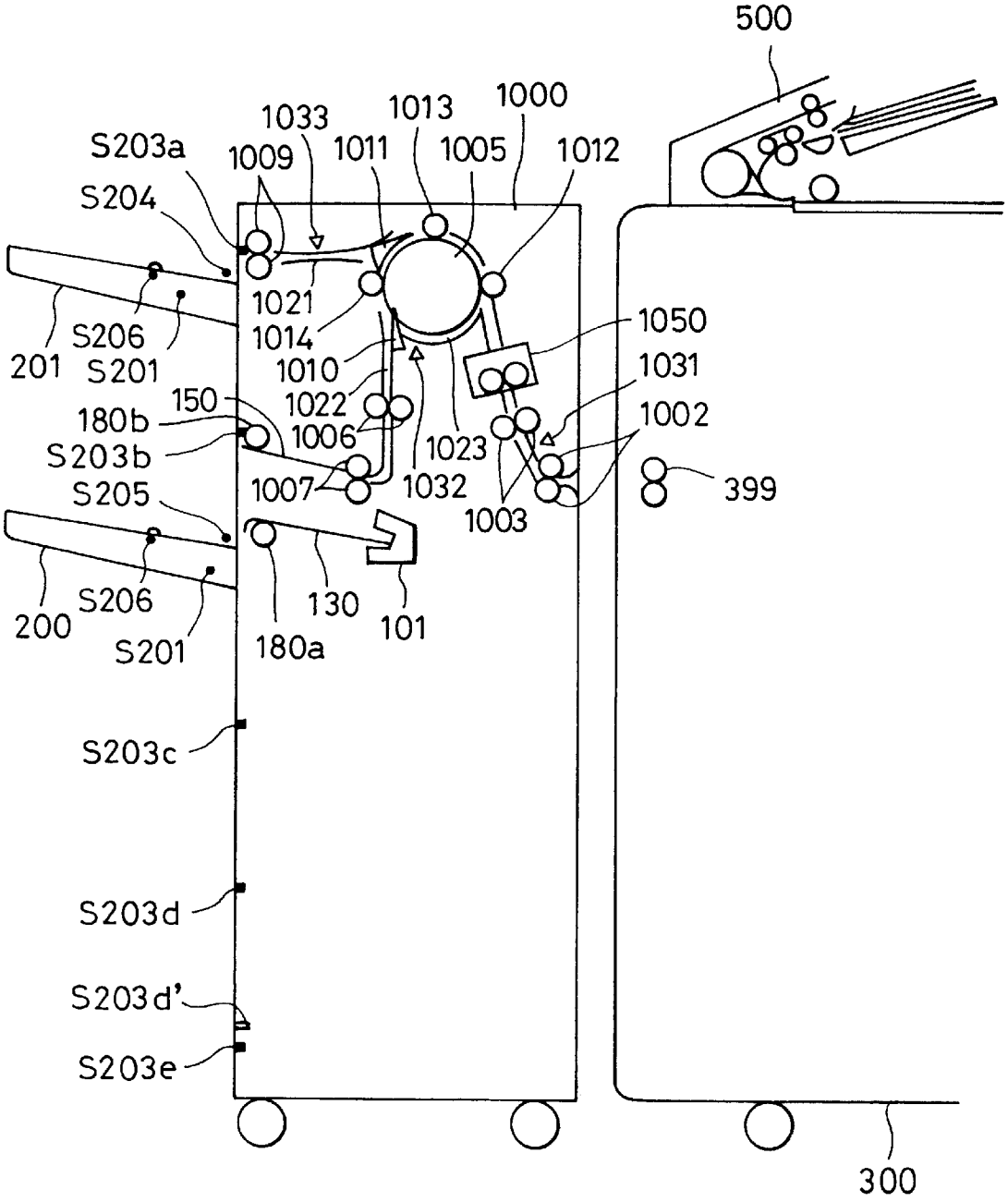
FIG. 19 illustrates the arrangement of sensors around the stack tray.
Figure 20:
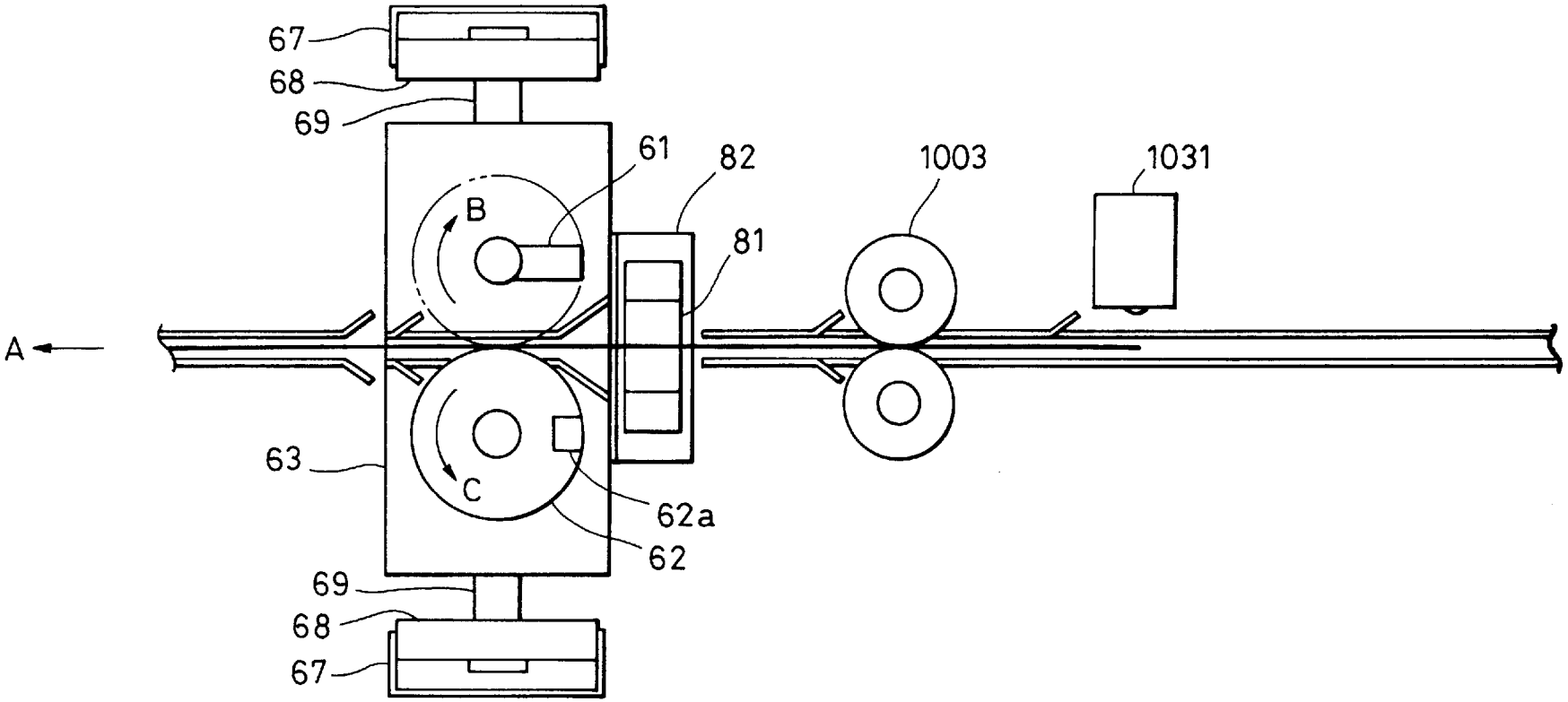
FIG. 20 is a side view of a punch unit.

The stack tray 200 and a sample tray 201 will now be described with reference to FIGS. 18 and 19.

The stack tray 200 and the sample tray 201 are used according to circumstances present. The lower stack tray 200 is selected when receiving a copy output sheet or a printer output sheet, and the upper sample tray 201 is selected when receiving a sample output sheet, an interrupt output sheet, an output sheet at the time of overflow of the stack tray, an output sheet of a function sorting, or an output sheet at the time of mixed loading of jobs.

The respective trays 200 and 201 have stepping motors 202 so as to independently move up and down, and are attached to racks 210 which are vertically mounted to a frame 250 of the finisher 1000 and double as roller holders.

A regulating member 215 regulates proximal and distal looseness of the stack tray 200, the stepping motor 202 is mounted on a tray base plate 211, and the drive of the motor 202 is transmitted by a timing belt 212 to a pulley 203 pressed on a motor shaft.

A shaft 213 connected to the pulley 203 by a parallel pin transmits the drive to a ratchet 205 also connected to the pulley 203 by the parallel pin, and is urged by a spring 206 to an idler gear 204. The ratchet 205 is connected to the idler gear 204 to transmit the drive, and the idler gear 204 is connected to a gear 207. Another gear 207 is attached to the idler gear 204 through a shaft 208 so that the drive of the stepping motor 202 can be transmitted to the rack 210 at both proximal and distal sides of the stack tray 200. The rack 210 can be moved through a gear 209. Two rollers 214 are fitted in the rack 210 to fix the stack tray 200. In addition, respective trays 200 and 201 are mounted on the base plate 211 to constitute a tray unit.

In addition, in order to prevent breakage of a tray drive system due to catching of foreign materials when lowering the stack tray 200, the ratchet 205 pushes away the spring 206 only in the direction in which the stack tray is raised, and idles. During the idling, a sensor S201 for stopping immediately the drive of the stepping motor 202 detects a slit incorporated in the idler gear 204. The sensor S202 is also used for detecting step out of the motor 202 in normal time. In addition, the rocking guide 150 serves as a part of a loading wall of the stack tray 200 when it is in the closed position so as to move vertically the processing tray 130 having a closed section. The processing tray 130 can be moved only when the closed position of the rocking guide 150 is detected by a sensor (not shown).

A sensor S202 is an area detection sensor which detects flags in an area from an upper limit sensor S203*a* for stopping an excessive raising of the sample tray 201 to a detection sensor S205 for detecting a sheet plane on the processing tray 130. A sensor S203*b* is provided at the position equivalent to 1,000 sheets from a non-sort sheet plane detection sensor S204 so as to limit an amount of loading of the sample tray 201 by the height of the sheets.

In addition, a sensor S203*c* limits the amount of loading of the sample tray 201 by the height of the sheets received from the processing tray 130. The sensor S203*c* is also provided at the position equivalent to 1,000 sheets from the sensor S205. A sensor S203*d* limits the amount of loading of the stack tray 200 by the height of the sheets received from the processing tray 130. The sensor S203*d* is provided at the position equivalent to 2,000 sheets from the sensor s205. A sensor S203*e* is a lower limit sensor for preventing an excessive lowering of the stack tray 200. Only the sheet plane detection sensors S204 and S205 are sensors in which light passes from the proximal side to the distal side. Each of the trays 200 and 201 is provided with a sheet presence detection sensor S206.

The sheet plane is detected as follows. A state in which respective trays 201 and 200 are raised from under the respective sheet plane detection sensors S204 and S205 until the trays 201 and 200 cover the sensors S204 and S205 is initial state of each of the trays 201 and 200. After the sheets are loaded on the trays 201 and 200, the trays 201 and 200 are repeatedly lowered until optical axes of the respective sensors S204 and S205 appear, and raised until they cover the optical axes of the sensors S204 and S205.

The punch unit 1050 will now be described with reference to FIGS. 20 to 24.

Figure 21:
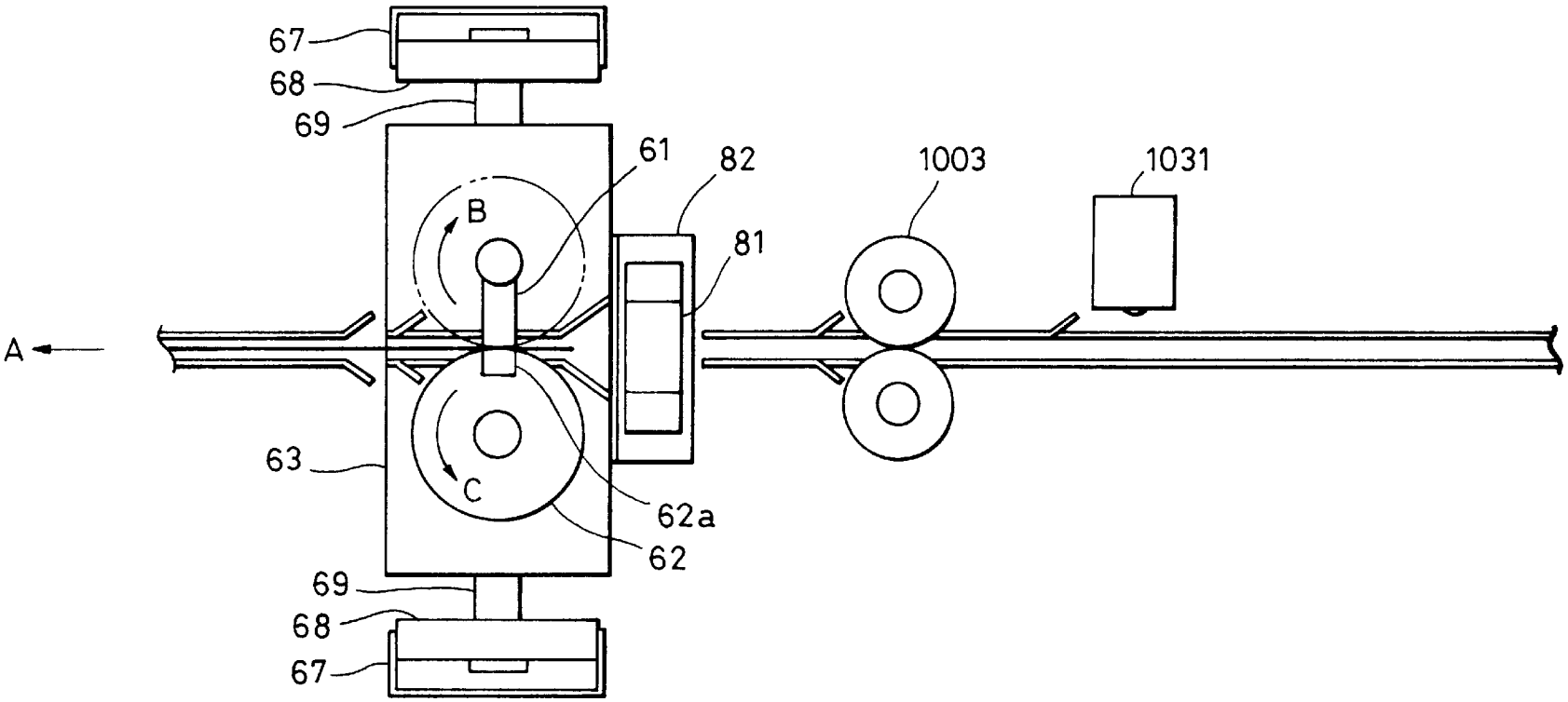
FIG. 21 is a side view of the punch unit.
Figure 22:
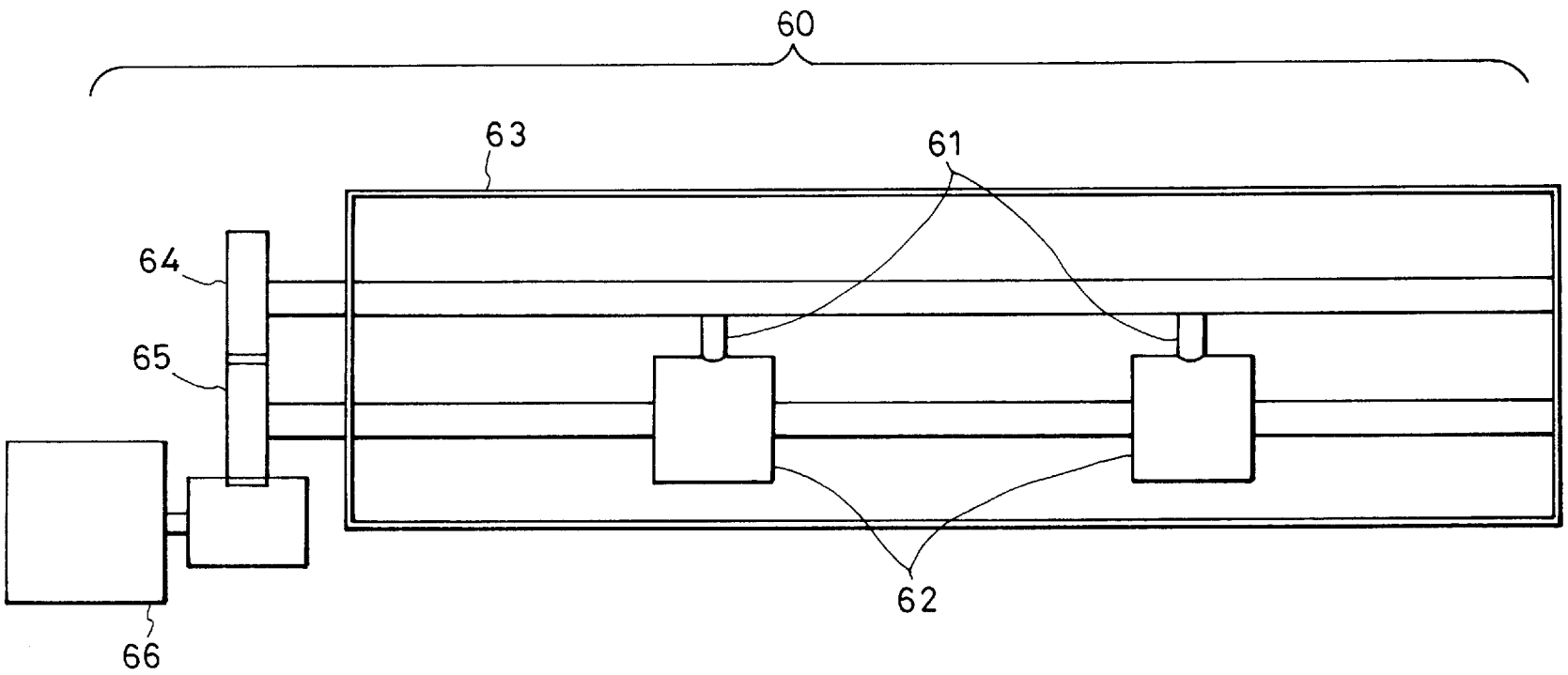
FIG. 22 is a plan view of the punch unit.

The punch unit 1050 includes a punching means 60 and a side registration detection means 80. In the punching means 60, a punch 61 and a die 62 are supported by a casing 63, and gears 64 and 65 of the punch 61 and the die 62 are meshed with each other so that the punch 61 and the die 62 can be rotated in synchronization with each other in the directions of the arrows B and C by the drive of a punch drive motor 66. The punch 61 and the die 62 are usually placed in home position shown in FIG. 20. By driving the punch drive motor 66 with a predetermined timing after the sheet detection sensor 1031 has detected the trailing end of the sheet, the punch 61 and the die 62 rotate in the direction of the arrows B and C, respectively, and the punch 61 is engaged with a die hole 62*a* formed in the die 62, as shown in FIG. 21, thereby punching the sheet during sheet transportation.

At this time, by equalizing the rotation speed of the punch 61 and the die 62 to that of the conveyor roller pair 1003, the sheet in transportation can be punched. A guide section 67 moves the punching means 60 in the direction perpendicular to the sheet transport direction A, and a roller 68 rotates in abutment with the guide section 67. The guide section 67 and the roller 68 are joined to the casing 63 by means of a roller shaft 69.

A rack gear 63*a* formed on a part of the casing 63 is meshed with a pinion gear 70 provided on a punching means moving motor (not shown). A punching means initial position detection sensor 71 having a light receiving portion 71*a* provided parallel to the transport direction A of the sheet is attached to the casing 63.

Therefore, driving the punching means moving motor, the punching means 60 can move in the directions D and E perpendicular to the sheet transport direction A. By moving the punching means initial position detection sensor 71 in the direction of the arrow E, a punching means initial position defining section 52 provided on the finisher 1000 can be detected by the light receiving portion 71*a*. Here, it is assumed that the initial position of the punching means 60 is several millimeters short of a sheet reference position equivalent to obliqueness and an amount of shift of the side registration of the sheet.

The side registration detection means 80 is mounted to the punching means 60. A side registration detection sensor 81 having a light receiving portion 81*a* mounted parallel to the sheet transport direction A for detecting one side end (the upper side in FIGS. 23 and 24) of the sheet, which is the end of the sheet parallel to the sheet transport direction A, is attached to one end of a sensor arm 82 closer to the sheet.

The sensor arm 82 has a rack gear 82*a* formed on a part thereof, and the rack gear 82*a* is meshed with a pinion gear 83 provided on a side registration moving motor (not shown) attached to the casing 63. In addition, a side registration initial position detection sensor 84 having a light receiving portion 84*a* provided parallel to the light receiving portion 81*a* is attached to the other end of the sensor arm 82.

Therefore, by driving the side registration moving motor, the side registration detection sensor 81 and the side registration initial position sensor 84 can be moved in the direction of the arrows D and E perpendicular to the sheet transport direction A. By moving the side registration initial position sensor 84 in the direction of the arrow E, the side registration initial position defining section 63*b* can be detected by the light receiving portion 84*a*. In addition, by moving the side registration detection sensor 81 in the direction of the arrow D, the side registration detection sensor can be set at the position corresponding to a selected sheet size.

When one side end (upper end in FIGS. 23 and 24) of the sheet is detected, the punching means moving motor is driven at a predetermined timing after the sheet detection sensor 1031 has detected the leading end of the sheet to move the punching means 60 and the side registration detection sensor 81 in the direction of the arrow D. When the light receiving portion 81*a* is blocked by the one side end of the sheet, the sheet side end is detected and the side registration detection sensor 81 stops. Therefore, punch positions can be justified to the side end of the sheet.

The flow of the sheet P will now be descried.

Figure 25:
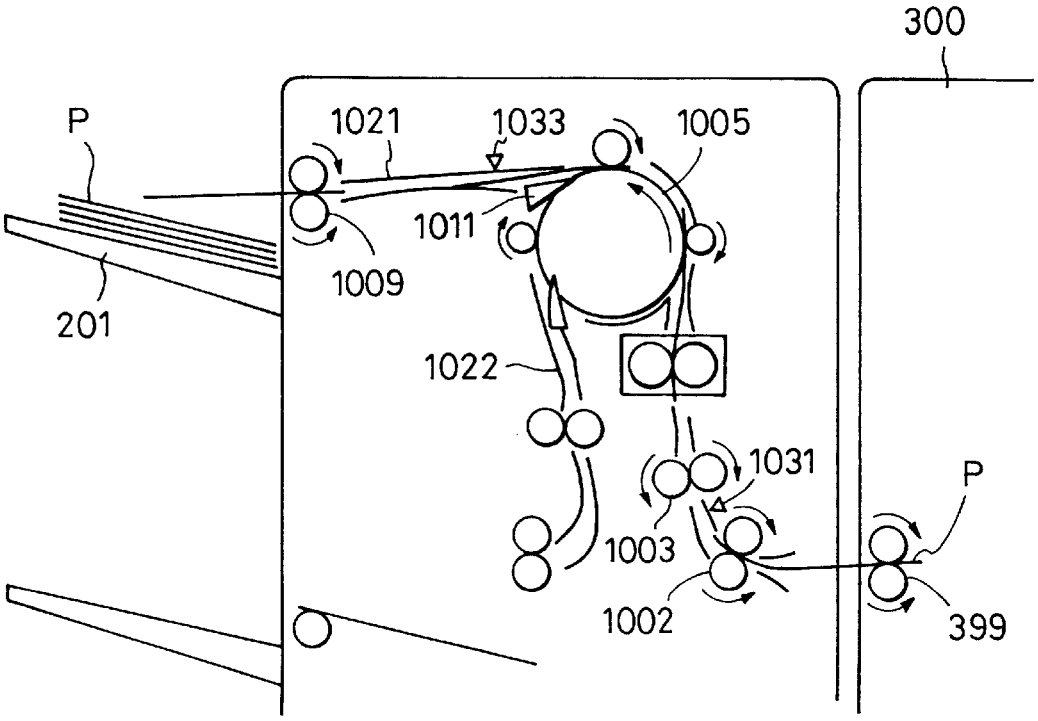
FIG. 25 is an operational diagram of the sheet processing device in a non-sort mode.

When a user designates a non-sort mode by an operating section (not shown) of the image forming apparatus main body 300, the entrance roller pair 1002, the conveyor rollers 1003, and the large conveyor roller 1005 rotate to transport the sheet P transported from the image forming apparatus main body 300, as shown in FIG. 25. The switching flapper 1011 is actuated at the position shown in FIG. 5 by a solenoid (not shown) to transport the sheet P to the non-sort path 1021. When the trailing end of the sheet P is detected by a sensor 1033, a roller 1009 rotates at a speed suited for loading, and ejects the sheet P onto the sample tray 201.

An operation when the user designates a staple sort mode will now be described.

Figure 26:
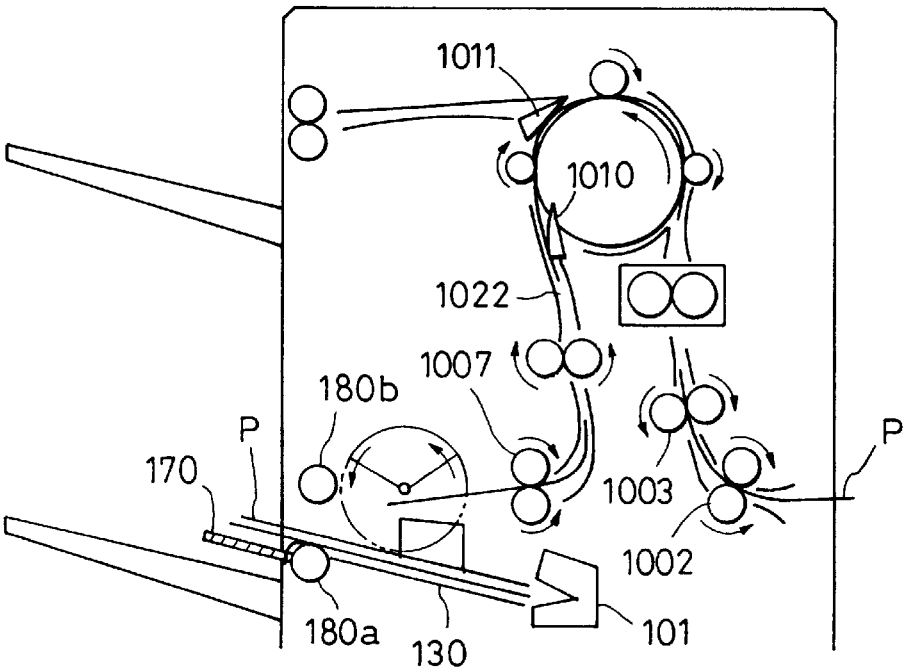
FIG. 26 is an operational diagram of the sheet processing device in a staple sort mode.

As shown in FIG. 26, the entrance roller pair 1002, the conveyor rollers 1003, and the large conveyor roller 1005 rotate to transport the sheet P transported from the image forming apparatus main body 300. The switching flappers 1010 and 1011 stop at the position shown in FIG. 26. The sheet P passes through the sort path 1022 to be ejected to the stapler 101 by the eject roller pair 1007. At this time, since the advance-and-retreat tray 170 is in the advanced position, the leading end of the sheet P is prevented from drooping at the position where the sheet P is ejected by the eject roller 1007 to cause poor returning, and the alignment property of sheets on the processing tray 130 is improved.

The ejected sheet P starts to move to the trailing end stopper 131 (FIG. 15) by the weight of the sheet P, and the paddle 160 (FIG. 15) stopped at its home position rotates counterclockwise upon receipt of the drive of the motor M160 to help the movement of the sheet P. When the trailing end of the sheet P is in positive abutment with the stopper 131 and stopped, the rotation of the paddle 160 is also stopped, and registration members 141 and 142 (FIG. 16) register the sheet P. A registration operation of the sheet P will be described later.

Figure 27:
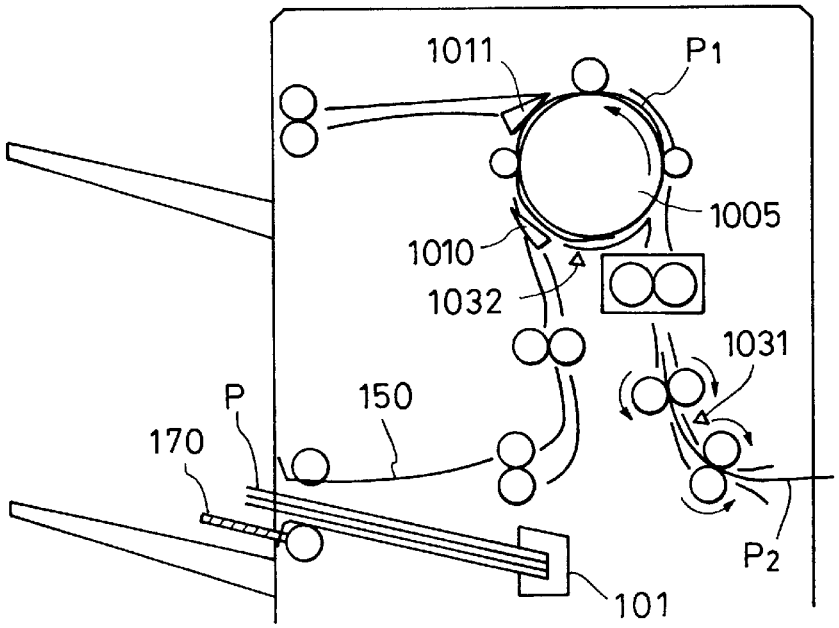
FIG. 27 is an operational diagram of the sheet processing device in the staple sort mode.

When all of the sheets of a first set are ejected onto the processing tray 130 and registered, the rocking guide 150 moves downward as shown in FIG. 27, the upper roller 180*b* is placed on a sheet bundle, and the stapler 101 staples the sheet bundle.

Figure 28:
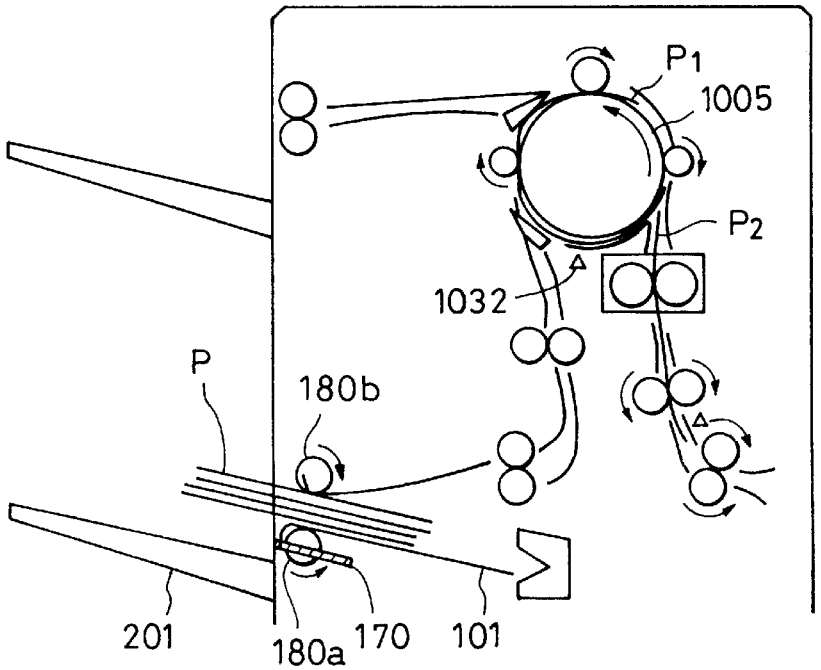
FIG. 28 is an operational diagram of the sheet processing device in the staple sort mode.
Figure 29:
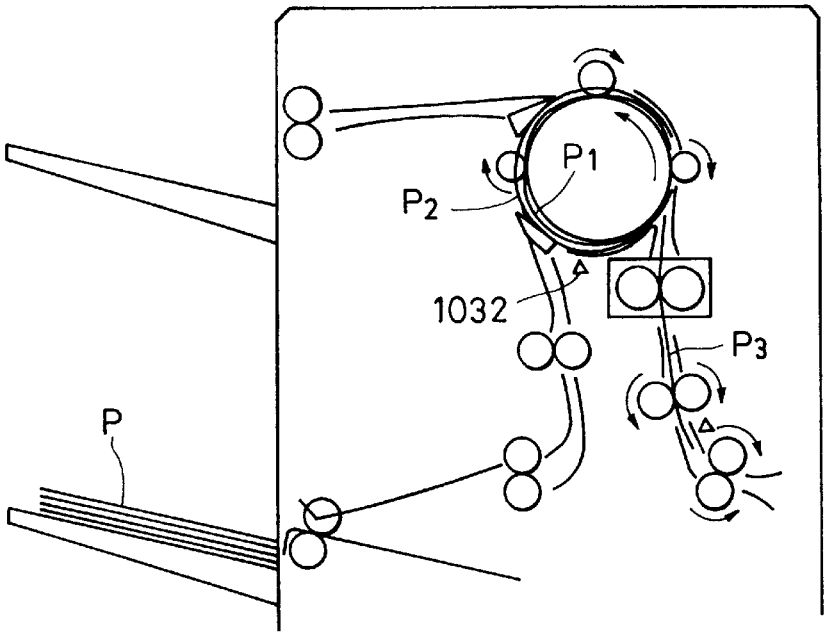
FIG. 29 is an operational diagram of the sheet processing device in the staple sort mode.

On the other hand, during stapling, a sheet $P_1$ ejected from the image forming apparatus main body 300 is wound around the large conveyor roller 1005 by the actuation of the flapper 1010, and stops after advancing a predetermined distance from a sensor 1032 (FIG. 27). When the next sheet $P_2$ advances a predetermined distance from the sheet detection sensor 1031, the large conveyor roller 1005 rotates to overlap the sheet $P_2$ on the sheet $P_1$ so that the sheet $P_2$ goes ahead of the sheet $P_1$ by a predetermined distance, as shown in FIG. 28, and then, winds the sheets $P_1$ and $P_2$ therearound and stops at a predetermined distance, as shown in FIG. 29. The sheet bundle on the processing tray 130 is ejected onto the stack tray 200, as shown in FIG. 29.

Figure 30:
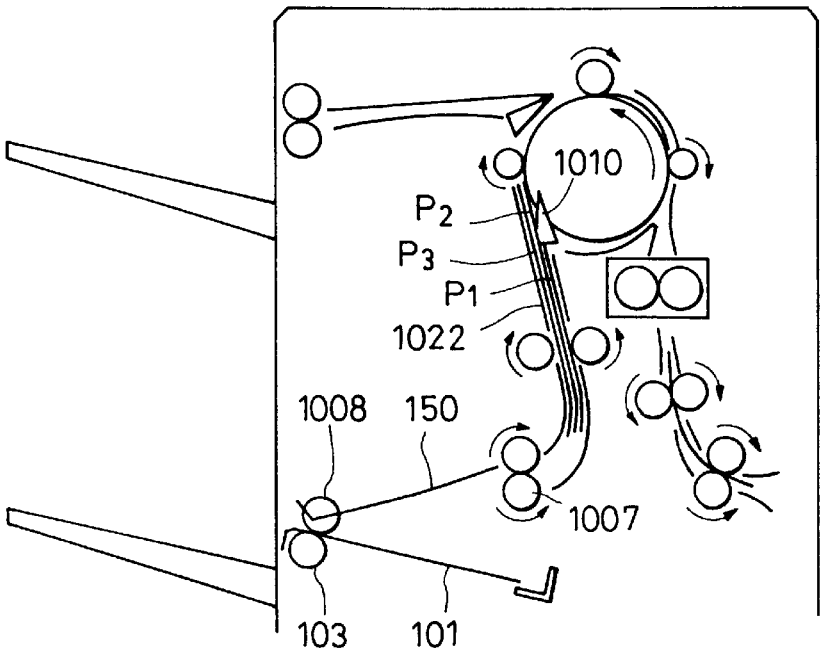
FIG. 30 is an operational diagram of the sheet processing device in the staple sort mode.

At this time, however, in order to drop the sheet bundle on the stack tray 200, the advance-and-retreat tray 170 moves to the home position before the sheet bundle passes through the bundle eject rollers 180*a* and 180*b*. As shown in FIG. 30, when the third sheet $P_3$ reaches a predetermined position, the large conveyor roller 1005 rotates to overlap the sheet $P_3$ on the sheet $P_2$ shifted by a predetermined distance, and the flapper 1010 is actuated to transport three sheets P ($P_1$, $P_2$, and $P_3$) to the sort path 1022.

Figure 31:
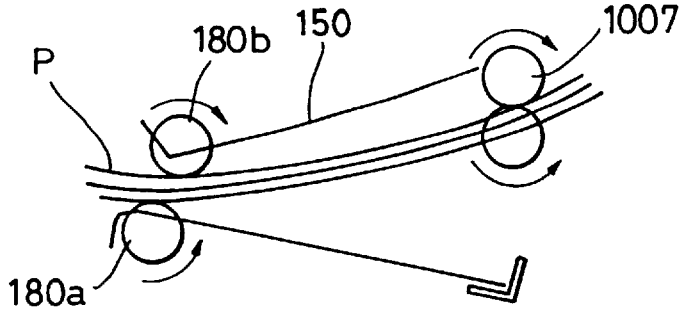
FIG. 31 is an operational diagram of the sheet processing device in the staple sort mode.
Figure 32:
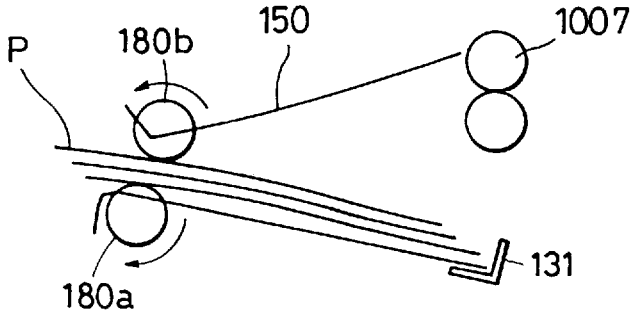
FIG. 32 is an operational diagram of the sheet processing device in the staple sort mode.
Figure 33A:
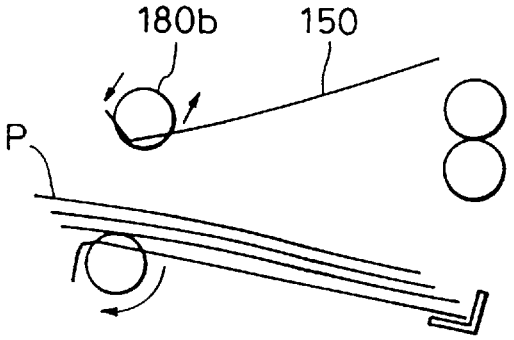
FIGS. 33A and 33B are operational diagrams of the sheet processing device in the staple sort mode.

As shown in FIG. 31, the rocking guide 150 remains moved downward, and the rollers 180*a* and 180*b* receive three sheets P. When the trailing ends of three sheets P pass through the roller 1007, the rollers 180*a* and 180*b* rotate in reverse directions, as shown in FIG. 32. Before the trailing ends of thee sheets P are in abutment with the stopper 131, the rocking guide 150 moves upward, and the roller 180*b* separates from the sheet plane, as shown in FIG. 33A. The fourth and subsequent sheets are ejected onto the processing tray 130 passing through the sort path similarly to the operation of the first set of sheets. The third and subsequent sets of sheets are operated similarly to the second set, and a prescribed number of sets are loaded on the stack tray 200 to complete the bundle ejection.

In the transportation of a plurality of overlapped sheets, each of the sheets P is offset in the transport direction. The sheet $P_2$ is offset downstream of the sheet $P_1$, and the sheet $P_3$ is offset downstream of the sheet $P_2$.

Figure 33B:
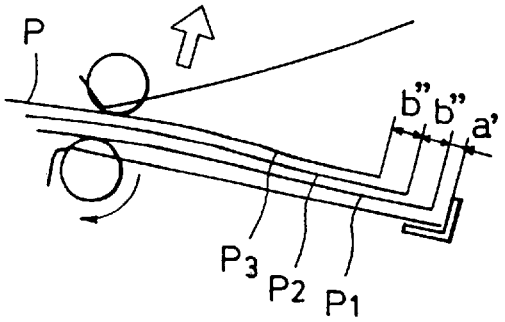

The offset amount of the sheet P, and the timing of raising the rocking guide relate to stabilization time of the sheet due to a return speed of the bundle eject rollers, i.e., they depend on the processing capability of the image forming apparatus main body 300. In this embodiment, the separate positions of the bundle eject rollers are set to the timing of the sheet $P_1$ reaching 40 mm or shorter (a in FIG. 33B) before abutting with the stopper, when the transport speed of the sheet is 750 mm/s, the offset amount (b" in FIG. 33B) is 20 mm, and the bundle eject roller return speed is 500 mm/s.

A sort mode will now be described.

Figure 34:
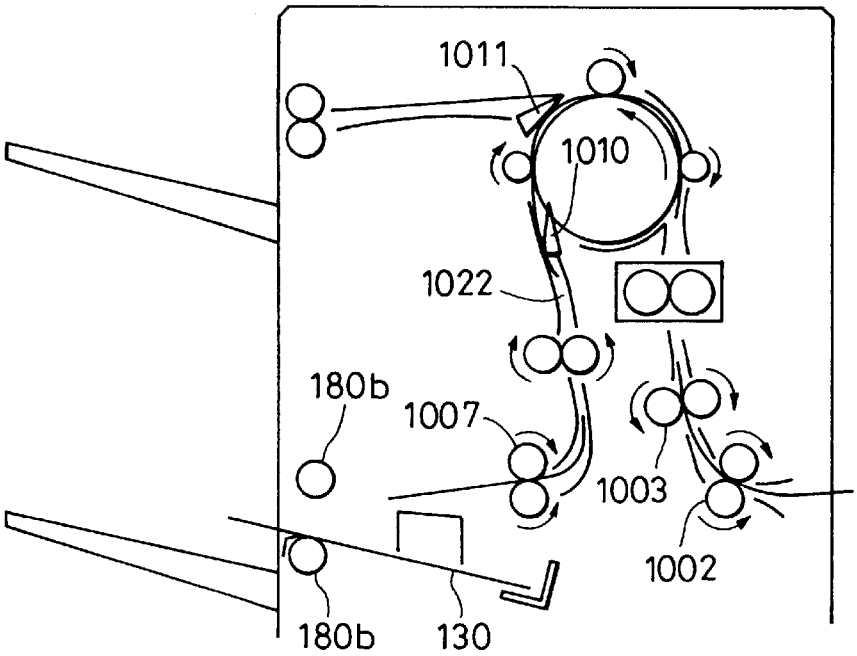
FIG. 34 is an operational diagram of the sheet processing device in a sort mode.
Figure 35:
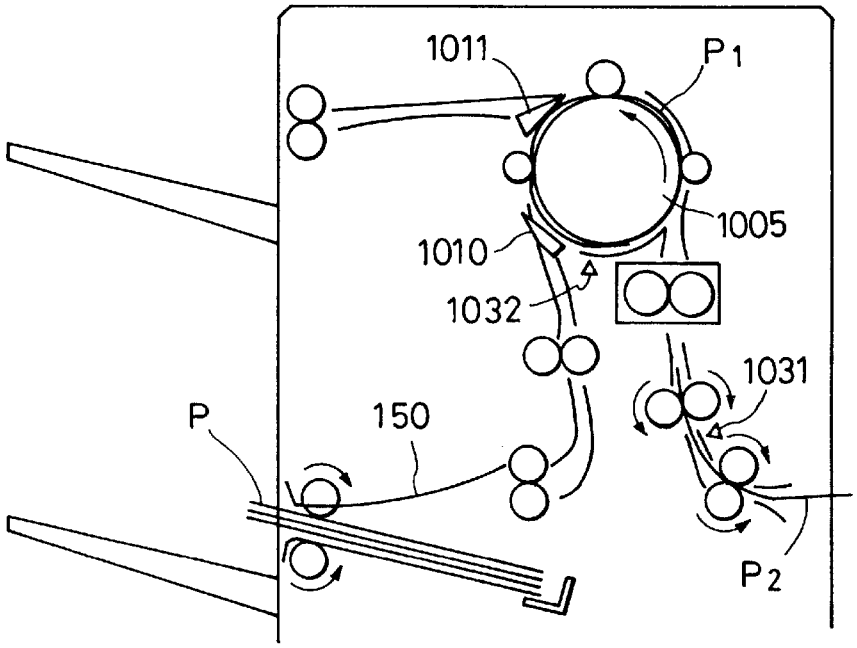
FIG. 35 is an operational diagram of the sheet processing device in the sort mode.

The user sets an original on the RDF 500, designates the sort mode on the operating section (not shown), and turns on a start key (not shown). The entrance roller pair 1002, the conveyor rollers 1003 rotate as shown in FIG. 34 in the same manner as the staple sort mode to load the sheet P on the processing tray 130. The registration wall 140 (FIG. 16) loads a few sheets on the processing tray 130 while registering the sheet P. Thereafter, as shown in FIG. 35, the rocking guide 150 moves downward to transport a sheet bundle of a few sheets.

Then, the transported sheet P passes by the flapper 1010 to be wound around the large roller 1005 in the same operation as that of the staple sort mode, and is ejected onto the processing tray 130 which has completed the bundle ejection. The number of sheets of the bundle of a few sheets to be ejected is preferably twenty or less according to experiment. The number of sheets is set so as to satisfy the following expression:

number of documents≧number of sheets to be bundle-ejected≧twenty sheets

Therefore, if the number of sheets to be bundle-ejected is set to five when programming, the bundle of four sheets at a time is ejected when the number of documents is four. When the number of originals is five or more, e.g. fourteen, the sheets are divided into a bundle of five sheets, a bundle of five sheets, and a bundle of four sheets to be registered, respectively, and then ejected.

When the bundle ejection of the first set is completed, the proximal registration means 141 moves with the distal registration member 142 to offset the registration position of the second set with respect to the registration position of the first set. A detailed description of this operation will be given later.

Figure 36:
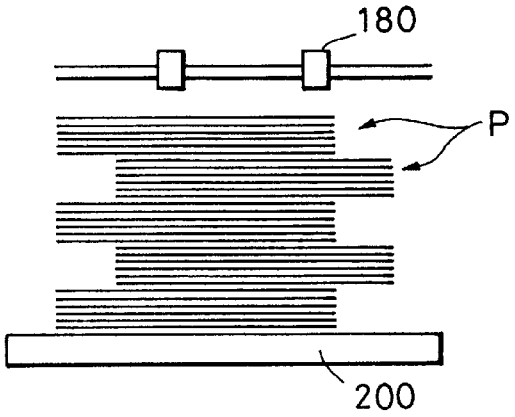
FIG. 36 illustrates sheet bundles loaded on a stack tray in the sort mode.

The second set is registered at the offset position, and the bundle of a few sheets at a time is ejected similarly to the first set. After the ejection of the second set has been completed, the proximal registration member 141 and the distal registration member 142 return to the position of the registration of the first set to register the third set. In this way, ejection of all of the prescribed number of sets is completed while offsetting the bundles with respect to each other, as shown in FIG. 36.

The registration operation will now be described with reference to FIGS. 37 to 40.

Figure 37:
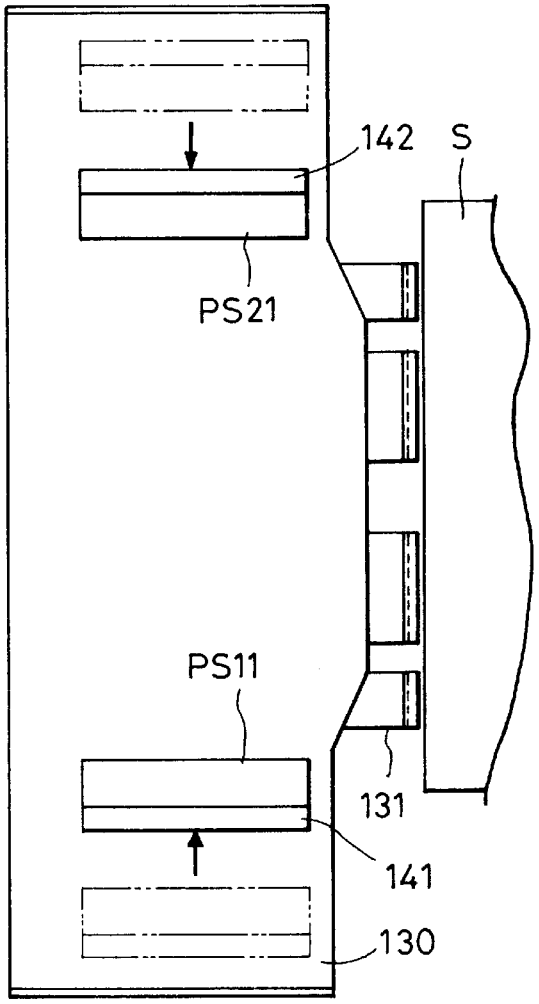
FIG. 37 is a plan view of a processing tray showing a registration operation of a sheet bundle.

When there is no sheet on the processing tray, i.e., when the initial three sheets P of the job are ejected, the proximal and distal registration members 141 and 142 standing by at the home positions move to positions PS11 and PS21, respectively, where they are spaced apart slightly more than the width of the sheet ejected previously (FIG. 37).

Figure 38:
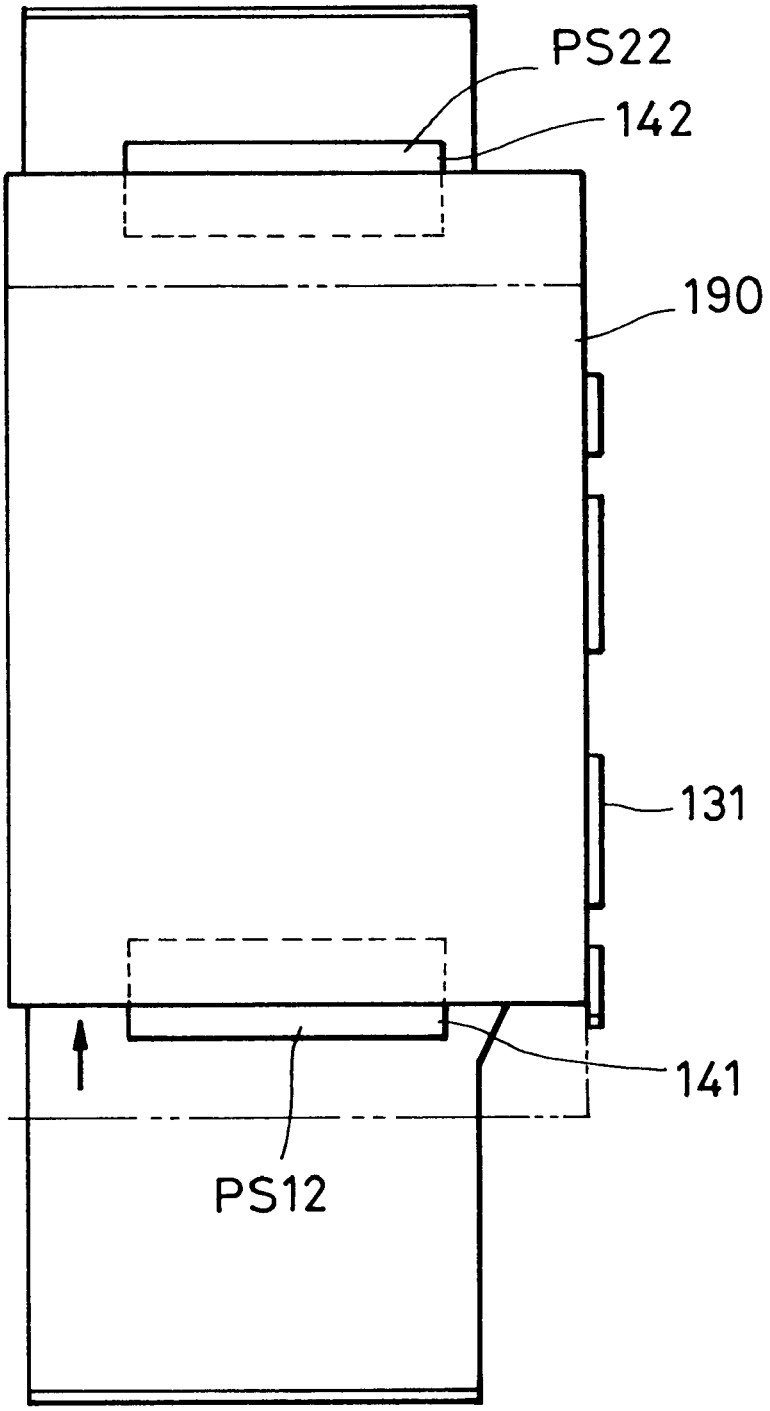
FIG. 38 is a plan view of the processing tray showing the registration operation of the sheet bundle.
Figure 39:
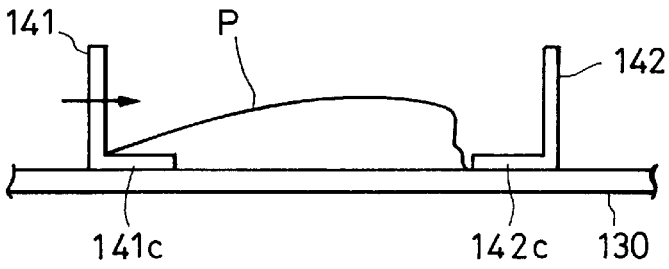
FIG. 39 is a front view of the processing tray showing the registration operation of the sheet bundle.

When the trailing ends of the three sheets S are supported by the trailing end stopper 131, and the lower surfaces are supported by support plates 141*c* and 142*c* of the registration members 141 and 142, the registration members 141 and 142 move to the positions PS12, and PS22, and move the sheet to a first registration position 190 to register it (FIG. 38). Then, the registration member 141 moves to the position PS11 to stand by for the next ejected sheet, and moves again to the position PS12 after the completion of the sheet ejection so as to register the sheet at the first registration position 190.

At this time, the distal registration member 142 remains at the position PS22 to serve as the reference. The above operations are continued until the final sheet of the bundle is registered. Since the registration operation is performed as described above, the trailing end of the sheet shown in FIG. 39 does not buckle in collision with support planes 142*c*.

The registered sheet bundle of the first set is stapled as needed, ejected and transported to the stack tray 200.

Figure 40:
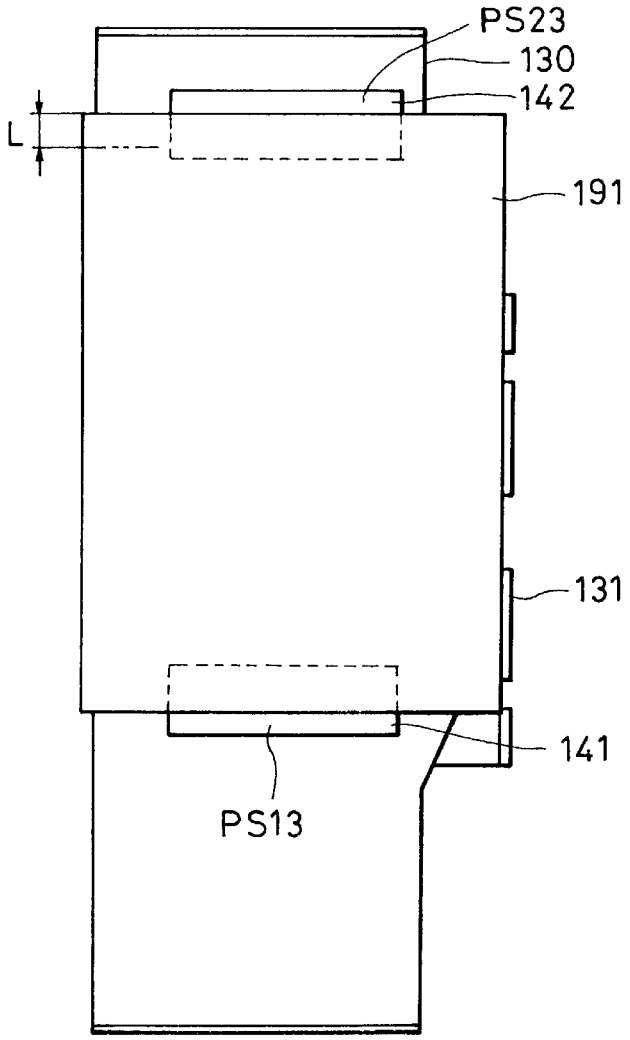
FIG. 40 is a plan view of the processing tray showing the registration operation of the sheet bundle.

Sequentially, three sheets of the second set are ejected onto the processing tray 130. At this time, although the registration members 141 and 142 stand by at the positions PS11 and PS12 similar to the first set (FIG. 37), the registration members 141 and 142 are at positions PS13 and PS14 and the registration position is moved to a second registration position 191, which is located distal side of the first registration position by a predetermined amount L (FIG. 40).

Thereafter, the sheet bundles are loaded on the stack tray 200 while changing the registration position for each sheet bundle, whereby the sheet bundles can be sorted and loaded with the offset amount L.

The offset amount L may be changed in the sort mode and the staple mode. For example, by setting the offset amount to about 15 mm which can prevent overlap of staples of the bundles adjacent to each other in the staple mode, and by setting the offset amount to about 20 to 30 mm in the sort mode by which visual identification of bundles is improved, the moved distance for registration in the staple mode is shortened, thereby increasing the processing speed.

In the staple mode, the stapler 101 stands by in advance at a desired clinching position with respect to the registered sheet, and performs stapling after the ejection of the final sheet of the bundle has been completed. The stapler 101 moves as the registration position of each of the sheet bundles moves by the offset amount L.

In addition, the stapler 101 moves in accordance with a binding mode (a proximal oblique binding, a distal oblique binding, and a two-position binding). However, the range in which the stapler 101 maintains the same position (the horizontal position and the inclined position) is limited. Further, since there are many sheet widths to be stapled, the stapling may not be performed at the same registration position with respect to the above different binding modes. Therefore, the first and the second registration positions may be changed in response to the binding mode.

Figure 41:
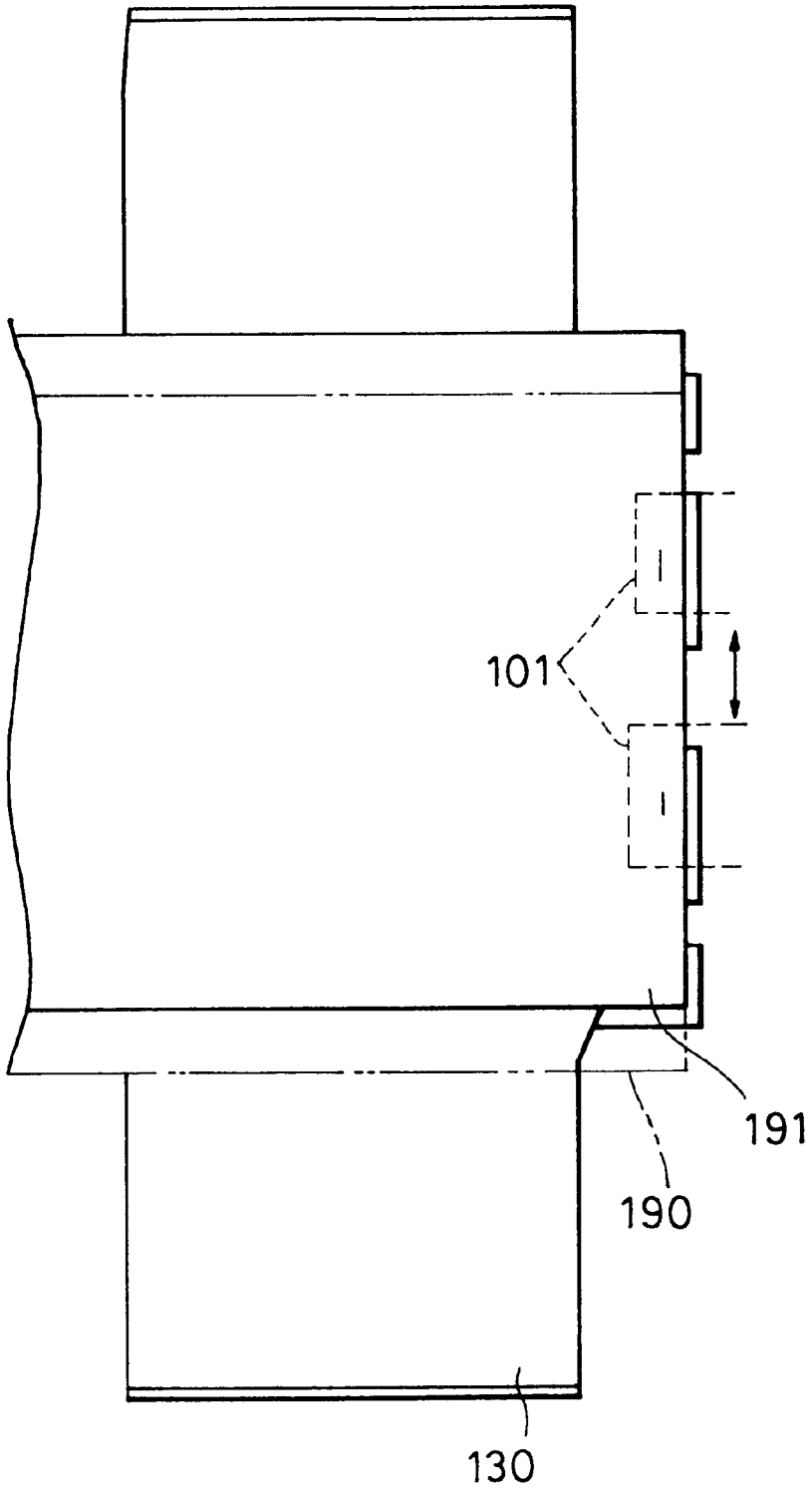
FIG. 41 is a plan view of the processing tray showing the registration operation of the sheet bundle.
Figure 42:
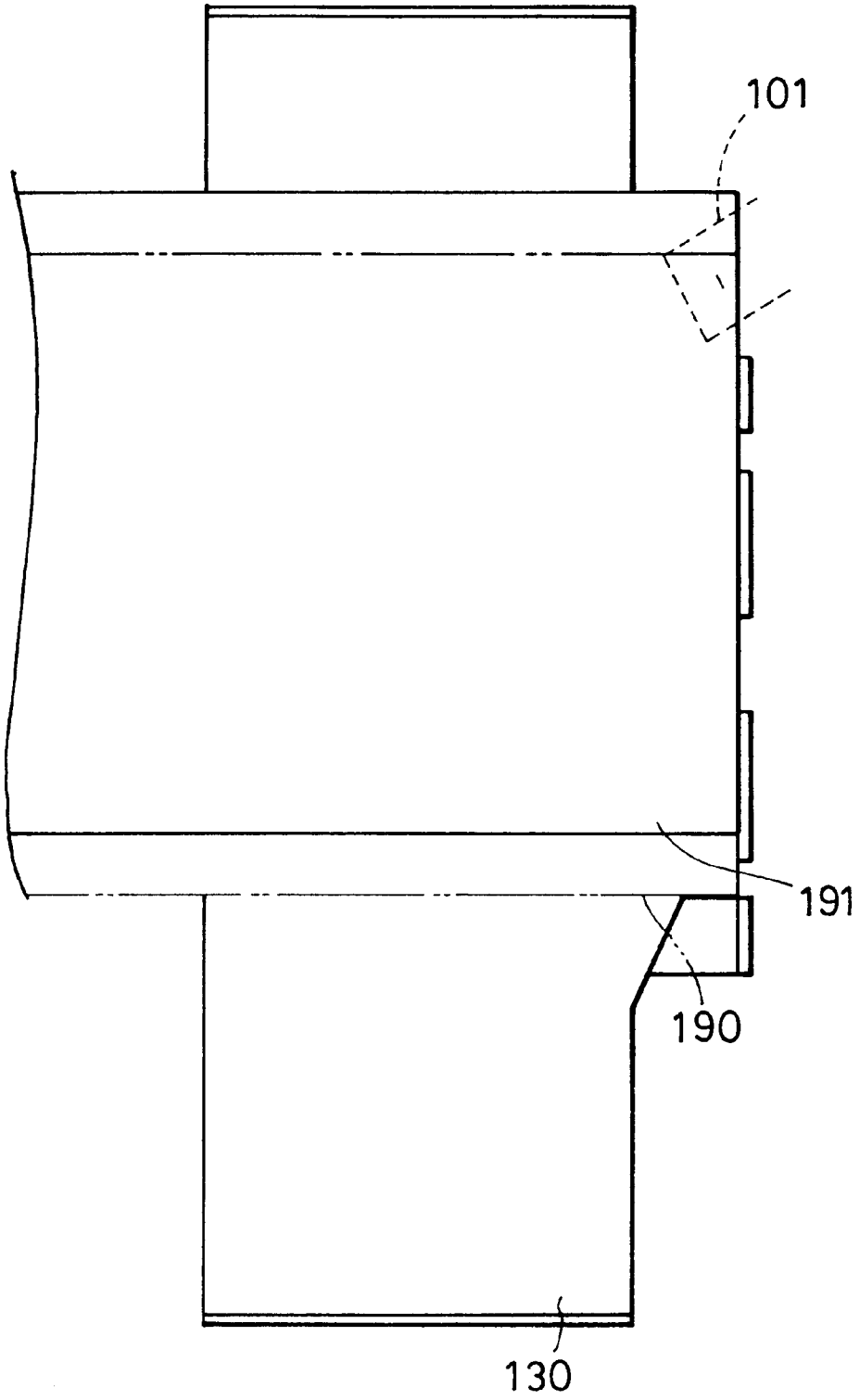
FIG. 42 is a plan view of the processing tray showing the registration operation of the sheet bundle.
Figure 43:
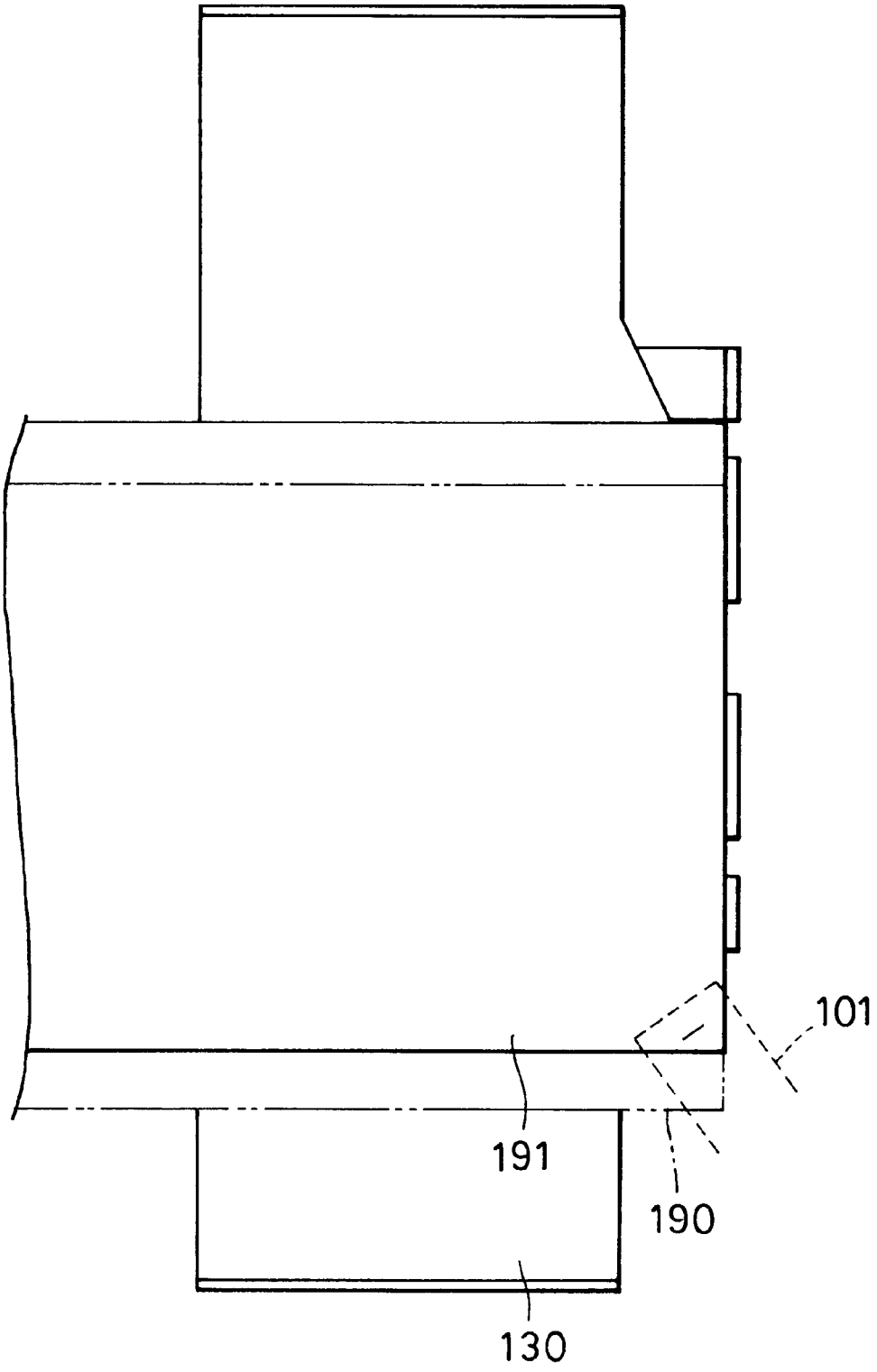
FIG. 43 is a plan view of the processing tray showing the registration operation of the sheet bundle.

FIG. 41 shows the registration positions in the two-position binding mode, FIG. 42 shows the registration positions in the distal oblique binding mode, and FIG. 43 shows the registration positions in the proximal oblique binding mode, respectively, in which the first registration position 190 is shown by the two-dot chain line, and the second registration position 191 is shown by the solid line. When the registration positions are located at the proximal side of the ejection position, the distal registration member 142 transports the sheet to the proximal registration member 141 side. When the registration positions are located at the distal side of the sheet ejection position, the proximal registration member 141 transports the sheet to the distal registration member 142 side.

Therefore, by switching the registration position in response to the binding mode, the sheet can be moved to the position corresponding to the stapler 101.

The movement of the stack tray 200 and the sample tray 201 will now be described with reference to FIGS. 18 and 19. Each of the trays 200 and 201 are maintained at their standby position adjacent each of the respective sheet plane detection sensors before the actuation of the apparatus.

The stack tray 200 can receive the sheets processed by the stapler 101, and an ejected unbound bundle of a few sheets, and load the amount equivalent to 2,000 sheets at most, and the sensor S203*d* detects the loading.

When printer output sheets are continuously output, the stack tray 200 is moved downward from the sensor S203*d* by the amount equivalent to 1,000 sheets (to the position of S203*d*'). Then, the sample tray 201 is moved downward to the sensor S205 to start receiving sheets again. At this time, the sample tray 201 can load the amount equivalent to at most 1,000 sheets, and the sensor S203*c* detects the loading.

When starting the next job or interrupting the present job without removing the sheet on the stack tray 200 after the job equivalent to 2,000 sheets or less has been completed, the sheet cannot be processed, but can be loaded on the sample tray 201 from the non-sort eject path 1021.

A mode of outputting the sheet on the sample tray 201 using the non-sort ejection path 1021 in a normal condition is adopted when a sample output is effected without processing only one set of sheets, and when a sample tray output is set for a function sorting.

Figure 44:
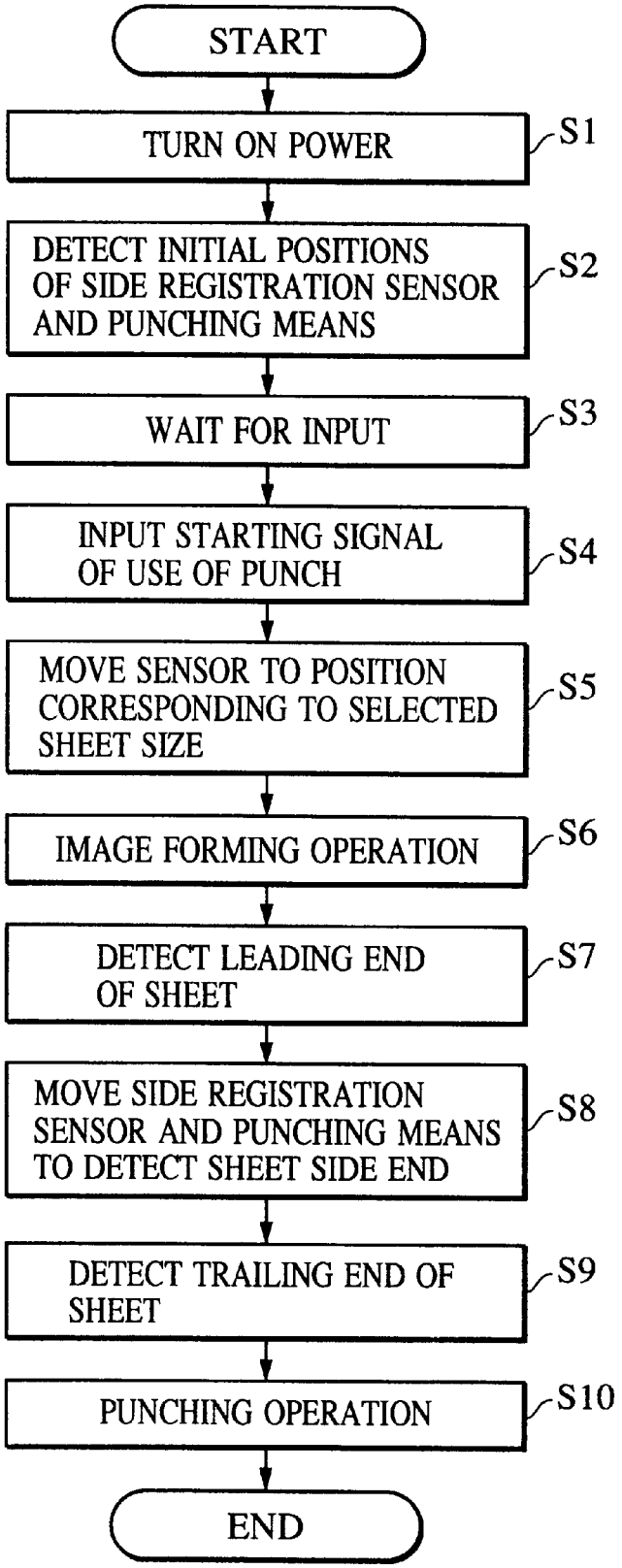
FIG. 44 is a flowchart of a punch mode.

A punch mode will now be described with reference to a flowchart of FIG. 44 laying stress on an operational sequence of the punch unit 1050.

Figure 23:
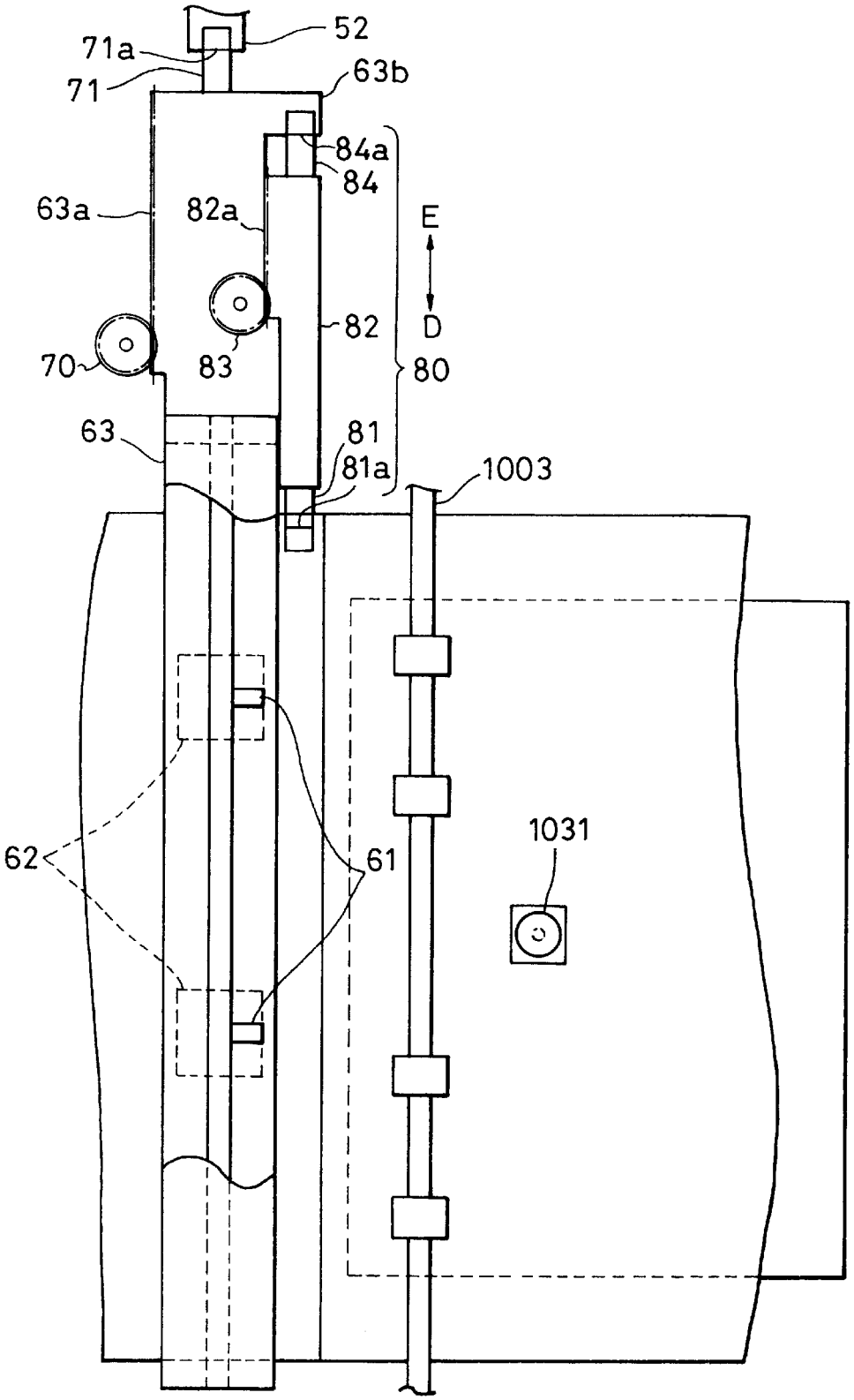
FIG. 23 illustrates a mechanism for moving a side registration detection sensor of the punch unit.
Figure 24:
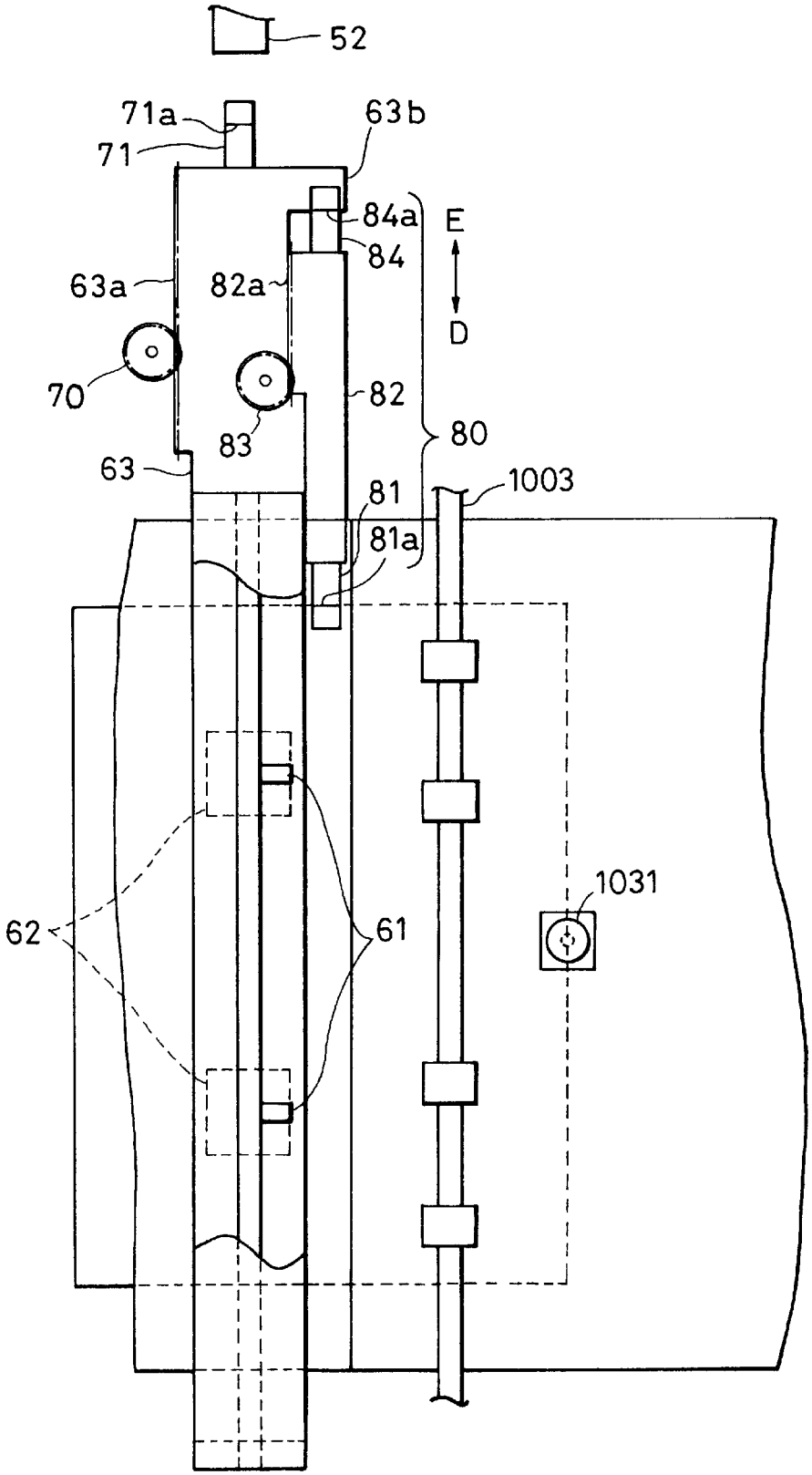
FIG. 24 also illustrates the mechanism for moving a side registration detection sensor of the punch unit.

When the power to the apparatus is turned on in S1, the punching means moving motor is driven in S2 to move the punching means 60 in the direction of the arrow E in FIG. 23, whereby the light receiving portion 71*a* of the punching means initial position detection sensor 71 is blocked by the punching means initial position defining section 52 provided on the finisher 1000 and stops after detecting the initial position.

Similarly, the side registration moving motor is driven to move the sensor arm 82 in the direction of the arrow E, whereby the light receiving portion 84*a* of the side registration initial position detection sensor 84 is blocked by the side registration initial position defining section 63*b* provided on the casing 63, and stops after detecting the initial position. Here, the apparatus awaits an input (S3).

Then, an operator selects buttons (not shown) of the image forming apparatus main body 300 for using the punch, and pushes a start button (not shown) (S4), whereby the transportation of the sheet is started in the image forming apparatus main body 300, and an image forming operation is performed (S6).

At the same time, the side registration moving motor is driven to move the sensor arm 82 in the direction of the arrow D, whereby the side registration detection sensor 81 is moved to the position corresponding to the selected sheet size (S5).

Thereafter, an image forming operation occurs (S6) and the image-formed sheet is transported into the finisher 1000. When the leading end of the sheet passes through the sheet detection sensor 1031, the sheet detection sensor 1031 detects the leading end of the sheet, and drives the punching means moving motor after a predetermined timing to move the punching means 60 and the side registration detection sensor 81 in the direction of the arrow D (S7). When the light receiving portion 81*a* of the side registration detection sensor 81 is blocked by one side end (upper end in FIGS. 23 and 24) of the sheet, the sheet side end is detected and the side registration detection sensor 81 stops (S8).

When the trailing end of the sheet passes through the sheet detection sensor 1031, the trailing end is detected by the sheet detection sensor 1031 (S9). By driving the punch drive motor 66 after a predetermined timing, the punch 61 and the die 62 rotate in the direction of the arrows B and C (FIG. 20), and the punch 61 is engaged with the die hole 62*a* (FIG. 21), thereby punching the sheet in transportation (S10). Thereafter, the sheet is ejected in response to each of the ejection modes as described above to end the punch mode.

As described above, the side registration detection sensor 81 located at the position corresponding to the sheet size, and the punching means 60 are moved in the direction of the arrow D, and stopped at the positions where the sheet side end is detected so as to perform punching, so that punch positions can be justified to the side end of the sheet. In addition, since the side registration detection means 80 is attached to the punching means 60, the punch positions can be justified to the side end of the sheet only by driving the punching means moving motor when the side end of the continuously transported sheets of the same size are detected and punched. Therefore, power consumption of the apparatus can be saved.

[Fifth Embodiment]

Figure 45:
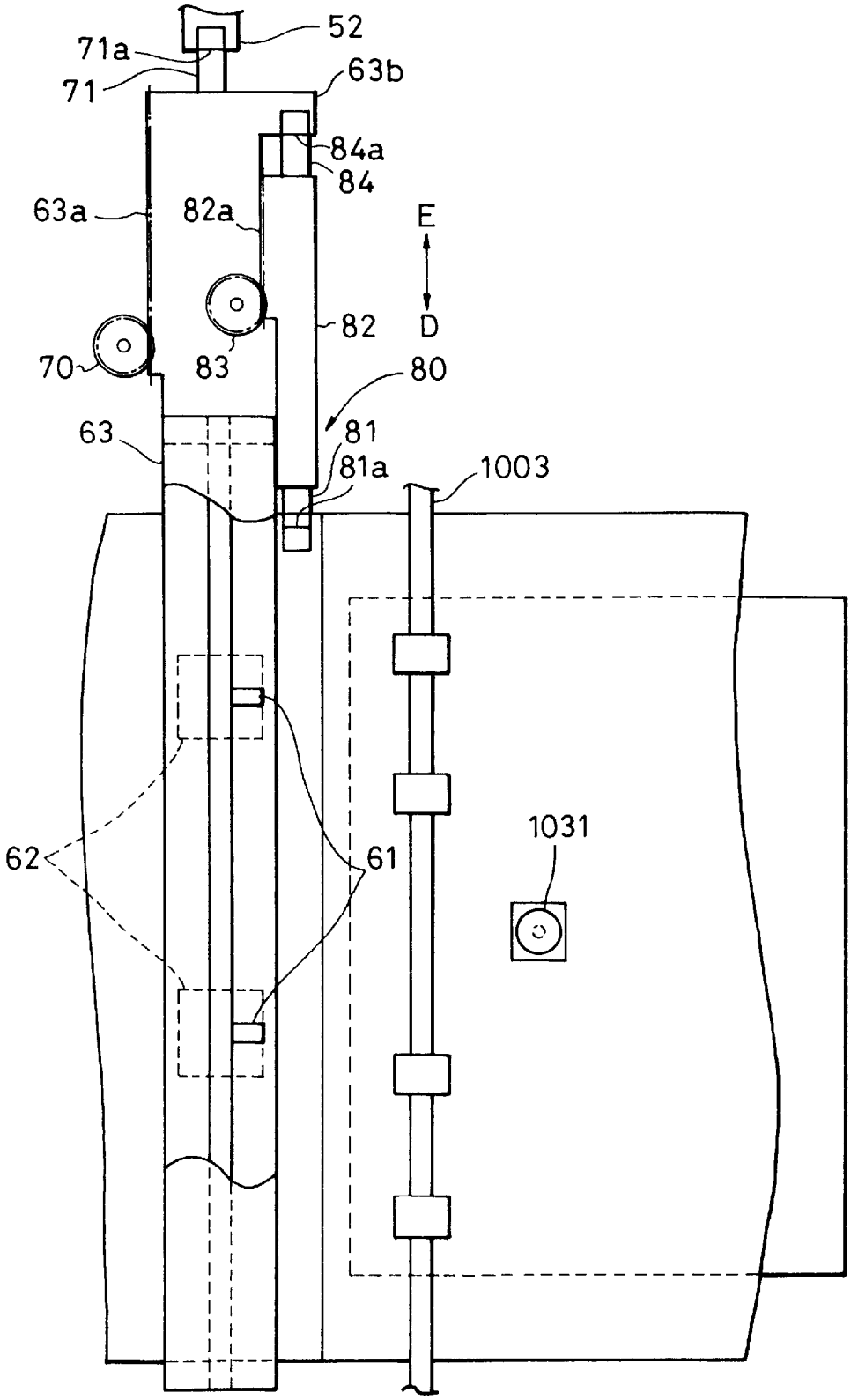
FIG. 45 illustrates a mechanism for moving a side registration detection sensor of a punch unit according to a fifth embodiment of the present invention.
Figure 46:
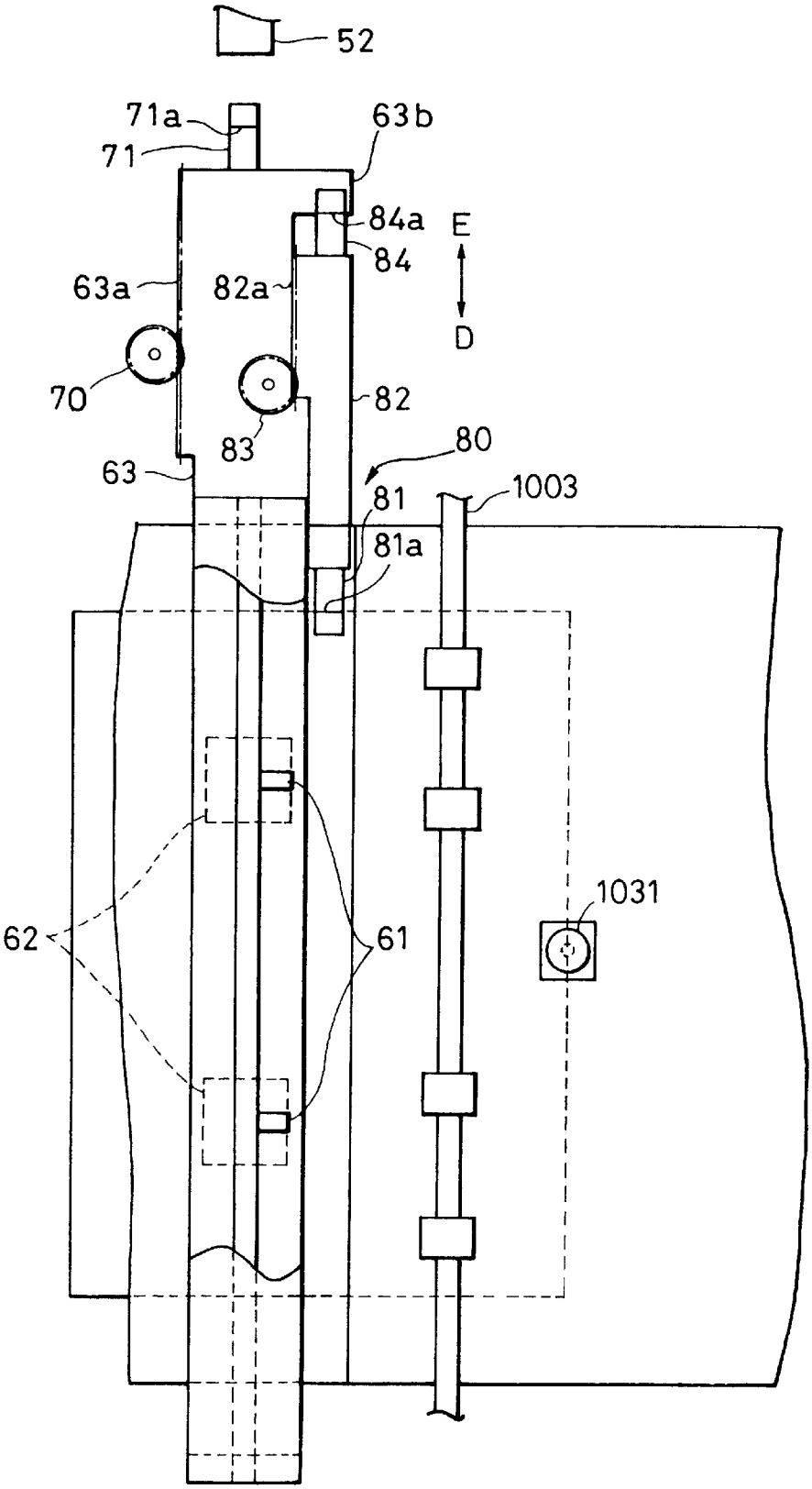
FIG. 46 also illustrates the mechanism for moving the side registration detection sensor of the punch unit according to the fifth embodiment of the present invention.

FIGS. 45 and 46 are views of a mechanism for moving a side registration sensor of a puncher showing a part of the finisher 1000 including a sheet punching device according to a fifth embodiment of the present invention.

The same components as those of the above embodiments are indicated by the same numerals, and their description will be omitted.

The punch unit 1050 includes the punching means 60 and the side registration detection means 80, which is disposed upstream of the punching means 60 at a predetermined distance therefrom.

The side registration initial position detection sensor 84 is moved in the direction of the arrow E by the drive of the pinion gear 70 of the side registration moving motor, whereby the side registration initial position defining section 63*b* can be detected by the light receiving portion 84*a*. In addition, by moving the side registration detection sensor 81 in the direction of the arrow D, one side end (upper end in FIGS. 45 and 46) position of the sheet can be detected by the light receiving portion 81*a*.

When the side end of the sheet is detected, the side registration moving motor is driven with a predetermined timing after the sheet detection sensor 1031 has detected the leading end of the sheet to move the side registration detection sensor 81 in the direction of the arrow D. When the light receiving portion 81*a* of the side registration detection sensor 81 is blocked by the side end of the sheet, the sheet side end is detected and the side registration detection sensor 81 stops.

The punching means 60 is moved in the direction of the arrow D to perform punching by the thus obtained information about the position of the sheet side end, so that the punch positions can be justified to the side end of the sheet.

Figure 47:
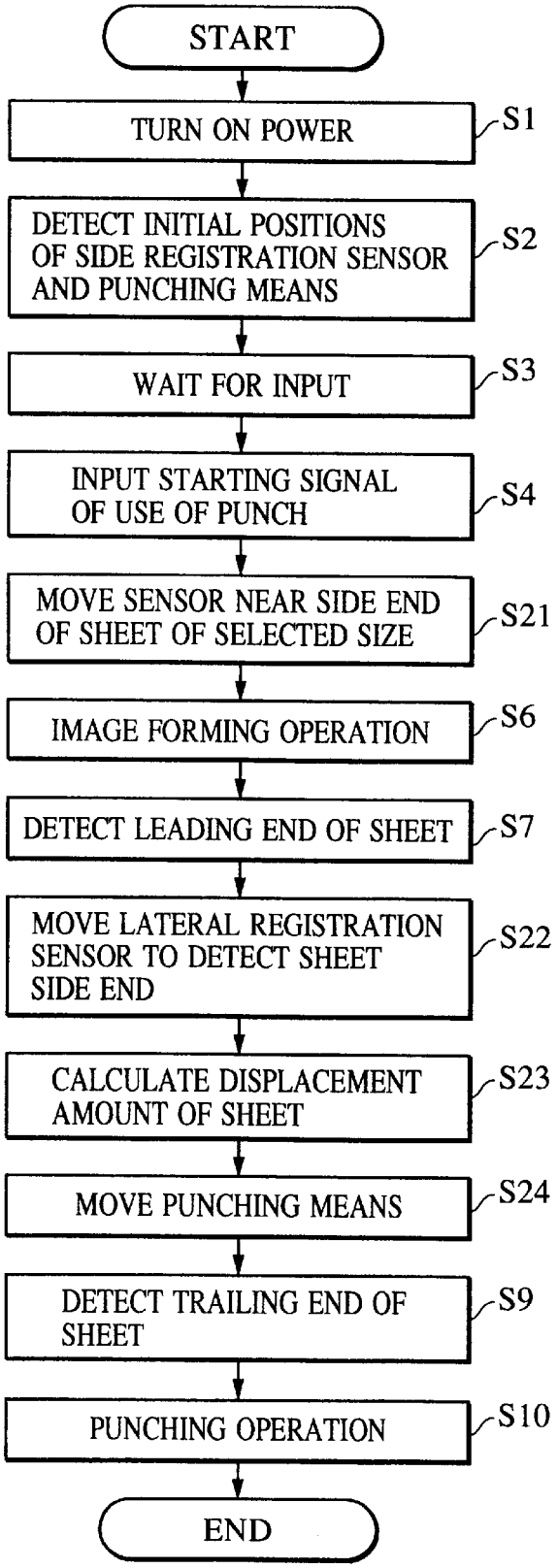
FIG. 47 is a flowchart of the punch mode according to the fifth embodiment.

The operational sequence of the punch unit 1050 will now be described with reference to a flowchart of FIG. 47.

When the power to the apparatus is turned on in S1, the punching means moving motor is driven in S2 to move the punching means 60 in the direction of the arrow E (FIG. 45), whereby the light receiving portion 71*a* of the punching means initial position detection sensor 71 is blocked by the punching means initial position defining section 52 provided on the finisher 1000 and stops after detecting the initial position. Similarly, the side registration moving motor is driven to move the sensor arm 82 in the direction of the arrow E, whereby the light receiving portion 84*a* of the side registration initial position detection sensor 84 is blocked by the side registration initial position defining section 63*b* provided on the finisher 1000 and stops after detecting the initial position. Here, the apparatus awaits an input (S3).

Then, the operator selects buttons (not shown) of the image forming apparatus main body 300 for using the punch, and pushes a start button (not shown) (S4), whereby the transportation of the sheet is started in the image forming apparatus main body 300, and an image forming operation is performed (S6). At the same time, the side registration moving motor is driven to move the sensor arm 82 in the direction of the arrow D, whereby the side registration detection sensor 81 is moved to the position near the side end of the selected sheet size (several millimeters short of the sheet size equivalent to obliqueness and an amount of shift of the sheet) to reduce the amount of movement when detecting the side end of the sheet (S21).

Thereafter, the image-formed sheet is transported into the finisher 1000. When the leading end of the sheet passes through the sheet detection sensor 1031, the sheet detection sensor 1031 detects the leading end of the sheet (S7), and drives the side registration moving motor after a predetermined timing to move the side registration detection sensor 81 in the direction of the arrow D. When the light receiving portion 81*a* of the side registration detection sensor 81 is blocked by one side end (upper end in FIGS. 45 and 46) of the sheet, the sheet side end is detected and the side registration detection sensor stops (S22).

This allows the position of the sheet in transportation to be found, so that an amount of shift of the side registration is calculated (S23), and the punching means moving motor is driven to move the punching means 60 in the direction of the arrow D to the position equivalent to the amount of shift of the side registration (S24). When the trailing end of the sheet passes through the sheet detection sensor 1031, the trailing end of the sheet is detected by the sheet detection sensor 1031 (S9). By driving the punch drive motor 66 after a predetermined timing, the punch 61 and the die 62 rotate in the direction of the arrows B and C, and the punch 61 engages die hole 62*a* provided in the die 62, thereby punching the sheet in transportation (S10).

Figure 48:
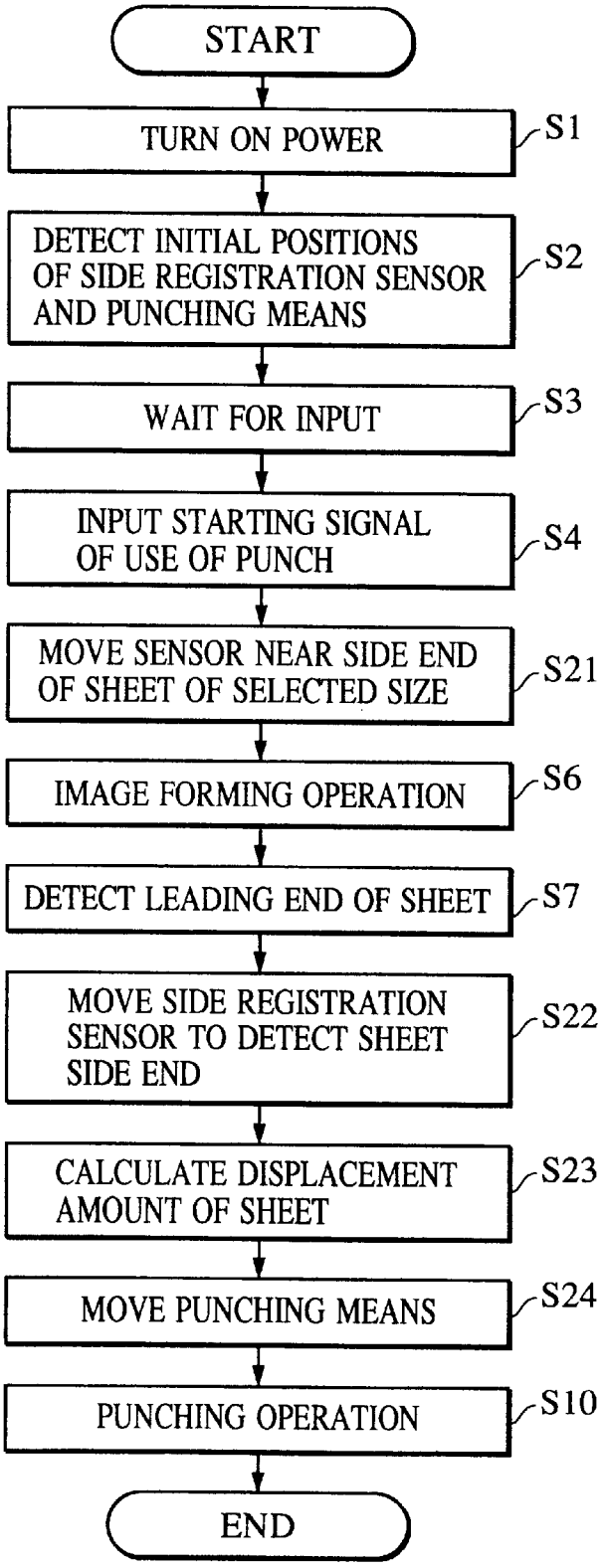
FIG. 48 is a flowchart of the punch mode according to the fifth embodiment.

Although the trailing end of the sheet is punched, the leading end of the sheet can be punched by driving the punch drive motor 66 at a predetermined timing after the sheet detection sensor 1031 has detected the leading end of the sheet. This is accomplished because the side registration detection means 80 is disposed upstream of the punching means 60 at a predetermined distance therefrom. The operational sequence of the punch unit 1050 at that time will be described with reference to a flowchart shown in FIG. 48.

When the power to the apparatus is turned on in S1, the punching means moving motor is driven in S2 to move the punching means 60 in the direction of the arrow E, whereby the light receiving portion 71*a* of the punching means initial position detection sensor 71 is blocked by the punching means initial position defining section 52 provided on the finisher 1000 and stops after detecting the initial position. Similarly, the side registration moving motor is driven to move the sensor arm 82 in the direction of the arrow E, whereby the light receiving portion 84*a* of the side registration initial position detection sensor 84 is blocked by the side registration initial position defining section 63*b* provided on the finisher 1000, and stops after detecting the initial position. Here, the apparatus awaits an input (S3).

Then, the operator selects buttons (not shown) of the image forming apparatus main body 300 for using the punch, and pushes a start button (not shown) (S4), whereby the transportation of the sheet is started in the image forming apparatus main body 300, and an image forming operation is performed (S6). At the same time, the side registration moving motor is driven to move the sensor arm 82 in the direction of the arrow D, whereby the side registration detection sensor 81 is moved to the position near the side end of the selected sheet size (several millimeters short of the sheet size equivalent to obliqueness and an amount of shift of the sheet) to reduce the amount of movement when detecting the side end of the sheet (S21).

Thereafter, the image-formed sheet is transported into the finisher 1000. When the leading end of the sheet passes through the sheet detection sensor 1031, the sheet detection sensor 1031 detects the leading end of the sheet (S7), and drives the side registration moving motor after a predetermined timing to move the side registration detection sensor 81 in the direction of the arrow D. When the light receiving portion 81*a* of the side registration detection sensor 81 is blocked by the side end of the sheet, the sheet side end is detected and the side registration detection sensor stops (S22).

This allows the position of the sheet in transportation to be found, so that an amount of shift of the side registration is calculated (S23), and the punching means moving motor is driven to move the punching means 60 in the direction of the arrow D to the position equivalent to the amount of shift of the side registration (S24). Thereafter, by driving the punch drive motor 66 at a predetermined timing after the sheet detection sensor 1031 has detected the leading end of the sheet, the punch 61 and the die 62 rotate in the direction of the arrows B and C, and the punch 61 engages die hole 62*a* provided in the die 62, thereby punching the sheet in transportation (S10).

As described above, the punching means 60 is moved in the direction of the arrow D to perform punching by the information about the position of the sheet side end obtained by using the side registration detection sensor 81, so that the punch positions can be justified to the side end of the sheet. In addition, the side registration detection means 80 is disposed upstream of the punching means 60 at a predetermined distance therefrom, both of the leading and trailing ends of the sheet can be punched.

[Sixth Embodiment]

Figure 49:
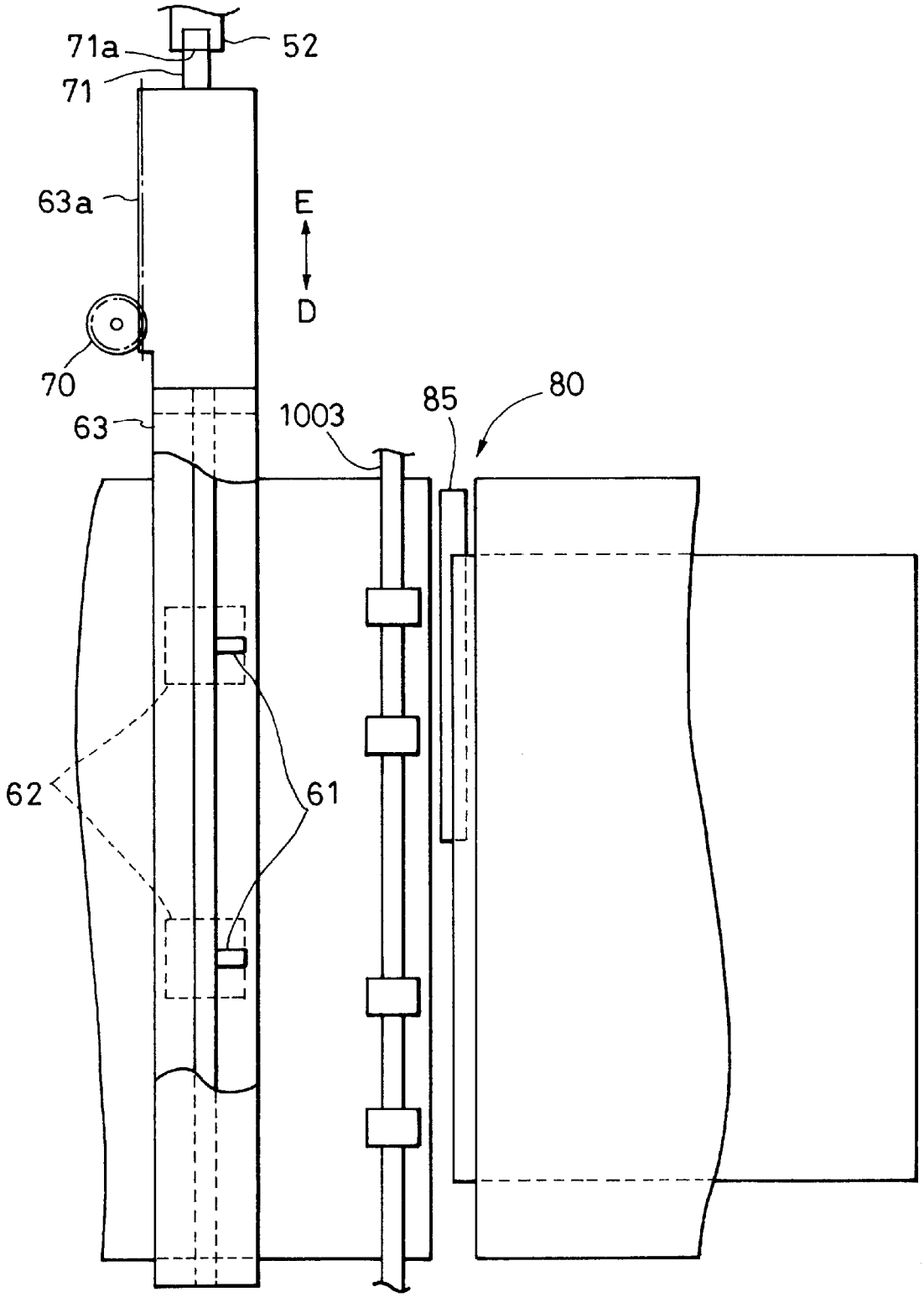
FIG. 49 illustrates a mechanism for moving a side registration detection sensor of a punch unit according to a sixth embodiment of the present invention.
Figure 50:
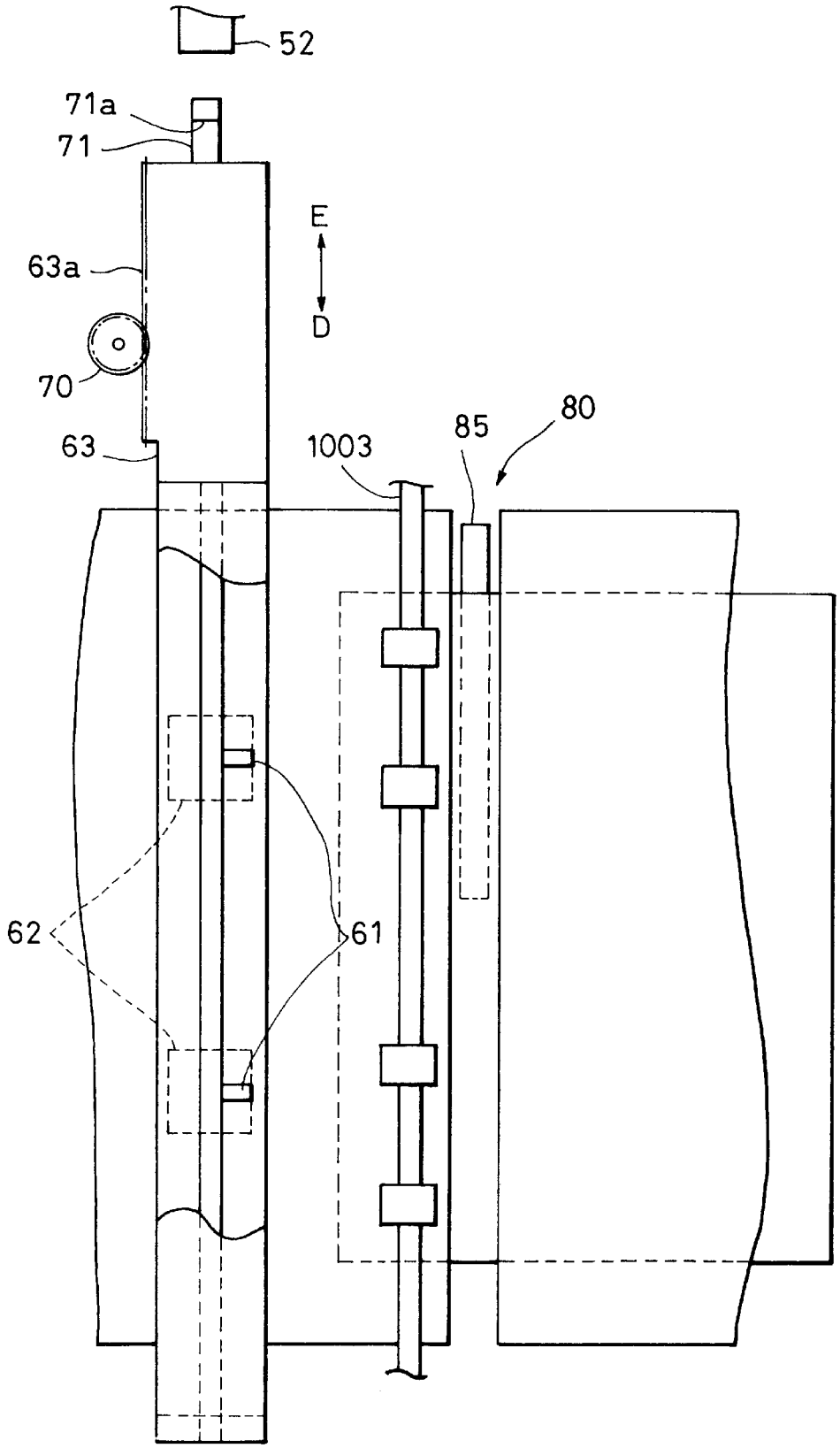
FIG. 50 also illustrates the mechanism for moving the side registration detection sensor of the punch unit according to the sixth embodiment.

FIGS. 49 and 50 are views of a mechanism for moving a side registration sensor of a puncher showing a part of the finisher 1000 including a sheet punching device according to a sixth embodiment of the present invention.

The same components as those of the above embodiments are indicated by the same numerals, and their description will be omitted.

The punch unit 1050 includes the punching means 60 and the side registration detection means 80, which is disposed upstream of the punching means 60 at a predetermined distance therefrom.

The side registration detection means 80 is provided with a CCD side registration detection sensor 85, which is a CCD line sensor, with its detection section being perpendicular to the transport direction of the sheet.

Therefore, when the sheet passes on the CCD side registration detection sensor 85, the side end (upper end in FIGS. 49 and 50) position of the sheet can be detected. In addition, the leading and trailing ends of the sheet can be detected.

The punching means 60 is moved in the direction of the arrow D to perform punching by the thus obtained information about the position of the sheet side end, so that the punch positions can be justified to the side end of the sheet.

In addition, the punching means 60 drives the punch drive motor 66 at a predetermined timing after the CCD side registration detection sensor 85 has detected the leading end of the sheet, thereby punching the sheet in transportation. At this time, by equalizing the rotation speed of the punch 61 and the die 62 to that of the conveyor rollers 1003, the sheet in transportation can be punched.

Figure 51:
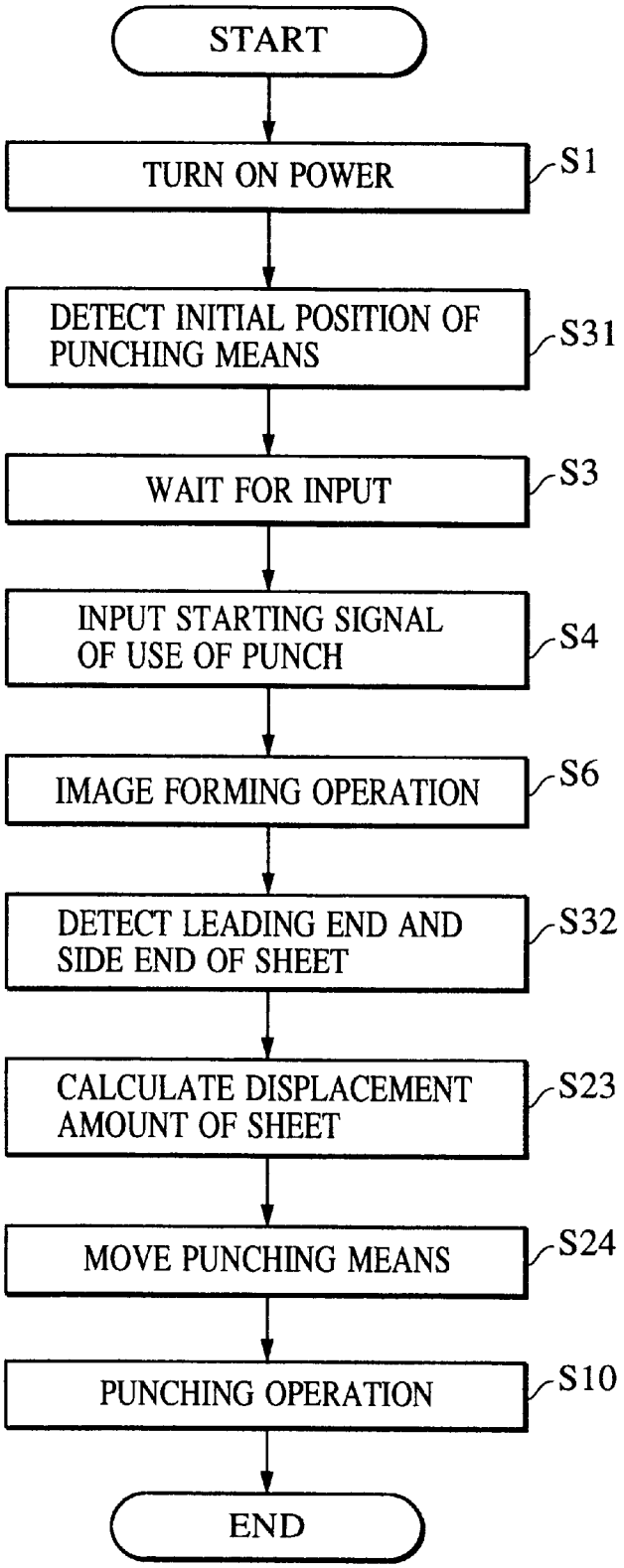
FIG. 51 is a flowchart of the punch mode according to the sixth embodiment.

The operational sequence of the punch unit 1050 will be described with reference to a flowchart shown in FIG. 51.

When the power to the apparatus is turned on in S1, the punching means moving motor is driven in S31 to move the punching means 60 in the direction of the arrow E, whereby the light receiving portion 71*a* of the punching means initial position detection sensor 71 is blocked by the punching means initial position defining section 52 provided on the finisher 1000 and stops after detecting the initial position. Here, the apparatus awaits an input (S3).

Then, the operator selects buttons (not shown) of the image forming apparatus main body 300 for using the punch, and pushes a start button (not shown) (S4), whereby the transportation of the sheet is started in the image forming apparatus main body 300, and an image forming operation is performed (S6). Thereafter, the image-formed sheet is transported into the finisher 1000. When the leading end of the sheet passes through the CCD side registration detection sensor 85, the CCD side registration detection sensor 85 detects the leading end and the side end of the sheet (S32).

This allows the position of the sheet in transportation to be found, so that an amount of shift of side registration is calculated (S23), and the punching means moving motor is driven to move the punching means 60 in the direction of the arrow D to the position equivalent to the amount of shift of the side registration (S24). By driving the punch drive motor 66 after a predetermined timing, the punch 61 and the die 62 rotate in the direction of the arrows B and C, and the punch 61 is engaged with the die hole 62*a* provided in the die 62, thereby punching the sheet in transportation (S10).

Although the leading end of the sheet is punched, the trailing end of the sheet can be punched by driving the punch drive motor 66 at a predetermined timing after the CCD side registration detection sensor 85 has detected the trailing end of the sheet, because the side registration detection means 80 is disposed upstream of the punching means at a predetermined distance therefrom.

As described above, the punching means 60 is moved in the direction of the arrow D to perform punching by the information about the position of the sheet side end obtained by using the CCD side registration detection sensor 85, so that the punch positions can be justified to the side end of the sheet. Further, the use of the CCD side registration detection sensor 85 allows the sheet side end to be detected without moving the sensor 85, so that power consumption of the apparatus can be saved.

Moreover, the leading and trailing ends of the sheet can be detected by using the CCD side registration detection sensor 85, so that information about the sheet side end to be punched can be obtained, whereby the amount of shift of the side registration of the sheet can be minimized when the sheet obliques. In addition, the use of the CCD side registration detection sensor 85 enables the detection of the leading and trailing ends of the sheet, so that the sheet detection sensor 1031 is not needed and the number of components can be reduced. Further, the side registration detection means 80 is disposed upstream of the punching means 60 at a predetermined distance therefrom, both of the leading and trailing ends of the sheet can be punched.

[Seventh Embodiment]

Figure 52:
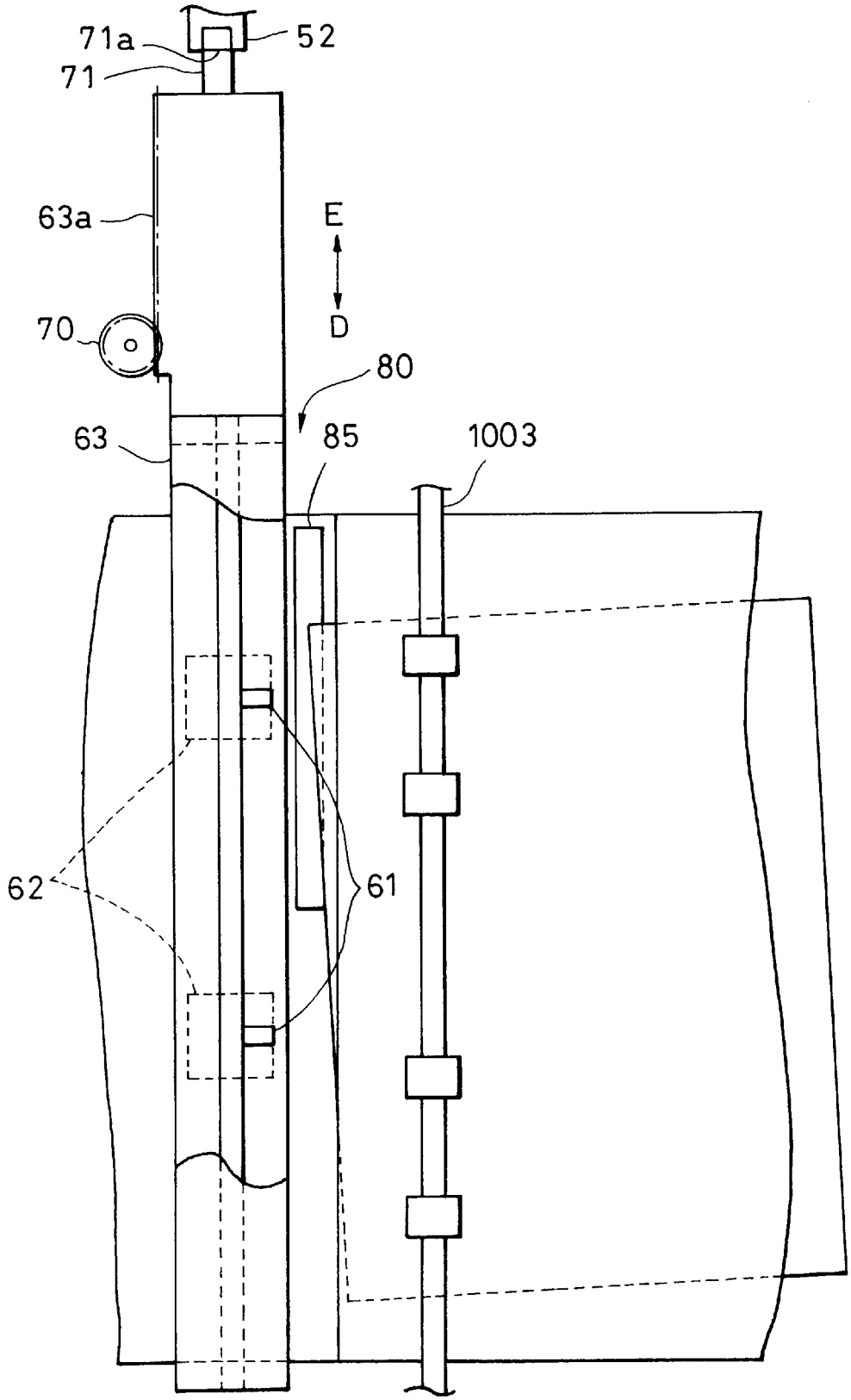
FIG. 52 illustrates a mechanism for moving a side registration detection sensor of a punch unit according to a seventh embodiment of the present invention.
Figure 53:
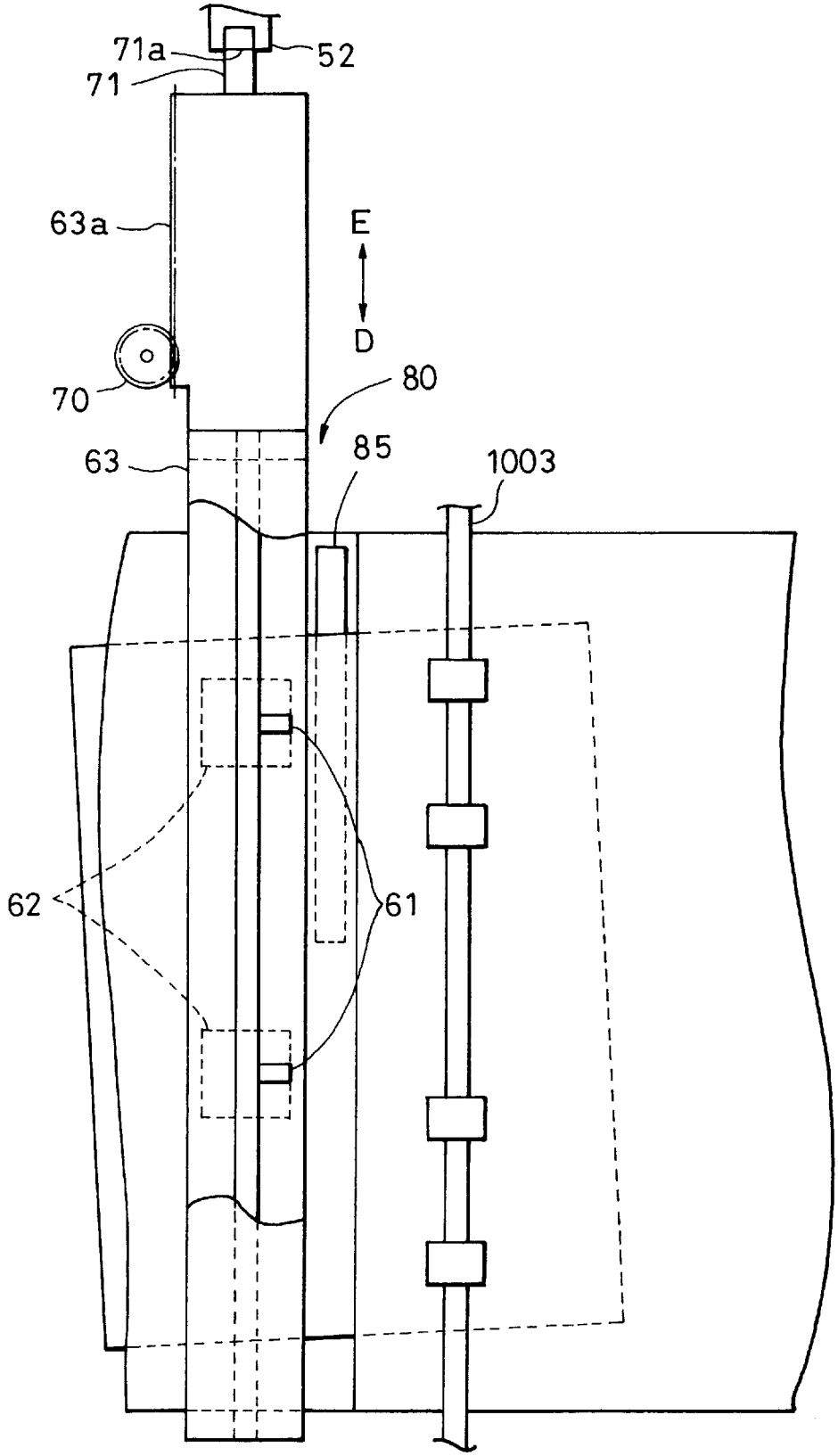
FIG. 53 also illustrates the mechanism for moving the side registration detection sensor of the punch unit according to the seventh embodiment.
Figure 54:
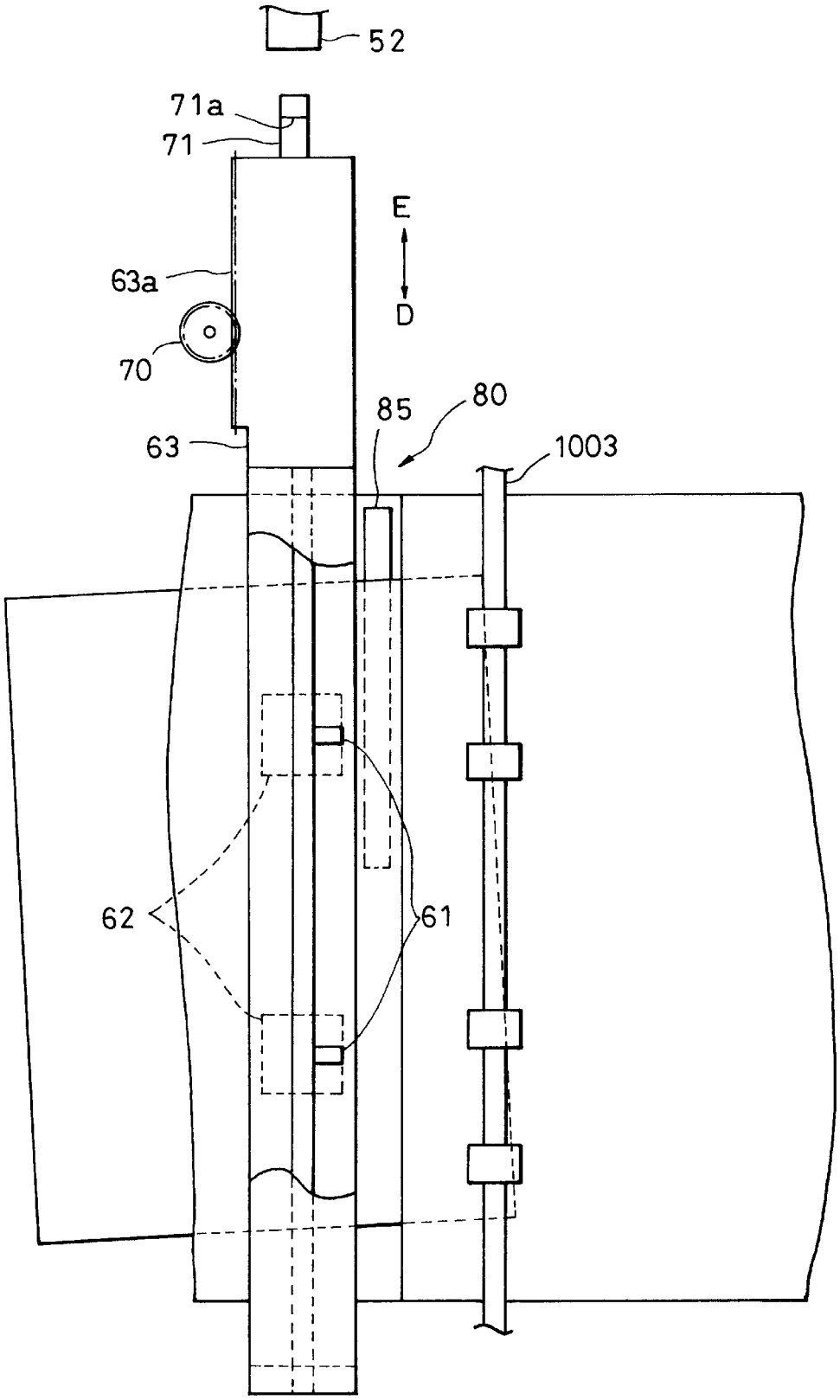
FIG. 54 further illustrates mechanism for moving the side registration detection sensor of the punch unit according to the seventh embodiment.
Figure 55:
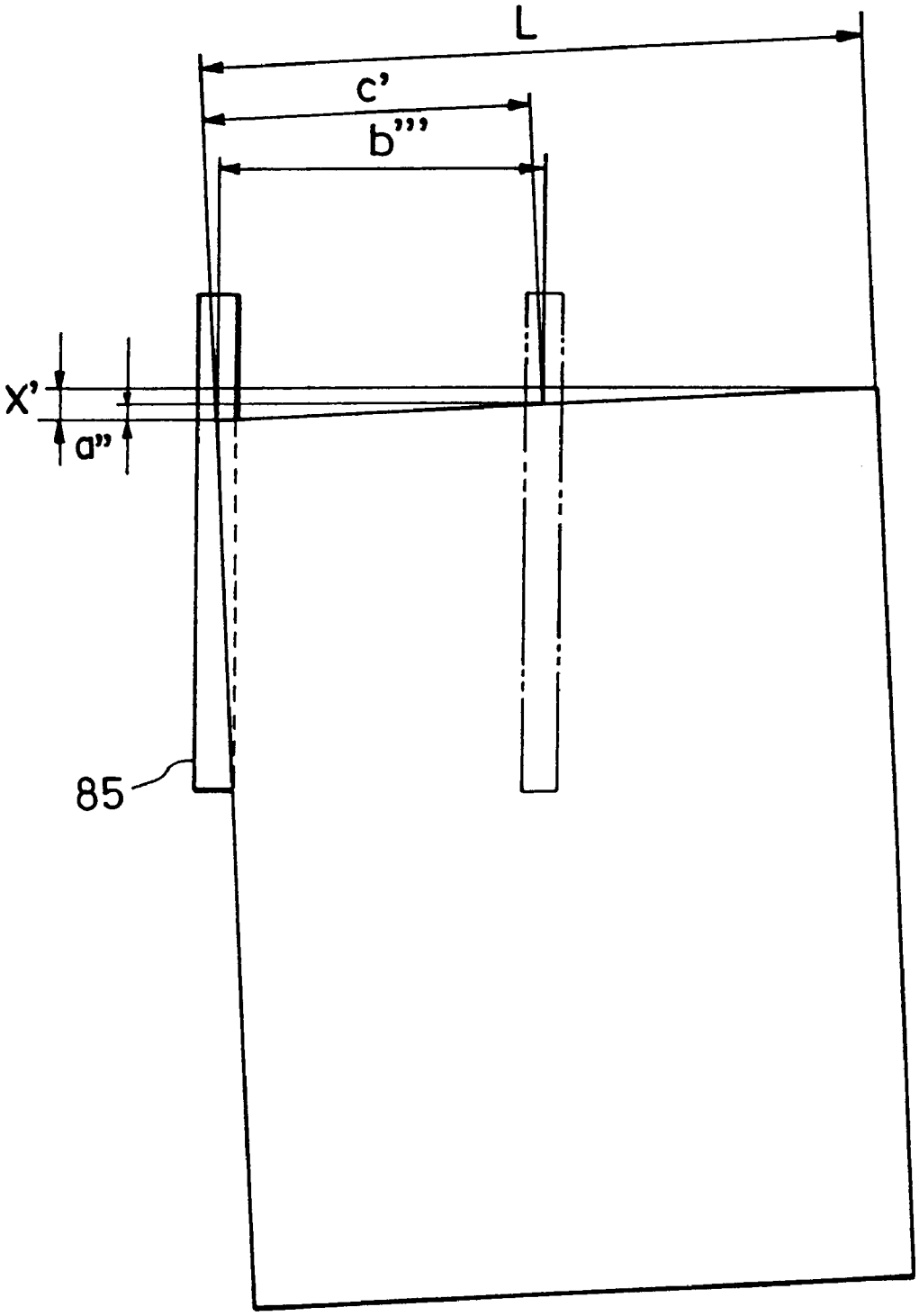
FIG. 55 is a plan view showing a state in which a plurality of side end positions of an oblique sheet are detected.

FIGS. 52, 53 and 54 are views of a mechanism for moving a side registration sensor of a puncher showing a part of the finisher 1000 including a sheet punching device according to a seventh embodiment of the present invention. FIG. 55 is an illustration in which the side end position of the oblique sheet is detected.

The same components as those of the above embodiments are indicated by the same numerals, and their description will be omitted.

The punch unit 1050 includes the punching means 60 and the side registration detection means 80, which is disposed upstream of the punching means 60 at a predetermined distance therefrom.

The side registration detection means 80 is provided with a CCD side registration detection sensor 85, which is a CCD line sensor, with its detection section being perpendicular to the transport direction A of the sheet.

Therefore, when the sheet passes on the CCD side registration detection sensor 85, the side end (upper end in FIGS. 52, 53 and 54) position of the sheet can be detected. In addition, the leading and trailing ends of the sheet can be detected. Here, the side end position of the sheet is detected two times, i.e., when the leading end of the sheet passing through the CCD side registration detection sensor 85, and after a predetermined timing thereof.

From the difference a" between the side registration positions, which are information about the positions of the sheet side end detected two times, and an amount of transportation b'" obtained from a transport speed of the sheet, the actual length c between the positions of the sheet side end detected two times is calculated (FIG. 55). Further, the difference x' between the side registration positions corresponding to the length L of the transport direction of the sheet obtained from information about the sheet size is calculated, and the punching means 60 is moved in the direction of the arrow D to perform punching, so that the punch positions when punching the trailing end of the sheet can be justified to the sheet side end.

In addition, the punching means 60 drives the punch drive motor 66 at the predetermined timing after the CCD side registration detection sensor 85 has detected the leading end of the sheet, thereby punching the sheet in transportation. At this time, by equalizing the rotation speed of the punch 61 and the die 62 to that of the conveyor rollers 1003, the sheet in transportation can be punched.

Figure 56:
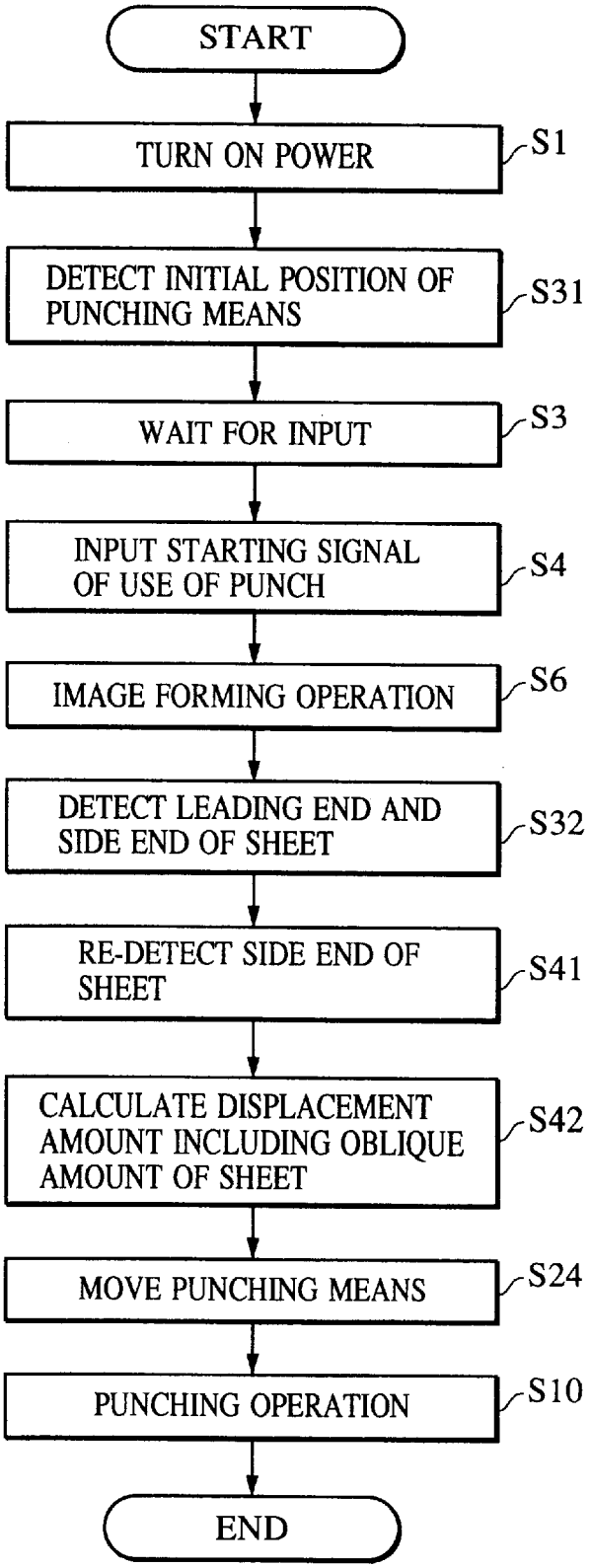
FIG. 56 is a flowchart of the punch mode according to the seventh embodiment.

The operational sequence of the punch unit 1050 will now be described with reference to a flowchart shown in FIG. 56.

When the power to the apparatus is turned on in S1, the punching means moving motor is driven in S31 to move the punching means 60 in the direction of the arrow E, whereby the light receiving portion 71*a* of the punching means initial position detection sensor 71 is blocked by the punching means initial position defining section 52 provided on the finisher 1000 and stops after detecting the initial position. Here, the apparatus awaits an input (S3).

Then, the operator selects buttons (not shown) of the image forming apparatus main body 300 for using the punch, and pushes a start button (not shown) (S4), whereby the transportation of the sheet is started in the image forming apparatus main body 300, and an image forming operation is performed (S6). Thereafter, the image-formed sheet is transported into the finisher 1000. When the leading end of the sheet passes through the CCD side registration detection sensor 85, the CCD side registration detection sensor 85 detects the leading and side ends of the sheet (S32). After the predetermined timing, the side end of the sheet is detected again (S41).

This allows the position of the sheet in transportation to be found, so that an amount of shift of the side registration including the oblique amount at the sheet trailing end is calculated from the difference a between the side registration positions, and the amount of transportation b (S42), and the punching means moving motor is driven to move the punching means 60 in the direction of the arrow D to a position equivalent to the amount of shift of the side registration (S24). By driving the punch drive motor 66 after a predetermined timing, the punch 61 and the die 62 rotate in the direction of the arrows B and C, and the punch 61 engages the die hole 62*a* provided in the die 62, thereby punching the sheet in transportation (S10).

As described above, the amount of shift of the side registration including the oblique amount at the sheet trailing end is calculated from information about two positions of the sheet side end obtained by using the CCD side registration detection sensor 85, and the punching means 60 is moved in the direction of the arrow D to perform punching. Therefore, even if the CCD side registration detection sensor 85 is brought near the upstream of the punching means 60 to save space, the amount of shift of the side registration can be minimized when the sheet obliques.

In addition, if the sheet is not oblique, the punch positions can be justified to the sheet side end. Further, the use of the CCD side registration detection sensor 85 allows the sheet side end to be detected without moving the sensor 85, so that power consumption of the apparatus can be saved. Moreover, the use of the CCD side registration detection sensor 85 enables the detection of the leading and trailing ends of the sheet, so that the sheet detection sensor 1031 is not needed, whereby the number of components can be reduced.

Although the sheet punching device is provided in the sheet processing device in the above-described embodiments, the same effect can be obtained either the sheet punching device is provided in the image forming apparatus main body, or used singly. In addition, the punching operation may be performed by stopping the sheet for a short period of time.

As described above, according to the fourth to seventh embodiments of the present invention, one side of the sheet parallel to the transport direction of the sheet is detected by the side registration detection means, and the punching means is moved to the punch positions based on the information about the position of the sheet side end. Thus, the punch positions of the sheet can be justified to one side end of the sheet. In addition, even if a sheet output apparatus transports the sheet with a side shift, the side registration detection means continuously detects the side shift to move the punching means to proper punch positions. Thus, the sheet can be continuously punched without decreasing a processing speed of the sheet output apparatus, such as an image forming apparatus.

In addition, the provision of the side registration detecting means on the punching means allows the punch positions to be justified to the sheet side end by only driving the means for moving the punching means when punching the continuously transported sheets of the same size, so that a driving operation of the side registration detection sensor is omitted, and power consumption of the apparatus can be saved.

Further, of the leading end and the trailing end of the sheet to be transported, one side end to be punched parallel to the transport direction is detected by the side registration detection means, and the punch positions of the punching means are moved on the basis of information about the detected side end position. Therefore, the punch positions of the sheet can be justified to one side end of the sheet, and the oblique sheet can also be punched with minimizing the amount of shift of the hole positions with respect to the sheet side end.

Still further, a plurality of sections in one side end of the sheet parallel to the transport direction of the sheet are detected by the side registration detection means to detect the oblique amount of the sheet, and the punch positions of the punching means are moved on the basis of the information about the position of the sheet side end and the oblique amount. Therefore, the punching operation can be performed with justifying the hole positions with respect to the sheet side end, and the oblique sheet can also be punched with minimizing the amount of shift of the hole positions with respect to the sheet side end.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet transport apparatus comprising:

a puncher for punching a hole in a sheet as the sheet is being transported through a transport path, said transport path extending downstream of said puncher;

transport means for clamping and transporting said sheet, said transport means disposed downstream of said puncher and having a first rotation member and a second rotation member for pressing the sheet into contact with said first rotation member, wherein said transport means is disposed at an upstream end of said transport path and at a position where a hole punched by said puncher passes through.

2. A sheet transport apparatus according to claim 1, wherein each of the first and second rotation members has a width larger than a diameter of a hole punched by said puncher.

3. A sheet transport apparatus according to claim 1, wherein the first and second rotation members of said transport means are formed successively over a region wider than a punching region of said puncher.

4. A sheet transport apparatus according to claim 3, wherein said puncher is a multiple-hole puncher for punching multiple holes in the sheet as the sheet is being transported.

5. A sheet transport apparatus according to claim 1, wherein said puncher comprises a punch rotating in the transport direction of the sheet at a peripheral speed equal to a transport speed of the sheet and a die rotating in synchronization with said punch and opposing said punch with the transport path sandwiched therebetween.

6. A sheet transport apparatus according to claim 5 further comprising a tray for receiving and loading punched sheets, wherein said punch is disposed so that the punched surface of the punched sheets passed through said puncher and transport means in said transport path faces upward when loaded on said tray.

7. A sheet transport apparatus comprising:

a puncher for punching a hole in a sheet as the sheet is being transported through a transport path; and transport means for clamping and transporting said sheet, said transport means disposed downstream of said puncher and having a first rotation member and a second rotation member for pressing the sheet into contact with said first rotation member, wherein said transport means is disposed at a position where a hole punched by said puncher passes through, and wherein said puncher punches a predetermined number of holes aligned in a direction axial to the rotation members, and each of said first and second rotation members includes a number of separate rollers equal to the predetermined number of punch holes in the axial direction.

8. A sheet transport apparatus according to claim 7, wherein each of said first and second rotation members has only a number of separate rollers equal to the number of the punch holes.

9. A sheet transport apparatus comprising:

a puncher for punching a hole in a sheet as the sheet is being transported through a transport path; and transport means for clamping and transporting said sheet, said transport means disposed downstream of said puncher and having a first rotation member and a second rotation member for pressing the sheet into contact with said first rotation member, wherein said transport means is disposed at a position where a hole punched by said puncher passes through, and wherein said puncher punches a predetermined number of holes aligned in a direction axial to the rotation members and each of said first and second rotation members includes a number of separate rollers less than the predetermined number of the punched holes in an axial direction, and wherein a third rotation member is provided downstream of said first and second rotation members, and said third rotation member includes a number of separate rollers that together with the number of separate rollers included in the first and second rotation members is equal to the predetermined number of punched holes in an axial direction.

10. A sheet transport apparatus comprising:

a puncher for punching a hole in a sheet as the sheet is being transported through a transport path; and transport means for clamping and transporting said sheet, said transport means disposed downstream of said puncher and having a first rotation member and a second rotation member for pressing the sheet into contact with said first rotation member, wherein said transport means is disposed at a position where a hole punched by said puncher passes through, and wherein one of said rotation members is a rubber roller, and the other one of said rotation members is a resin roller.

11. A sheet processing device, comprising:

guide means for forming a sheet transport path;

a sheet puncher provided at an upstream end of the sheet transport path for punching a hole in a punching region of a sheet;

conveyor rotation members provided at an upstream end of said sheet transport path, said conveyor rotation members provided downstream of said puncher and overlapping with the punching region of the sheet; and a first tray provided downstream of said conveyor rotation members for receiving and loading thereon the punched sheet.

12. A sheet processing device according to claim 11, wherein each of said conveyor rotation members has a width larger than a diameter of a hole punched by said sheet puncher.

13. A sheet processing device according to claim 11, wherein said conveyor rotation members are formed successively over a region wider than the punching region of said puncher.

14. A sheet processing device according to claim 13, wherein said puncher is a multiple-hole puncher for punching multiple holes in the sheet as the sheet is being transported.

15. A sheet processing device according to claim 11, wherein said puncher comprises a punch rotating in the transport direction of the sheet at a peripheral speed equal to a transport speed of the sheet, and a die rotating in synchronization with said punch and opposing said punch with the transport path sandwiched therebetween.

16. A sheet processing device according to claim 15, further comprising a tray for receiving and loading punched sheets, wherein said punch is disposed so that the punched surface of the punched sheets passed through said puncher and said conveyor rotation members in said sheet transport path faces upward when loaded on said tray.

17. A sheet processing device comprising:

guide means for forming a sheet transport path;

a sheet puncher provided in the sheet transport path for punching a hole in a punching region of a sheet;

conveyor rotation members provided in said sheet transport path, said conveyor rotation members provided downstream of said puncher and overlapping with the punching region of the sheet;

a first tray provided downstream of said conveyor rotation members for receiving and loading thereon the punched sheet;

branching means provided between said first tray and said conveyor rotation members for directing the punched sheet down a branch other than to the first tray;

a transport path for guiding the branched sheet;

binding means for collecting and binding guided sheets; and a second tray for receiving the bound sheet bundle.

18. A sheet processing device, comprising:

guide means for forming a sheet transport path;

a sheet puncher provided at an upstream end of the sheet transport path for punching a hole in a punching region of a sheet;

conveyor rotation members provided at an upstream end of said sheet transport path, said conveyor rotation members provided downstream of said sheet puncher and overlapping with the punching region of the sheet; and a first tray provided downstream of said conveyor rotation members for receiving and loading thereon the punched sheet, wherein a sheet on which an image is formed by an image forming means is fed to said sheet processing device to be processed.

19. A sheet processing device comprising:

guide means for forming a sheet transport path;

a sheet puncher provided in the sheet transport path for punching a hole in a punching region of a sheet;

conveyor rotation members provided in said sheet transport path, said conveyor rotation members provided downstream of said sheet puncher and overlapping with the punching region of the sheet;

a first tray provided downstream of said conveyor rotation members for receiving and loading thereon the punched sheet, wherein a sheet on which an image is formed by an image forming means is fed to said sheet processing device to be processed;

branching means provided between said first tray and said conveyor rotation members for directing the punched sheet down a branch other than to the first tray;

a transport path for guiding the branched sheet;

binding means for collecting and binding guided sheets; and a second tray for receiving the bound sheet bundle, wherein a sheet on which an image is formed by an image forming means is fed to said sheet processing device to be processed.

20. A sheet transport apparatus comprising:

a puncher for punching a hole in a sheet as the sheet is being transported through a transport path; and transport means for clamping and transporting said sheet, said transport means disposed downstream of said puncher and having a first rotation member and a second rotation member for pressing the sheet into contact with said first rotation member, wherein said transport means is disposed at a position where a hole punched by said puncher passes through, and wherein said puncher punches a predetermined number of holes aligned in a direction axial to the rotation members, and each of said first and second rotation members includes a number of separate rollers corresponding to the position of the predetermined number of punch holes in the axial direction.

21. A sheet transport apparatus according to claim 20, wherein each of said first and second rotation members has only a number of separate rollers corresponding to the number of the punch holes.

* * * * *

UNITED STATES PATENT AND TRADEMARK OFFICE

CERTIFICATE OF CORRECTION

PATENT NO. : 5,911,414

DATED : June 15, 1999

INVENTOR(S) : KATSUHITO KATO, ET AL.

It is certified that error appears in the above-identified patent and that said Letters Patent is hereby corrected as shown below:

COLUMN 13,
Line 56, "puddle" should read --paddle--; and
Line 62, "puddle" should read --paddle--.
COLUMN 15,
Line 22, "s205." should read --S205.--.
COLUMN 18,
Line 3, "(a" should read --(a'--.
COLUMN 26,
Line 32, "obtained" should read --obtained when--.
COLUMN 27,
Line 51, "claim 5" should read --claim 5,--.

Signed and Sealed this

Fourteenth Day of December, 1999

*Attest:*

Q. TODD DICKINSON

*Attesting Officer*

*Acting Commissioner of Patents and Trademarks*